US009803267B2

(12) United States Patent
Roscoe

(10) Patent No.: US 9,803,267 B2
(45) Date of Patent: Oct. 31, 2017

(54) AUSTENITIC STAINLESS STEEL

(75) Inventor: Cecil Vernon Roscoe, Singapore (SG)

(73) Assignee: UPL, L.L.C., Singapore (SG)

( * ) Notice: Subject to any disclaimer, the term of this patent is extended or adjusted under 35 U.S.C. 154(b) by 0 days.

(21) Appl. No.: 14/119,153

(22) PCT Filed: May 24, 2012

(86) PCT No.: PCT/SG2012/000183

§ 371 (c)(1),
(2), (4) Date: Nov. 20, 2013

(87) PCT Pub. No.: WO2012/161661

PCT Pub. Date: Nov. 29, 2012

(65) Prior Publication Data

US 2014/0134039 A1 May 15, 2014

(30) Foreign Application Priority Data

May 26, 2011 (SG) ..... 201103887-4

(51) Int. Cl.

| | |
|---|---|
| ***C22C 38/44*** | (2006.01) |
| ***C22C 38/48*** | (2006.01) |
| ***C22C 38/58*** | (2006.01) |
| ***C22C 38/34*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/46*** | (2006.01) |
| ***C22C 38/50*** | (2006.01) |
| ***C22C 38/54*** | (2006.01) |

(52) U.S. Cl.

CPC ..... *C22C 38/34* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01); *C22C 38/58* (2013.01)

(58) Field of Classification Search

None

See application file for complete search history.

(56) References Cited

U.S. PATENT DOCUMENTS

| | | | | |
|---|---|---|---|---|
| 3,152,934 | A | 10/1964 | Lula et al. | |
| 3,476,555 | A | 11/1969 | Kohl et al. | |
| 3,551,142 | A | 12/1970 | Decroix | |
| 3,854,937 | A | 12/1974 | Muta et al. | |
| 3,969,109 | A | 7/1976 | Tanczyn | |
| 4,172,716 | A | 10/1979 | Abo et al. | |
| 4,341,555 | A | 7/1982 | Douthett et al. | |
| 4,371,394 | A | 2/1983 | Henthorne et al. | |
| 4,421,557 | A | 12/1983 | Rossomme et al. | |
| 4,559,090 | A | 12/1985 | Grutzner | |
| 4,824,638 | A * | 4/1989 | Culling | 420/582 |
| 4,861,547 | A | 8/1989 | Culling | |
| 4,929,419 | A | 5/1990 | Wegman et al. | |
| 5,064,610 | A | 11/1991 | Sato et al. | |
| 5,141,705 | A | 8/1992 | Stenvall et al. | |
| 5,194,221 | A | 3/1993 | Culling | |
| 5,411,701 | A * | 5/1995 | Holmberg | 420/48 |
| 5,494,636 | A * | 2/1996 | Dupoiron et al. | 420/586.1 |
| 5,783,143 | A | 7/1998 | Handa et al. | |
| 6,300,001 | B1 | 10/2001 | Hornung et al. | |
| 6,905,652 | B2 * | 6/2005 | Ulfvin et al. | 420/586.1 |
| 2001/0031217 | A1 | 10/2001 | Bergstrom et al. | |
| 2003/0086808 | A1 | 5/2003 | Sundstrom et al. | |
| 2003/0143105 | A1 * | 7/2003 | Bahar | C22C 38/005 420/586.1 |
| 2004/0050463 | A1 | 3/2004 | Jung et al. | |
| 2005/0072268 | A1 | 4/2005 | Sjodin et al. | |

(Continued)

FOREIGN PATENT DOCUMENTS

| | | | |
|---|---|---|---|
| DE | 2002175 | A1 | 8/1970 |
| EP | 0142015 | A1 | 5/1985 |

(Continued)

OTHER PUBLICATIONS

Key to Steel, 10th Edition, 1974 Verlag Stahlschlussel, West Germany.*

Machine-English tranlsation of EP0573335 A1. Jean Bourrat, Dec. 8, 1993.*

Machine-English translation of JP06-145913, Azuma Shigeki et al., May 27, 1995.*

International Search Report and Written Opinion (dated Aug. 10, 2012) for PCT/SG2012/000183, filed on May 24, 2012.

J. C. Lippold and VV. F. Savage; Solidification of Austenitic Stainless Steel Weldments: Part I—A Proposed Mechanism; Welding Research Supplement, Dec. 1979, pp. 362-s-374-s.

J. C. Lippold and VV. F. Savage; Solidification of Austenitic Stainless Steel Weldments: Part 2—The Effect of Alloy Composition on Ferrite Morphology, Welding Research Supplement, Feb. 1980, pp. 48-s-58-s.

(Continued)

*Primary Examiner* — Deborah Yee

(74) *Attorney, Agent, or Firm* — Innovation Capital Law Group, LLP; Vic Lin

(57) ABSTRACT

Austenitic stainless steel is disclosed herein. In the described embodiments, the austenitic stainless steel comprises 16.00 wt % of Chromium to 30.00 wt % of Chromium; 8.00 wt % of Nickel to 27.00 wt % of Nickel; no more than 7.00 wt % of Molybdenum; 0.40 wt % of Nitrogen to 0.70 wt % of Nitrogen, 1.0 wt % of Manganese to 4.00 wt % of Manganese, and less than 0.10 wt % of Carbon, wherein the ratio of the Manganese to the Nitrogen is controlled to less than or equal to 10.0. Austenitic stainless steel based on specified minimum PREN (Pitting Resistance Equivalent Number) values is also disclosed. (1) PRE=wt % Cr+3.3×wt % (Mo)+16 wt % N>=25 for N in range of 0.40-0.70. (2) PRE=wt % Cr+3.3×wt % (Mo+W)+16 wt % N>=27 for N in range of 0.40-0.70 with W present.

47 Claims, No Drawings

(56) References Cited

U.S. PATENT DOCUMENTS

| | | | |
|---|---|---|---|
| 2006/0150388 | A1 | 7/2006 | Inada et al. |
| 2006/0243719 | A1 | 11/2006 | Inoue et al. |
| 2007/0089810 | A1 | 4/2007 | Sundstrom et al. |
| 2007/0098588 | A1 | 5/2007 | Narita et al. |
| 2007/0217941 | A1 | 9/2007 | Hayashi et al. |
| 2007/0258844 | A1 | 11/2007 | Crum et al. |
| 2008/0095656 | A1 | 4/2008 | Loucif et al. |
| 2009/0098007 | A1 | 4/2009 | Tsuge et al. |
| 2009/0305078 | A1 | 12/2009 | Sjodin |

FOREIGN PATENT DOCUMENTS

| | | | | |
|---|---|---|---|---|
| EP | 0231492 | A1 | | 8/1987 |
| EP | 0296439 | A2 | | 12/1988 |
| EP | 0467756 | A1 | | 1/1992 |
| EP | 0573335 | A1 | | 12/1993 |
| EP | 0626460 | A1 | | 11/1994 |
| EP | 1995341 | A1 | | 11/2008 |
| EP | 2228578 | A1 | | 9/2010 |
| GB | 508619 | | | 7/1939 |
| GB | 936872 | | | 9/1963 |
| GB | 1079582 | | | 8/1967 |
| GB | 1433857 | A | | 4/1976 |
| GB | 1514934 | | | 6/1978 |
| JP | 355021547 | A | * | 2/1980 |
| JP | 04-006216 | | * | 1/1992 |
| JP | H04006216 | A | | 1/1992 |
| JP | H04026740 | | | 1/1992 |
| JP | H06179952 | A | | 6/1994 |
| JP | 08269632 | | | 10/1996 |
| JP | 11-302798 | | | 11/1999 |
| JP | 2006315080 | A | | 11/2006 |
| JP | 2007146287 | A | | 6/2007 |
| JP | 2008018115 | A | | 1/2008 |
| JP | 2009084597 | | | 4/2009 |
| JP | 2010031313 | A | | 2/2010 |
| PL | 159768 | A1 | | 5/1990 |
| PL | 159769 | A1 | | 5/1990 |
| RU | 2218446 | C2 | | 12/2003 |
| RU | 72697 | U1 | | 4/2008 |
| WO | 2001000898 | A1 | | 1/2001 |
| WO | 2001064969 | A1 | | 9/2001 |
| WO | 02/088411 | A1 | | 11/2002 |
| WO | 2003080886 | A1 | | 10/2003 |
| WO | 2004079027 | A1 | | 9/2004 |

OTHER PUBLICATIONS

M.F. McGuire, "Austenitic Stainless Steels", Encyclopedia of Materials: Science and Technology, 2001, pp. 406-410.

A. Iverson et al., "Aqueous Corrosion of Stainless Steels", Shreir's Corrosion, 2010, vol. 3, pp. 1802-1878.

Yan Cui, "Effect of Microfissures on Corrosion Performance and Mechanical Properties of Austenitic Stainless Steel Weld Metals", A Dissertation Presented for the Doctor of Philosophy Degree, The University of Tennessee, Knoxville, Aug. 2004, 245 pages.

L. Weber et al., "Partitioning of chromium and molybdenum in super duplex stainless steels with respect to nitrogen and nickel content", Materials Science and Engineering, A242, 1998, pp. 222-229.

J.-O. Nilsson et al., "Mechanical Properties, Microstructural Stability and Kinetics of o-Phase Formation in 29Cr—6Ni—2Mo—0. 38N Superduplex Stainless Steel", Metallurgical and Materials Transactions, Jan. 2000, vol. 31A, pp. 35-45.

M.O. Speidel, "Nitrogen Containing Austenitic Stainless Steels", Mat.-wiss. u. Werkstofftech., Wiley Interscience, Weinheim, 2006, 37, No. 10, pp. 875-880.

Nathan Elsinger et al., "An Enhanced Super Austenitic Stainless Steel Offers Resistance to Aggressive Media", Corrosion 2003, Mar. 2003, San Diego, CA, Paper No. 03256, Nace International, 15 pages.

Hua-Bing Li et al., "Pitting corrosion and crevice corrosion behaviors of high nitrogen Austenitic stainless steels", International Journal of Minerals, Metallurgy and Materials, vol. 16, No. 5, Oct. 2009, pp. 517-527.

G. Mori et al., "Pitting and crevice corrosion of superaustenitic stainless steels", Materials and Corrosion 2004, vol. 55, No. 3, pp. 164-173.

N. Arlt et al., "Welding characteristics and corrosion resistance of the new nitrogen-alloyed steel X 2 CrNiMnMoN 24 17 6 4", Welding International, vol. 8, Issue 10, 1994, pp. 804-807.

Daniel S. Janikowski, "Selecting Tubing Materials for Power Generation Heat Exchangers", Presented at the Power-Gen International Conference at New Orleans, Dec. 12, 2007, 20 pages.

J. Charles et al., "A new high-nitrogen austenitic steel with improved structure stability and corrosion resistance properties", 10th Anniversary Conference on Corrosion and Materials Offshore; Oslo, Norway, Sep. 1994, 11 pages.

C. Vichytil et al., "Corrosion Fatigue Investigations of CrNiMoN Austenitic Stainless Steels", Corrosion 2011, Mar. 13-17, 2011, Houston, Texas, Nace International, Paper No. 11297, 17 pages.

Bengt Wallen et al., "A new high molybdenum, high nitrogen stainless steel", ACOM, Materials & Design, 1992, vol. 13, No. 6, 6 pages.

"Sandvik Bioline High-N", http://www.smt.sandvik.com/en/materials-center/material-datasheets/bar-and-hollow-bar/bar/sandvik-bioline-high-n/, 3 pages.

"MT Grade, Nitronic 50", http://www.metaltek.com/alloy-guide/stainless-steel/austenitic/j93790.html, 1 page.

* cited by examiner

AUSTENITIC STAINLESS STEEL

BACKGROUND AND FIELD OF THE INVENTION

This invention relates to Austenitic Stainless Steel.

Traditionally, 300 series Austenitic Stainless Steels such as UNS S30403 (304L) and UNS S30453 (304LN) have specified chemical compositions in percentage by weight as illustrated in Table 1 herein:

TABLE 1

| UNS No | Type | | C | Mn | P | S | Si | Cr | Ni | Mo | N |
|---|---|---|---|---|---|---|---|---|---|---|---|
| S 30403 | 304L | MIN | | | | | | 17.50 | 8.00 | | |
| | | MAX | 0.030 | 2.00 | 0.045 | 0.030 | 0.75 | 19.50 | 12.00 | . . . | 0.10 |
| S 30453 | 304LN | MIN | | | | | | 18.00 | 8.00 | | 0.10 |
| | | MAX | 0.030 | 2.00 | 0.045 | 0.030 | 0.75 | 20.00 | 12.00 | . . . | 0.16 |

There are a number of shortcomings with the abovementioned conventional Austenitic Stainless Steels associated with their particular specification ranges. This can potentially lead to a lack of proper control of the chemical analysis at the melting stage, which is necessary to optimise the properties of the Alloys to give an excellent combination of mechanical strength properties and good corrosion resistance.

The mechanical properties that are achieved, with Alloys such as UNS S30403 and UNS S30453 are not optimised and are relatively low compared to other generic stainless steel groups such as 22Cr Duplex Stainless Steels and 25Cr Duplex and 25Cr Super Duplex Stainless Steels. This is demonstrated in Table 2 which compares the properties of these conventional Austenitic Stainless Steels with typical grades of 22Cr Duplex, 25Cr Duplex and 25Cr Super Duplex Stainless Steels.

TABLE 2

| Mechanical Properties of Austenitic Stainless Steels | | | | | | | | |
|---|---|---|---|---|---|---|---|---|
| | | Tensile Strength Min | | Yield Strength Min | | Elongation 2 in or 50 mm | Hardness Note 2 Max | |
| UNS No | Type | Ksi | MPa | Ksi | MPa | Min % | Brinell | Rockwell B |
| S30403 | 304L | 70 | 485 | 25 | 170 | 40 | 201 | 92 |
| S30453 | 304LN | 75 | 515 | 30 | 205 | 40 | 217 | 95 |
| | | Tensile Strength Min | | Yield Strength Min | | Elongation 2 in or 50 mm | Hardness Note 2 Max | |
| UNS No | Type | Ksi | MPa | Ksi | MPa | Min % | Brinell | Rockwell C |
| Mechanical Properties of 22Cr Duplex Stainless Steels | | | | | | | | |
| S31803 | 2205 | 90 | 620 | 65 | 450 | 25 | 293 | 31 |
| S32205 | 2205 | 95 | 655 | 65 | 450 | 25 | 293 | 31 |
| S32304 | 2304 | 87 | 600 | 58 | 400 | 25 | 290 | 32 |
| Mechanical Properties of 25Cr Duplex and 25Cr Super Duplex Stainless Steels | | | | | | | | |
| S32760 | . . . | 108 | 750 | 80 | 550 | 25 | 270 | . . . |
| S32750 | 2507 | 116 | 795 | 80 | 550 | 15 | 310 | 32 |
| S39274 | . . . | 116 | 800 | 80 | 550 | 15 | 310 | 32 |
| S32520 | . . . | 112 | 770 | 80 | 550 | 25 | 310 | . . . |

Note 2

The hardness figures quoted apply to the solution annealed condition.

It is an object of the present invention to provide an austenitic stainless steel which alleviates at least one of the disadvantages of the prior art and/or provide the public with a useful choice.

SUMMARY OF THE INVENTION

According to a first aspect of the invention, there is provided austenitic stainless steel according to claim 1.

Further preferred features may be found in the dependent claims.

As it can be appreciated from the described embodiments, the austenitic stainless steel (Cr—Ni—Mo—N) Alloy comprises a high level of Nitrogen possesses a unique combination of high mechanical strength properties with excellent ductility and toughness, along with good weldability and good resistance to general and localised corrosion. Specifically, the described embodiments also address the problem of relatively low mechanical strength properties in the conventional 300 series austenitic stainless steels such as UNS S30403 and UNS S30453 when compared to 22Cr Duplex Stainless Steels and 25Cr Duplex and 25Cr Super Duplex Stainless Steels.

DETAILED DESCRIPTION OF THE PREFERRED EMBODIMENTS

304LM4N

For ease of explanation, a first embodiment of the invention is referred to as 304LM4N. In general terms, the 304LM4N is a high strength austenitic stainless steel (Cr—Ni—Mo—N) alloy which comprises a high level of Nitrogen and formulated to achieve a minimum specified Pitting Resistance Equivalent of $PRE_N \geq 25$, and preferably $PRE_N \geq 30$. The $PRE_N$ is calculated according to the formulae:

$$PRE_N = \%\ Cr + (3.3 \times \%\ Mo) + (16 \times \%\ N).$$

The 304LM4N high strength austenitic stainless steel possesses a unique combination of high mechanical strength properties with excellent ductility and toughness, along with good weldability and good resistance to general and localised corrosion.

Chemical composition of the 304LM4N high strength austenitic stainless Steel is selective and characterised by an alloy of chemical elements in percentage by weight (wt) as follows, 0.030 wt % C (Carbon) max, 2.00 wt % Mn (Manganese) max, 0.030 wt % P (Phosphorus) max, 0.010 wt % S (Sulphur) max, 0.75 wt % Si (Silicon) max, 17.50 wt % Cr (Chromium)-20.00 wt % Cr, 8.00 wt % Ni (Nickel)-12.00 wt % Ni, 2.00 wt % Mo (Molybdenum) max, and 0.40 wt % N (Nitrogen)-0.70 wt % N.

The 304LM4N stainless steel also comprises principally Fe (Iron) as the remainder and may also contain very small amounts of other elements such as 0.010 wt % B (Boron) max, 0.10 wt % Ce (Cerium) max, 0.050 wt % Al (Aluminium) max, 0.01 wt % Ca (Calcium) max and/or 0.01 wt % Mg (Magnesium) max and other impurities which are normally present in residual levels.

The chemical composition of the 304LM4N stainless steel is optimised at the melting stage to primarily ensure an austenitic microstructure in the base material after solution heat treatment typically performed in the range 1100 deg C. to 1250 deg C. followed by water quenching. The microstructure of the base material in the solution heat treated condition, along with as-welded weld metal and heat affected zone of weldments, is controlled by optimising the balance between austenite forming elements and ferrite forming elements to primarily ensure that the alloy is austenitic. As a result, the 304LM4N stainless steel exhibits a unique combination of high strength and ductility at ambient temperatures, while at the same time achieves excellent toughness at ambient temperatures and cryogenic temperatures. In view of the fact that the chemical composition of the 304LM4N high strength austenitic stainless steel is adjusted to achieve a $PRE_N \geq 25$, but preferably $PRE_N \geq 30$, this ensures that the material also has a good resistance to general corrosion and localised corrosion (Pitting Corrosion and Crevice Corrosion) in a wide range of process environments. The 304LM4N stainless steel also has improved resistance to stress corrosion cracking in Chloride containing environments when compared to conventional Austenitic Stainless Steels such as UNS S30403 and UNS S30453.

It has been determined that the optimum chemical composition range of the 304LM4N stainless steel is carefully selected to comprise the following chemical elements in percentage by weight as follows based on the first embodiment, Carbon (C)

Carbon content of the 304LM4N stainless steel is ≤0.030 wt % C (i.e. maximum of 0.030 wt % C). Preferably, the amount of Carbon should be ≥0.020 wt % C and ≥0.030 wt % C and more preferably ≥0.025 wt % C.

Manganese (Mn)

The 304LM4N stainless steel of the first embodiment may come in two variations: low Manganese or high Manganese.

For the low Manganese alloys, the Manganese content of the 304LM4N stainless steel is ≤2.0 wt % Mn. Preferably, the range is ≥1.0 wt % Mn and ≥2.0 wt % Mn and more preferably ≥1.20 wt % Mn and ≥1.50 wt % Mn. With such compositions, this achieves an optimum Mn to N ratio of ≤5.0, and preferably, ≥1.42 and ≤5.0. More preferably, the ratio is ≥1.42 and ≤3.75.

For the high Manganese alloys, the Manganese content of the 304LM4N stainless steel is ≤4.0 wt % Mn. Preferably, the Manganese content is ≥2.0 wt % Mn and ≤4.0 wt % Mn, and more preferably the upper limit is ≤3.0 wt % Mn. Even more preferably, the upper limit is ≤2.50 wt % Mn. With such selective ranges, this achieves a Mn to N ratio of ≤10.0, and preferably ≥2.85 and ≤10.0. More preferably, the Mn to N ratio for high Manganese alloys is ≥2.85 and ≤7.50 and even more preferably ≥2.85 and ≤6.25.

Phosphorus (P)

Phosphorus content of the 304LM4N stainless steel is controlled to be ≤0.030 wt % P. Preferably, the 304LM4N alloy has ≤0.025 wt % P and more preferably ≤0.020 wt % P. Even more preferably, the alloy has ≤0.015 wt % P and even further more preferably ≤0.010 wt % P.

Sulphur (S)

Sulphur content of the 304LM4N stainless steel of the first embodiment includes is ≤0.010 wt % S. Preferably, the 304LM4N has ≤0.005 wt % S and more preferably ≤0.003 wt % S, and even more preferably ≤0.001 wt % S.

Oxygen (O)

Oxygen content of the 304LM4N stainless steel is controlled to be as low as possible and in the first embodiment, the 304LM4N has ≤0.070 wt % O. Preferably, the 304LM4N alloy has ≤0.050 wt % O and more preferably ≤0.030 wt % O. Even more preferably, the alloy has ≤0.010 wt % O and even further more preferably ≤0.005 wt % O.

Silicon (Si)

Silicon content of the 304LM4N stainless steel is ≤0.75 wt % Si. Preferably, the alloy has ≥0.25 wt % Si and ≤0.75 wt % Si. More preferably, the range is ≥0.40 wt % Si and ≤0.60 wt % Si. However, for specific higher temperature applications where improved oxidation resistance is required, the Silicon content may be ≥0.75 wt % Si and ≤2.00 wt % Si.

Chromium (Cr)

Chromium content of the 304LM4N stainless steel of the first embodiment is ≥17.50 wt % Cr and ≤20.00 wt % Cr. Preferably, the alloy has ≥18.25 wt % Cr.

Nickel (Ni)

Nickel content of the 304LM4N stainless steel is ≥8.00 wt % Ni and ≤12.00 wt % Ni. Preferably, the upper limit of Ni of the alloy is ≤11 wt % Ni and more preferably ≤10 wt % Ni.

Molybdenum (Mo)

Molybdenum content of the 304LM4N stainless steel alloy is ≤2.00 wt % Mo, but preferably ≥0.50 wt % Mo and ≤2.00 wt % Mo. More preferably, the lower limit of Mo is ≥1.0 wt % Mo.

Nitrogen (N)

Nitrogen content of the 304LM4N stainless steel is ≤0.70 wt % N, but preferably ≥0.40 wt % N and ≤0.70 wt % N.

More preferably, the 304LM4N alloy has ≥0.40 wt % N and ≤0.60 wt % N, and even more preferably ≥0.45 wt % N and ≤0.55 wt % N.

$PRE_N$

The PITTING RESISTANCE EQUIVALENT ($PRE_N$) is calculated using the formulae:

$$PRE_N = \%\ Cr + (3.3 \times \%\ Mo) + (16 \times \%\ N).$$

The 304LM4N stainless steel is specifically formulated to have the following composition:

(i) Chromium content of ≥17.50 wt % Cr and ≤20.00 wt % Cr, but preferably ≥18.25 wt % Cr;

(ii) Molybdenum content ≤2.00 wt % Mo, but preferably ≥0.50 wt % Mo and ≤2.00 wt % Mo and more preferably ≥1.0 wt % Mo;

(iii) Nitrogen content ≤0.70 wt % N, but preferably ≥0.40 wt % N and ≤0.70 wt % N and more preferably ≥0.40 wt % N and ≤0.60 wt % N and even more preferably ≥0.45 wt % N and ≤0.55 wt % N.

With a high level of Nitrogen, the 304LM4N stainless steel achieves the $PRE_N$ of ≥25, and preferably $PRE_N \geq 30$. This ensures that the alloy has a good resistance to general corrosion and localised corrosion (Pitting Corrosion and Crevice Corrosion) in a wide range of process environments. The 304LM4N stainless steel also has improved resistance to stress corrosion cracking in Chloride containing environments when compared to conventional Austenitic Stainless Steels such as UNS S30403 and UNS S30453. It should be emphasised that these equations ignore the effects of microstructural factors on the breakdown of passivity by pitting or crevice corrosion The chemical composition of the 304LM4N stainless steel is optimised at the melting stage to ensure that the ratio of the [Cr] equivalent divided by the [Ni] equivalent, according to Schoefer[6], is in the range >0.40 and <1.05, but preferably ≤0.45 and <0.95, in order to primarily obtain an austenitic microstructure in the base material after solution heat treatment typically performed in the range 1100 deg C.-1250 deg C. followed by water quenching. The microstructure of the base material in the solution heat treated condition, along with as-welded weld metal and heat affected zone of weldments, is controlled by optimising the balance between austenite forming elements and Ferrite forming elements to primarily ensure that the alloy is austenitic. The alloy can therefore be manufactured and supplied in the Non-Magnetic condition.

The 304LM4N stainless steel also has principally Iron (Fe) as the remainder and may also contain very small amounts of other elements such as Boron, Cerium, Aluminium, Calcium and/or Magnesium in percentage by weight as follows, Boron (B)

The 304LM4N stainless steel may not have Boron intentionally added to the alloy and as a result the level of Boron is typically ≥0.0001 wt % B and ≤0.0006 wt % B for mills which prefer not to intentionally add Boron to the heats. Alternatively, the 304LM4N stainless steel may be manufactured to specifically include ≤0.010 wt % B. Preferably, the range of Boron is ≥0.001 wt % B and ≤0.010 wt % B and more preferably ≥0.0015 wt % B and ≤0.0035 wt % B. In other words, Boron is specifically added during the production of the stainless steel but controlled to achieve such levels.

Cerium (Ce)

The 304LM4N stainless steel of the first embodiment may also include ≤0.10 wt % Ce, but preferably ≥0.01 wt % Ce and ≤0.10 wt % Ce. More preferably, the amount of Cerium is ≥0.03 wt % Ce and ≤0.08 wt % Ce. If the stainless steel contains Cerium, it may also possibly contain other Rare Earth Metals (REM) such as Lanthanum since REMs are very often supplied to the stainless steel manufacturers as Mischmetal. It should be noted that Rare Earth Metals may be utilised individually or together as Mischmetal providing the total amount of REMs conforms to the levels of Ce specified herein.

Aluminium (Al)

The 304LM4N stainless steel of the first embodiment may also comprise ≤0.050 wt % Al, but preferably ≥0.005 wt % Al and ≤0.050 wt % Al and more preferably ≥0.010 wt % Al and ≤0.030 wt % Al.

Calcium (Ca)/Magnesium (Mg)

The 304LM4N stainless steel may also include ≤0.010 wt % Ca and/or Mg. Preferably, the stainless steel may have ≥0.001 wt % Ca and/or Mg and ≤0.010 wt % Ca and/or Mg and more preferably ≥0.001 wt % Ca and/or Mg and ≤0.005 wt % Ca and/or Mg and other impurities which are normally present in residual levels.

Based on the above characteristics, 304LM4N stainless steel possesses minimum yield strength of 55 ksi or 380 MPa for the wrought version. More preferably, minimum yield strength of 62 ksi or 430 MPa may be achieved for the wrought version. The cast version possesses minimum yield strength of 41 ksi or 280 MPa. More preferably minimum yield strength of 48 ksi or 330 MPa may be achieved for the cast version. Based on the preferred strength values, comparisons of the wrought mechanical strength properties of 304LM4N stainless steel, with those of UNS S30403 in Table 2, suggest that the minimum yield strength of the 304LM4N stainless steel might be 2.5 times higher than that specified for UNS S30403. Similarly, a comparison of the wrought mechanical strength properties of the novel and innovative 304LM4N stainless steel, with those of UNS S30453 in Table 2, suggests that the minimum yield strength of the 304LM4N stainless steel might be 2.1 times higher than that specified for UNS S30453.

The 304LM4N stainless steel of the first embodiment possesses a minimum tensile strength of 102 ksi or 700 MPa for the wrought version. More preferably, a minimum tensile strength of 109 ksi or 750 MPa may be achieved for the wrought version. The cast version possesses a minimum tensile strength of 95 ksi or 650 MPa. More preferably, a minimum tensile strength of 102 ksi or 700 MPa may be achieved for the cast version. Based on the preferred values, a comparison of the wrought mechanical strength properties of the novel and innovative 304LM4N stainless steel, with those of UNS S30403 in Table 2, may suggest that the minimum tensile strength of the 304LM4N stainless steel is more than 1.5 times higher than that specified for UNS S30403. Similarly, a comparison of the wrought mechanical strength properties of the novel and innovative 304LM4N austenitic stainless steel, with those of UNS S30453 in Table 2, suggests that the minimum tensile strength of the 304LM4N stainless steel might be 1.45 times higher than that specified for UNS S30453. Indeed, if the wrought mechanical strength properties of the novel and innovative 304LM4N stainless steel, are compared with those of the 22 Cr Duplex Stainless Steel in Table 2, then it might be demonstrated that the minimum tensile strength of the 304LM4N stainless steel is in the region of 1.2 times higher than that specified for S31803 and similar to that specified for 25 Cr Super Duplex Stainless Steel. Therefore, the minimum mechanical strength properties of the 304LM4N stainless steel have been significantly improved compared to conventional Austenitic Stainless Steels such as UNS S30403 and UNS S30453 and the tensile strength properties are better than that specified for 22 Cr Duplex Stainless Steel and similar to those specified for 25 Cr Super Duplex Stainless Steel.

This means that applications using the wrought 304LM4N stainless steel may be frequently designed with reduced wall thicknesses, thus, leading to significant weight savings when specifying 304LM4N stainless steel compared to conventional austenitic stainless steels such as UNS S30403 and S30453 because the minimum allowable design stresses may be significantly higher. In fact, the minimum allowable design stresses for the wrought 304LM4N stainless steel may be higher than for 22 Cr Duplex Stainless Steels and similar to 25 Cr Super Duplex Stainless Steels.

For certain applications, other variants of the 304LM4N stainless steel have been purposely formulated to be manufactured containing specific levels of other alloying elements such as Copper, Tungsten and Vanadium. It has been determined that the optimum chemical composition range of the other variants of the 304LM4N stainless steel is selective and characterised by alloys of chemical compositions in percentage by weight as follows, Copper (Cu)

The Copper content of the 304LM4N stainless steel is ≤1.50 wt % Cu, but preferably ≥0.50 wt % Cu and ≤1.50 wt % Cu and more preferably ≤1.00 wt % Cu for the lower Copper range Alloys. For higher copper range alloys, the Copper content may include ≤3.50 wt %, but preferably ≥1.50 wt % Cu and ≤3.50 wt % Cu and more preferably ≤2.50 wt % Cu.

Copper may be added individually or in conjunction with Tungsten, Vanadium, Titanium and/or Niobium and/or Niobium plus Tantalum in all the various combinations of these elements, to further improve the overall corrosion performance of the Alloy. Copper is costly and therefore is being purposely limited to optimise the economics of the Alloy, while at the same time optimising the ductility, toughness and corrosion performance of the Alloy.

Tungsten (W)

The Tungsten content of the 304LM4N stainless steel is ≤2.00 wt % W, but preferably ≥0.50 wt % W and ≤1.00 wt % W and more preferably ≤0.75 wt % W. For 304LM4N stainless steel variants containing Tungsten, the PITTING RESISTANCE EQUIVALENT is calculated using the formulae:

$$PRE_{NW}=\%\ Cr+[3.3\times\%\ (Mo+W)]+(16\times\%\ N).$$

This Tungsten containing variant of the 304LM4N stainless steel is specifically formulated to have the following composition:

(i) Chromium content ≥17.50 wt % Cr and ≤20.00 wt % Cr, but preferably ≥18.25 wt % Cr;

(ii) Molybdenum content ≤2.00 wt % Mo, but preferably ≥0.50 wt % Mo and ≤2.00 wt % Mo and more preferably ≥1.0 wt % Mo;

(iii) Nitrogen content ≤0.70 wt % N, but preferably ≥0.40 wt % N and ≤0.70 wt % N and more preferably ≥0.40 wt % N and ≤0.60 wt % N and even more preferably ≥0.45 wt % N and ≤0.55 wt % N; and (iv) Tungsten content ≤2.00 wt % W, but preferably ≥0.50 wt % W and ≤1.00 wt % W and more preferably ≥0.75 wt % W.

The Tungsten containing variant of the 304LM4N stainless steel has a high specified level of Nitrogen and a $PRE_{NW}$≥27, but preferably $PRE_{NW}$≥32. It should be emphasised that these equations ignore the effects of microstructural factors on the breakdown of passivity by pitting or crevice corrosion. Tungsten may be added individually or in conjunction with Copper, Vanadium, Titanium and/or Niobium and/or Niobium plus Tantalum in all the various combinations of these elements, to further improve the overall corrosion performance of the Alloy. Tungsten is extremely costly and therefore is being purposely limited to optimise the economics of the Alloy, while at the same time optimising the ductility, toughness and corrosion performance of the Alloy.

Vanadium (V)

The Vanadium content of the 304LM4N stainless steel has ≤0.50 wt % V, but preferably ≥0.10 wt % V and ≤0.50 wt % V and more preferably ≤0.30 wt % V. Vanadium may be added individually or in conjunction with Copper, Tungsten, Titanium and/or Niobium and/or Niobium plus Tantalum in all the various combinations of these elements to further improve the overall corrosion performance of the Alloy. Vanadium is costly and therefore is being purposely limited to optimise the economics of the Alloy, while at the same time optimising the ductility, toughness and corrosion performance of the Alloy.

Carbon (C)

For certain applications, other variants of the 304LM4N High strength austenitic stainless steel are desirable, which have been specifically formulated to be manufactured comprising higher levels of Carbon. Specifically, the Carbon content of the 304LM4N stainless steel may be ≥0.040 wt % C and <0.10 wt % C, but preferably ≤0.050 wt % C or >0.030 wt % C and ≤0.08 wt % C, but preferably <0.040 wt % C. These specific variants of the 304LM4N High strength austenitic stainless steel may be regarded as the 304HM4N or 304M4N versions respectively.

Titanium (Ti)/Niobium (Nb)/Niobium (Nb) plus Tantalum (Ta)

Furthermore, for certain applications, other stabilised variants of the 304HM4N or 304M4N stainless steels are desirable, which have been specifically formulated to be manufactured containing higher levels of Carbon. Specifically, the amount of Carbon may be ≥0.040 wt % C and <0.10 wt % C, but preferably ≤0.050 wt % C, or >0.030 wt % C and ≤0.08 wt % C, but preferably <0.040 wt % C.

(i) These include the Titanium stabilised versions which are referred to as 304HM4NTi or 304M4NTi to contrast with the generic 304LM4N stainless steel versions.

The Titanium content is controlled according to the following formulae:

Ti 4×C min, 0.70 wt % Ti max or Ti 5×C min, 0.70 wt % Ti max respectively, in order to have Titanium stabilised derivatives of the alloy.

(ii) There are also the Niobium stabilised, 304HM4NNb or 304M4NNb versions where the Niobium content is controlled according to the following formulae:

Nb 8×C min, 1.0 wt % Nb max or Nb 10×C min, 1.0 wt % Nb max, respectively, in order to have Niobium stabilised derivatives of the alloy.

(iii) In addition, other variants of the Alloy may also be manufactured to contain Niobium plus Tantalum stabilised, 304HM4NNbTa or 304M4NNbTa versions where the Niobium plus Tantalum content is controlled according to the following formulae:

Nb+Ta 8×C min, 1.0 wt % Nb+Ta max, 0.10 wt % Ta max, or Nb+Ta 10×C min, 1.0 wt % Nb+Ta max, 0.10 wt % Ta max.

Titanium stabilised, Niobium stabilised and Niobium plus Tantalum stabilised variants of the Alloy may be given a stabilisation heat treatment at a temperature lower than the initial solution heat treatment temperature. Titanium and/or Niobium and/or Niobium plus Tantalum may be added individually or in conjunction with Copper, Tungsten and Vanadium in all the various combinations of these elements to optimise the alloy for certain applications where higher Carbon contents are desirable. These alloying elements may be utilised individually or in all the various combinations of the elements to tailor the stainless steel for specific applications and to further improve the overall corrosion performance of the alloy.

The wrought and cast versions of the 304LM4N stainless steel along with the other variants and embodiments discussed herein are generally supplied in the solution annealed condition. However, the weldments of fabricated components, modules and fabrications are generally supplied in the as-welded condition, provided that suitable Weld Procedure Qualifications have been prequalified in accordance with the respective standards and specifications. For specific applications the wrought versions may also be supplied in the cold worked condition.

Effect of the Proposed Alloying Elements and their Compositions

One of the most important properties of stainless steels is normally their corrosion resistance, without which, they would find few industrial applications, since in many instances their mechanical properties can be matched by less costly materials.

Changes in alloying element content which are desirable to establish attractive corrosion resistant characteristics can have a marked effect on the metallurgy of stainless steel. Consequently, this can affect the physical and mechanical characteristics which can be used practically. The establishment of certain desirable properties such as high strength, ductility and toughness is dependent upon the control of the microstructure and this may limit the corrosion resistance attainable. Alloying elements in the solid solution, Manganese Sulphide inclusions and various phases which can precipitate giving Chromium and Molybdenum depleted zones around the precipitates, can all have a profound influence on the microstructure, the mechanical properties of the alloy and the maintenance or breakdown of passivity.

Thus, it is extremely challenging to derive an optimum composition of the elements of the alloy in order for the alloy to have good mechanical strength properties, excellent ductility and toughness and yet good weldability and resistance to general and localised corrosion. This is especially true in view of the complex array of metallurgical variables which make up the alloy composition and how each variable affects passivity, micro-structure and the mechanical properties. It is also necessary to incorporate this knowledge into new alloy development programmes, fabrication and heat treatment schedules. In the following passages, it is discussed how each of the elements of the alloy is optimised to achieve the abovementioned properties.

Effect of Chromium

Stainless Steels derive their passive characteristics from alloying with Chromium. Alloying Iron with Chromium moves the primary passivation potential in the active direction. This in turn expands the passive potential range and reduces passive current density $i_{pass}$. In Chloride solutions, increasing the Chromium content of Stainless Steels raises the pitting potential $E_p$ thereby expanding the passive potential range. Chromium, therefore, increases the resistance to localised corrosion (Pitting and Crevice Corrosion) as well as general corrosion. An increase in Chromium, which is a Ferrite forming element, may be balanced by an increase in Nickel and other austenite forming elements such as Nitrogen, Carbon and Manganese in order to primarily maintain an Austenitic microstructure. However, it has been found that Chromium in conjunction with Molybdenum and Silicon may increase the tendency towards the precipitation of intermetallic phases and deleterious precipitates. Therefore, practically, there is a maximum limit to the level of Chromium that may be increased without enhancing the rate of intermetallic phase formation in thick sections which, in turn, could lead to a reduction in ductility, toughness and corrosion performance of the Alloy. This 304LM4N stainless steel has been specifically formulated to have a Chromium content ≥17.50 wt % Cr and ≤20.00 wt % Cr to achieve optimum results. Preferably, the Chromium content is ≥18.25 wt %

Effect of Nickel

It has been found that Nickel moves the pitting potential $E_p$ in the noble direction, thereby extending the passive potential range and also reduces the passive current density $i_{pass}$. Nickel therefore, increases the resistance to localised corrosion and general corrosion in austenitic stainless steels. Nickel is an Austenite forming element and the level of Nickel, Manganese, Carbon and Nitrogen are optimised in the first embodiment to balance the ferrite forming elements such as Chromium, Molybdenum and Silicon to primarily maintain an austenitic microstructure. Nickel is extremely costly and therefore is being purposely limited to optimise the economics of the Alloy, while at the same time optimising the ductility, toughness and corrosion performance of the Alloy. This 304LM4N stainless steel has been specifically formulated to have a Nickel content ≥8.00 wt % Ni and ≤12.00 wt % Ni, but preferably ≤11.00 wt % Ni and more preferably ≤10.00 wt % Ni.

Effect of Molybdenum

At particular levels of Chromium content, it has been found that Molybdenum has a strong beneficial influence on the passivity of austenitic stainless steels. The addition of Molybdenum moves the pitting potential in the more noble direction thus extending the passive potential range. Increasing Molybdenum content also lowers $i_{max}$ and thus Molybdenum improves the resistance to general corrosion and localised corrosion (Pitting Corrosion and Crevice Corrosion) in Chloride environments. Molybdenum also improves the resistance to Chloride stress corrosion cracking in Chloride containing environments. Molybdenum is a Ferrite forming element and the level of Molybdenum along with Chromium and Silicon, is optimised to balance the austenite forming elements such as Nickel, Manganese, Carbon and Nitrogen to primarily maintain an Austenitic microstructure. However, Molybdenum in conjunction with Chromium and Silicon may increase the tendency towards the precipitation of intermetallic phases and deleterious precipitates. At higher levels of Molybdenum it is possible to experience macro-segregation, particularly in castings and primary products, which may which may further increase the kinetics of such intermetallic phases and deleterious precipitates. Sometimes other elements such as Tungsten may be introduced into the heat in order to lower the relative amount of Molybdenum required in the Alloy. Therefore, practically, there is a maximum limit to the level of Molybdenum that can be increased without enhancing the rate of intermetallic phase formation in thick sections which, in turn, could lead to a reduction in ductility, toughness and corrosion performance of the Alloy. This 304LM4N stainless steel has been specifically formulated to have a Molybdenum content ≤2.00 wt % Mo, but preferably ≥0.50 wt % Mo and ≤2.0 wt % Mo and more preferably ≥1.0 wt % Mo.

Effect of Nitrogen

In the first embodiment (and the subsequent embodiments), one of the most significant improvements in the localised corrosion performance of austenitic stainless steels is obtained by increasing the Nitrogen levels. Nitrogen raises the pitting potential $E_p$ thereby expanding the passive potential range. Nitrogen modifies the passive protective film to improve the protection for the breakdown of passivity. It has been reported[1], that high Nitrogen concentrations have been observed at the metal side of the metal-passive film interface using Auger electron spectroscopy. Nitrogen is an extremely strong austenite forming element along with Carbon. Similarly, Manganese and Nickel are also austenite forming elements albeit to a lesser extent. The levels of austenite forming elements such as Nitrogen and Carbon, as well as Manganese and Nickel are optimised in these embodiments to balance the Ferrite forming elements such as Chromium, Molybdenum and Silicon to primarily maintain an austenitic microstructure. As a result, Nitrogen indirectly limits the propensity to form intermetallic phases since diffusion rates are much slower in Austenite. Thus the kinetics of intermetallic phase formation is reduced. Likewise, in view of the fact that austenite has a good solubility for Nitrogen, this means that the potential to form deleterious precipitates such as $M_2X$ (carbo-nitrides, nitrides, borides, boro-nitrides or boro-carbides) as well as $M_{23}C_6$ carbides, in the weld metal and heat affected zone of weldments, during welding cycles, is reduced. Nitrogen in the solid solution is primarily responsible for increasing the mechanical strength properties of the 304LM4N stainless steel whilst ensuring that an austenitic microstructure optimises the ductility, toughness and corrosion performance of the Alloy. Nitrogen however, has a limited solubility both at the melting stage and in solid solution. This 304LM4N stainless steel has been specifically formulated to have a Nitrogen content ≤0.70 wt % N, but preferably ≥0.40 wt % N and ≤0.70 wt % N and more preferably ≥0.40 wt % N and ≤0.60 wt % N and even more preferably ≥0.45 wt % N and ≤0.55 wt % N.

Effect of Manganese

Manganese is an austenite forming element and the level of Manganese, Nickel, Carbon and Nitrogen is optimised in the embodiments to balance the ferrite forming elements such as Chromium, Molybdenum and Silicon to primarily maintain an austenitic microstructure. Therefore, a higher level of Manganese indirectly allows for a higher solubility of Carbon and Nitrogen both at the melting stage and in solid solution so as to minimise the risk of deleterious precipitates such as $M_2X$ (carbo-nitrides, nitrides, borides, boro-nitrides or boro-carbides) as well as $M_{23}C_6$ carbides. Therefore, increasing the Manganese concentration to specific levels to improve the solid solubility of Nitrogen would result in an improvement in the localised corrosion performance of the Austenitic Stainless Steel. Manganese is also a more cost effective element than Nickel and can be used up to a certain level to limit the amount of Nickel being utilised in the Alloy. However, there is a limit on the Manganese level that can be used successfully since this may lead to the formation of Manganese Sulphide inclusions which are favourable sites for pit initiation, thus adversely affecting the localised corrosion performance of the Austenitic Stainless Steel. Manganese also increases the tendency towards the precipitation of intermetallic phases as well as deleterious precipitates. Therefore, practically, there is a maximum limit to the level of Manganese that can be increased without enhancing the rate of intermetallic phase formation in thick sections which, in turn, could lead to a reduction in ductility, toughness and corrosion performance of the Alloy. This 304LM4N Stainless steel has been specifically formulated to have a Manganese content ≥1.00 wt % Mn and ≤2.00 wt % Mn, but preferably with a Manganese content ≥1.20 wt % Mn and ≤1.50 wt % Mn. The Manganese content may be controlled to ensure the Manganese to Nitrogen ratio is ≤5.0, and preferably ≥1.42 and ≤5.0. More preferably, the ratio is ≥1.42 and ≤3.75 for the lower Manganese range Alloys. The Manganese content may be characterised by an Alloy that contains ≥2.0 wt % Mn and ≤4.0 wt % Mn, but preferably ≤3.0 wt % Mn and more preferably ≤2.50 wt % Mn, with a Mn to N ratio of ≤10.0, and preferably, ≥2.85 and ≤10.0. More preferably the ratio is ≥2.85 and ≤7.50 and even more preferably ≥2.85 and ≤6.25 for the higher Manganese range Alloys.

Effect of Sulphur, Oxygen and Phosphorus

Impurities such as Sulphur, Oxygen and Phosphorus may have a negative influence on the mechanical properties and resistance to localised corrosion (Pitting and Crevice Corrosion) and general corrosion in Austenitic Stainless Steel. This is because Sulphur, in conjunction with Manganese at specific levels, promotes the formation of Manganese Sulphide inclusions. In addition, Oxygen in conjunction with Aluminium or Silicon at specific levels, promotes the formation of oxide inclusions such as $Al_2O_3$ or $SiO_2$. These inclusions are favourable sites for pit initiation thus adversely affecting the localised corrosion performance, ductility and toughness of the austenitic stainless steel. Likewise, Phosphorus promotes the formation of deleterious precipitates which are favourable sites for pit initiation which adversely affect the pitting and crevice corrosion resistance of the Alloy as well as reducing its ductility and toughness. In addition, Sulphur, Oxygen and Phosphorus have an adverse effect on the hot workability of wrought austenitic stainless steels and the sensitivity towards hot cracking and cold cracking, particularly in castings and the weld metal of weldments in austenitic stainless steel. Oxygen at specific levels may also lead to porosity in Austenitic Stainless Steel castings. This may generate potential crack initiation sites within the cast components that experience high cyclical loads. Therefore, modern melting techniques such as electric arc melting, induction melting and vacuum oxygen decarburisation or argon oxygen decarburisation in conjunction with other secondary remelting techniques such as Electro Slag Remelting or Vacuum Arc Remelting as well as other refining techniques are utilised to ensure that extremely low Sulphur, Oxygen and Phosphorus contents are obtained to improve the hot workability of wrought Stainless Steel and to reduce the sensitivity towards hot cracking and cold cracking and porosity particularly in castings and in the weld metal of weldments. Modern melting techniques also lead to a reduction in the level of inclusions. This improves the cleanness of the Austenitic Stainless Steel and hence the ductility and toughness as well as the overall corrosion performance. This 304LM4N stainless steel has been specifically formulated to have a Sulphur content ≤0.010 wt % 5, but preferably with a Sulphur content of ≤0.005 wt % S and more preferably ≤0.003 wt % S and even more preferably ≤0.001 wt % S. The Oxygen content is as low as possible and controlled to ≤0.070 wt % O, but preferably ≤0.050 wt % O and more preferably ≤0.030 wt % O and even more preferably ≤0.010 wt % O and even further more preferably ≤0.005 wt % O. The Phosphorus content is controlled to ≤0.030 wt % P, but preferably ≤0.025 wt % P, and more preferably ≤0.020 wt % P, and even more preferably ≤0.015 wt % P, and even further more preferably ≤0.010 wt % P.

Effect of Silicon

Silicon moves the pitting potential in the noble direction thereby extending the passive potential range. Silicon also enhances the fluidity of the melt during the manufacture of Stainless Steels. Likewise, Silicon improves the fluidity of the hot weld metal during welding cycles. Silicon is a Ferrite forming element and the level of Silicon along with Chromium and Molybdenum, is optimised to balance the Austenite forming elements such as Nickel, Manganese, Carbon and Nitrogen to primarily maintain an Austenitic microstructure. Silicon contents in the range of 0.75 wt % Si and 2.00 wt % Si may improve the oxidation resistance for higher temperature applications. However, Silicon content in excess of approximately 1.0 wt % Si, in conjunction with Chromium and Molybdenum may increase the tendency towards the precipitation of intermetallic phases and deleterious precipitates. Therefore, practically, there is a maximum limit to the level of Silicon that can be increased without enhancing the rate of intermetallic phase formation in thick sections which, in turn, could lead to a reduction in ductility, toughness and corrosion performance of the Alloy. This 304LM4N Stainless steel has been specifically formulated to have a Silicon content ≤0.75 wt % Si, but preferably ≥0.25 wt % Si and ≤0.75 wt % Si and more preferably ≥0.40 wt % Si and ≤0.60 wt % Si. The Silicon content may be characterised by an Alloy that contains ≥0.75 wt % Si and ≤2.00 wt % Si for specific higher temperature applications where improved oxidation resistance is required.

Effect of Carbon

Carbon is an extremely strong Austenite forming element along with Nitrogen. Similarly, Manganese and Nickel are also Austenite forming elements albeit to a lesser extent. The levels of Austenite forming elements such as Carbon and Nitrogen, as well as Manganese and Nickel are optimised to balance the Ferrite forming elements such as Chromium, Molybdenum and Silicon to primarily maintain an Austenitic microstructure. As a result, Carbon indirectly limits the propensity to form intermetallic phases since diffusion rates are much slower in Austenite. Thus, the kinetics of intermetallic phase formation is reduced. Likewise, in view of the fact that Austenite has a good solubility for Carbon, this means that the potential to form deleterious precipitates such as $M_2X$ (carbo-nitrides, nitrides, borides, boro-nitrides or boro-carbides) as well as $M_{23}C_6$ carbides, in the weld metal and heat affected zone of weldments, during welding cycles, is reduced. Carbon and Nitrogen in the solid solution are primarily responsible for increasing the mechanical strength properties of the 304LM4N Stainless steel whilst ensuring that an Austenitic microstructure optimises the ductility, toughness and corrosion performance of the Alloy. The Carbon content is normally restricted to 0.030 wt % C maximum to optimise the properties and also to ensure good hot workability of the wrought Austenitic Stainless Steels. This 304LM4N Stainless steel has been specifically formulated to have a Carbon content ≤0.030 wt % C maximum, but preferably ≥0.020 wt % C and ≤0.030 wt % C and more preferably ≤0.025 wt % C. For certain applications, where a higher Carbon content ≥0.040 wt % C and <0.10 wt % C, but preferably ≤0.050 wt % C or >0.030 wt % C and ≤0.08 wt % C, but preferably <0.040 wt % C is desirable, specific variants of the 304LM4N Stainless steel, namely 304HM4N or 304M4N respectively, have also been purposely formulated.

Effect of Boron, Cerium, Aluminium, Calcium and Magnesium

The hot workability of Stainless Steels is improved by introducing discrete amounts of other elements such as Boron or Cerium. If the Stainless steel contains Cerium it may also possibly contain other Rare Earth Metals (REM) such as Lanthanum since REMs are very often supplied to the Stainless steel manufacturers as Mischmetal. In general, the typical residual level of Boron present in Stainless Steels is ≥0.0001 wt % B and ≤0.0006 wt % B for mills which prefer not to intentionally add Boron to the heats. The 304LM4N stainless steel may be manufactured without the addition of Boron. Alternatively, the 304LM4N stainless steel may be manufactured to specifically have a Boron content ≥0.001 wt % B and ≤0.010 wt % B, but preferably ≥0.0015 wt % B and ≤0.0035 wt % B. The beneficial effect of Boron on hot workability results from ensuring that Boron is retained in solid solution. It is therefore necessary to ensure that deleterious precipitates such as $M_2X$ (borides, boro-nitrides or boro-carbides) do not precipitate in the microstructure at the grain boundaries of the base material during manufacturing and heat treatment cycles or in the as-welded weld metal and heat affected zone of weldments during welding cycles.

The 304LM4N stainless steel may be manufactured to specifically have a Cerium content ≤0.10 wt % Ce, but preferably ≥0.01 wt % Ce and ≤0.10 wt % Ce and more preferably ≥0.03 wt % Ce and ≤0.08 wt % Ce. The Cerium forms Cerium oxysulphides in the Stainless steel to improve hot workability but, at specific levels, these do not adversely affect the corrosion resistance of the material. For certain applications, where a higher Carbon content of ≥0.04 wt % C and <0.10 wt % C, but preferably ≤0.050 wt % C or >0.030 wt % C and ≤0.08 wt % C, but preferably <0.040 wt % C is desirable, variants of the 304LM4N stainless steel may also be manufactured to specifically have a Boron content ≤0.010 wt % B, but preferably ≥0.001 wt % B and ≤0:010 wt % B and more preferably ≥0.0015 wt % B and ≤0.0035 wt % B or a Cerium content ≤0.10 wt % Ce, but preferably ≥0.01 wt % Ce and ≤0.10 wt % Ce and more preferably ≥0.03 wt % Ce and ≤0.08 wt % Ce. It should be noted that Rare Earth Metals may be utilised individually or together as Mischmetal providing the total amount of REMs conforms to the levels of Ce specified herein. The 304LM4N Stainless steel may be manufactured to specifically contain Aluminium, Calcium and/or Magnesium. These elements may be added to deoxidise and/or desulphurise the Stainless steel in order to improve its cleanness as well as the hot workability of the material. Where relevant the Aluminium content is typically controlled to have an Aluminium content ≤0.050 wt % Al, but preferably ≥0.005 wt % Al and ≤0.050 wt % Al and more preferably ≥0.010 wt % Al and ≤0.030 wt % Al in order to inhibit the precipitation of nitrides. Similarly, the Calcium and/or Magnesium content is typically controlled to have a Ca and/or Mg content of ≤0.010 wt % Ca and/or Mg, but preferably ≥0.001 wt % Ca and/or Mg and ≤0.010 wt % Ca and/or Mg and more preferably ≥0.001 wt % Ca and/or Mg and ≤0.005 wt % Ca and/or Mg to restrict the amount of slag formation in the melt.

Other Variants

For certain applications, other variants of the 304LM4N stainless steel may be formulated to be manufactured containing specific levels of other alloying elements such as Copper, Tungsten and Vanadium. Similarly, for certain applications, where a higher Carbon content ≥0.040 wt % C and <0.10 wt % C, but preferably ≤0.050 wt % C or >0.030 wt % C and ≤0.08 wt % C, but preferably <0.040 wt % C is desirable, specific variants of the 304LM4N stainless steel, namely 304HM4N or 304M4N respectively, have been purposely formulated. Furthermore, for certain applications, where a higher Carbon content ≥0.040 wt % C and <0.10 wt % C, but preferably ≤0.050 wt % C or >0.030 wt % C and ≤0.08 wt % C but preferably <0.040 wt % C is desirable, specific variants of the 304HM4N or 304M4N stainless steel, namely Titanium stabilised, 304HM4NTi or 304M4NTi, Niobium stabilised, 304HM4NNb or 304M4NNb and Niobium plus Tantalum stabilised, 304HM4NNbTa or 304M4NNbTa Alloys have also been purposely formulated. Titanium stabilised, Niobium stabilised and Niobium plus Tantalum stabilised variants of the Alloys may be given a stabilisation heat treatment at a temperature lower than the initial solution heat treatment temperature. Titanium and/or Niobium and/or Niobium plus Tantalum may be added individually or in conjunction with Copper, Tungsten and Vanadium in all the various combinations of these elements to optimise the Alloy for certain applications where higher Carbon contents are desirable. These alloying elements may be utilised individually or in all the various combinations of the elements to tailor the stainless steel for specific applications and to further improve the overall corrosion performance of the Alloy.

Effect of Copper

The beneficial effect of Copper additions on the corrosion resistance of stainless steels in non-oxidising media is well known. If approximately 0.50 wt % of Copper is added, the active dissolution rate in boiling Hydrochloric Acid and the crevice corrosion loss in Chloride solutions are both decreased. It has been found that the general corrosion resistance in Sulphuric Acid also improves with the addition of Copper up to up to 1.50 wt % Cu.[2] Copper is an Austenite forming element along with Nickel, Manganese, Carbon and Nitrogen. Therefore, Copper can improve the localised corrosion and general corrosion performance of stainless steels. The levels of Copper and other austenite forming elements are optimised to balance the Ferrite forming elements such as Chromium, Molybdenum and Silicon to primarily maintain an Austenitic microstructure. Therefore, a variant of the 304LM4N stainless steel has been specifically selected to have a Copper content ≤1.50 wt % Cu, but preferably ≥0.50 wt % Cu and ≤1.50 wt % Cu and more preferably ≤1.00 wt % Cu for the lower Copper range Alloys. The Copper content of the 304LM4N may be characterised by an alloy which comprises ≤3.50 wt % Cu, but preferably ≥1.50 wt % Cu and ≤3.50 wt % Cu and more preferably ≤2.50 wt % Cu for the higher Copper range Alloys.

Copper may be added individually or in conjunction with Tungsten, Vanadium, Titanium and/or Niobium and/or Niobium plus Tantalum in all the various combinations of these elements, to further improve the overall corrosion performance of the Alloy. Copper is costly and therefore is being purposely limited to optimise the economics of the Alloy, while at the same time optimising the ductility, toughness and corrosion performance of the Alloy.

Effect of Tungsten

Tungsten and Molybdenum occupy a similar position on the Periodic table and have a similar potency and influence on the resistance to localised corrosion (Pitting and Crevice Corrosion). At particular levels of Chromium and Molybdenum content, Tungsten has a strong beneficial influence on the passivity of Austenitic Stainless Steels. Addition of Tungsten moves the pitting potential in the more noble direction, thus extending the passive potential range. Increasing Tungsten content also reduces the passive current density $i_{pass}$. Tungsten is present in the passive layer and is adsorbed without modification of the oxide state[3]. In acid Chloride solutions, Tungsten probably passes directly from the metal into the passive film, by interaction with water and forming an insoluble $WO_3$, rather than through a dissolution then adsorption process. In neutral Chloride solutions, the beneficial effect of Tungsten is interpreted by the interaction of $WO_3$ with other oxides, resulting in enhanced stability and enhanced bonding of the oxide layer to the base metal. Tungsten improves the resistance to general corrosion and localised corrosion (Pitting Corrosion and Crevice Corrosion) in Chloride environments. Tungsten also improves the resistance to Chloride stress corrosion cracking in Chloride containing environments. Tungsten is a Ferrite forming element and the level of Tungsten along with Chromium, Molybdenum and Silicon, is optimised to balance the Austenite forming elements such as Nickel, Manganese, Carbon and Nitrogen to primarily maintain an Austenitic microstructure. However, Tungsten in conjunction with Chromium, Molybdenum and Silicon may increase the tendency towards the precipitation of intermetallic phases and deleterious precipitates. Therefore, practically, there is a maximum limit to the level of Tungsten that can be increased without enhancing the rate of intermetallic phase formation in thick sections which, in turn, could lead to a reduction in ductility, toughness and corrosion performance of the Alloy. Therefore, a variant of this 304LM4N stainless steel has been specifically formulated to have a Tungsten content ≤2.00 wt % W, but preferably ≥0.50 wt % W and ≤1.00 wt % W and more preferably ≥0.75 wt % W. Tungsten may be added individually or in conjunction with Copper, Vanadium, Titanium and/or Niobium and/or Niobium plus Tantalum in all the various combinations of these elements, to further improve the overall corrosion performance of the Alloy. Tungsten is extremely costly and therefore is being purposely limited to optimise the economics of the Alloy, while at the same time optimising the ductility, toughness and corrosion performance of the Alloy.

Effect of Vanadium

At particular levels of Chromium and Molybdenum content, Vanadium has a strong beneficial influence on the passivity of Austenitic Stainless Steels. Addition of Vanadium moves the pitting potential in the more noble direction thus extending the passive potential range. Increasing the Vanadium content also lowers $i_{max}$ and thus Vanadium, in conjunction with Molybdenum improves the resistance to general corrosion and localised corrosion (Pitting Corrosion and Crevice Corrosion) in Chloride environments. Vanadium in conjunction with Molybdenum may also improve the resistance to Chloride stress corrosion cracking in Chloride containing environments. However, Vanadium in conjunction with Chromium, Molybdenum and Silicon may increase the tendency towards the precipitation of intermetallic phases and deleterious precipitates. Vanadium has a strong tendency to form deleterious precipitates such as $M_2X$ (carbo-nitrides, nitrides, borides, boro-nitrides or boro-carbides) as well as $M_{23}C_6$ carbides. Therefore, practically, there is a maximum limit to the level of Vanadium that can be increased without enhancing the rate of intermetallic phase formation in thick sections. Vanadium also increases the propensity to form such deleterious precipitates in the weld metal and heat affected zone of weldments, during welding cycles. These intermetallic phases and deleterious phases could, in turn, lead to a reduction in ductility, toughness and corrosion performance of the Alloy. Therefore, a variant of this 304LM4N stainless steel has been specifically formulated to have a Vanadium content ≤0.50 wt % V, but preferably ≥0.10 wt % V and ≤0.50 wt % V and more preferably ≤0.30 wt % V. Vanadium may be added individually or in conjunction with Copper, Tungsten, Titanium and/or Niobium and/or Niobium plus Tantalum in all the various combinations of these elements to further improve the overall corrosion performance of the Alloy. Vanadium is costly and therefore is being purposely limited to optimise the economics of the Alloy, while at the same time optimising the ductility, toughness and corrosion performance of the Alloy.

Effect of Titanium, Niobium and Niobium Plus Tantalum

For certain applications, where a higher Carbon content ≥0.040 wt % C and <0.10 wt % C, but preferably ≤0.050 wt % C or >0.030 wt % C and ≤0.08 wt % C, but preferably <0.040 wt % C is desirable, specific variants of the 304HM4N or 304M4N stainless steel, namely 304HM4NTi or 304M4NTi, have been purposely formulated to have a Titanium content according to the following formulae: Ti 4×C min, 0.70 wt % Ti max or Ti 5×C min, 0.70 wt % Ti max respectively, in order to have Titanium stabilised derivatives of the Alloy. Titanium stabilised variants of the alloys may be given a stabilisation heat treatment at a temperature lower than the initial solution heat treatment temperature. Titanium may be added individually or in conjunction with Copper, Tungsten, Vanadium and/or Niobium and/or Niobium plus Tantalum in all the various combinations of these elements to optimise the ductility, toughness and corrosion performance of the alloy.

Likewise, for certain applications, where a higher Carbon content ≥0.040 wt % C and <0.10 wt % C, but preferably ≤0.050 wt % C or >0.030 wt % C and ≤0.08 wt % C, but preferably <0.040 wt % C is desirable, specific variants of the 304HM4N or 304M4N Stainless steel, namely 304HM4NNb or 304M4NNb, have been purposely formulated to have a Niobium content according to the following formulae: Nb 8×C min, 1.0 wt % Nb max or Nb 10×C min, 1.0 wt % Nb max respectively, in order to have Niobium stabilised derivatives of the Alloy. In addition, other variants of the Alloy may also be manufactured to contain Niobium plus Tantalum stabilised, 304HM4NNbTa or 304M4NNbTa versions where the Niobium plus Tantalum content is controlled according to the following formulae: Nb+Ta 8×C min, 1.0 wt % Nb+Ta max, 0.10 wt % Ta max, or Nb+Ta 10×C min, 1.0 wt % Nb+Ta max, 0.10 wt % Ta max. Niobium stabilised and Niobium plus Tantalum stabilised variants of the alloys may be given a stabilisation heat treatment at a temperature lower than the initial solution heat treatment temperature. Niobium and/or Niobium plus Tantalum may be added individually or in conjunction with Copper, Tungsten, Vanadium and/or Titanium in all the various combinations of these elements to optimise the ductility, toughness and corrosion performance of the alloy.

Pitting Resistance Equivalent

It is evident from the foregoing that a number of alloying elements in Stainless Steels move the pitting potential in the noble direction. These beneficial effects are complex and interactive and attempts have been made to use compositionally derived empirical relationships for pitting resistance indices. The most commonly accepted formulae utilised for calculating PITTING RESISTANCE EQUIVALENT:

$$PRE_N = \%\ Cr + (3.3 \times \%\ Mo) + (16 \times \%\ N).$$

It is generally recognised that such Alloys as described herein with $PRE_N$ values less than 40, may be classified as "Austenitic" Stainless Steels. Whereas such alloys as described herein with $PRE_N$ values of greater or equal to 40, may be classified as "Super Austenitic" Stainless Steels reflecting their superior general and localised corrosion resistance. This 304LM4N stainless steel has been specifically formulated to have the following composition:

(i) Chromium content ≥17.50 wt % Cr and ≤20.00 wt % Cr, but preferably ≥18.25 wt % Cr, (ii) Molybdenum content ≤2.00 wt % Mo, but preferably ≥0.50 wt % Mo and ≤2.0 wt % Mo and more preferably ≥1.0 wt % Mo (iii) Nitrogen content ≤0.70 wt % N, but preferably ≥0.40 wt % N and ≤0.70 wt % N and more preferably ≥0.40 wt % N and ≤0.60 wt % N and even more preferably ≥0.45 wt % N and <0.55 wt % N.

The 304LM4N Stainless steel has a high specified level of Nitrogen and a $PRE_N \geq 25$, but preferably $PRE_N \geq 30$. As a result, the 304LM4N Stainless steel possesses a unique combination of High mechanical strength properties with excellent ductility and toughness, along with good weldability and good resistance to general and localised corrosion. There are reservations concerning the utilisation of such formulae in total isolation. The formulae do not take account of the beneficial effects of other elements such as Tungsten which improve pitting performance. For 304LM4N stainless steel variants containing Tungsten, the PITTING RESISTANCE EQUIVALENT is calculated using the formulae: $PRE_{NW} = \%\ Cr + [3.3 \times \%\ (Mo+W)] + (16 \times \%\ N)$. It is generally recognised that such alloys as described herein with $PRE_{NW}$ values less than 40, may be classified as "Austenitic" Stainless Steels. Whereas such Alloys as described herein with $PRE_{NW}$ values of greater or equal to 40, may be classified as "Super Austenitic" Stainless Steels reflecting their-superior general and localised corrosion resistance. This Tungsten containing variant of the 304LM4N Stainless steel has been specifically formulated to have the following composition:

(i) Chromium content ≥17.50 wt % Cr and ≤20.00 wt % Cr, but preferably ≥18.25 wt % Cr, (ii) Molybdenum content ≤2.00 wt % Mo, but preferably ≥0.50 wt % Mo and ≤2.0 wt % Mo and more preferably ≥1.0 wt % Mo, (iii) Nitrogen content ≤0.70 wt % N, but preferably ≥0.40 wt % N and ≤0.70 wt % N and more preferably ≥0.40 wt % N and ≤0.60 wt % N and even more preferably ≥0.45 wt % N and ≤0.55 wt % N (iv) Tungsten content ≤2.00 wt % W, but preferably ≥0.50 wt % W and ≤1.00 wt % W and more preferably ≥0.75 wt % W.

The Tungsten containing variant of the 304LM4N Stainless steel has a high specified level of Nitrogen and a $PRE_{NW} \geq 27$, but preferably $PRE_{NW} \geq 32$. It should be emphasised that these equations ignore the effects of microstructural factors on the breakdown of passivity by pitting or crevice corrosion.

Austenitic Microstructure

The chemical composition of the 304LM4N stainless steel of the first embodiment is optimised at the melting stage to primarily ensure an austenitic microstructure in the base material after solution heat treatment typically performed in the range 1100 deg C. to 1250 deg C. followed by water quenching.

The microstructure of the 304LM4N base material in the solution heat treated condition, along with as-welded weld metal and heat affected zone of weldments, is controlled by optimising the balance between austenite forming elements and ferrite forming elements, as discussed above, to primarily ensure that the alloy is austenitic.

The relative effectiveness of elements which stabilise the ferrite and austenite phases can be expressed in terms of their [Cr] and [Ni] equivalents. The conjoint effect of utilising [Cr] and [Ni] equivalents has been demonstrated using the method proposed by Schaeffler[4] for predicting the structures of weld metals. The Schaeffler[4] diagram is strictly only applicable to rapidly cast and cooled Alloys such as weldments or chill castings. However, the Schaeffler[4] diagram can also give an indication of the phase balance of 'parent' materials. Schaeffler[4] predicted the structures of Stainless Steel weld metals formed on rapid cooling according to their chemical composition expressed in terms of their [Cr] and [Ni] equivalents. The Schaeffler[4] diagram utilised [Cr] and [Ni] equivalents according to the following formulae:

$$[Cr]\ \text{equivalent}=\text{wt \% Cr}+\text{wt \% Mo}+1.5\times\text{wt \% Si}+0.5\times\text{wt \% Nb} \quad (1)$$

$$[Ni]\ \text{equivalent}=\text{wt \% Ni}+30\times\text{wt \% C}+0.5\times\text{wt \% Mn} \quad (2)$$

However, the Schaeffler[4] diagram did not take account of the significant influence of Nitrogen in stabilising Austenite. Therefore, the Schaeffler[4] diagram has been modified by DeLong[5] to incorporate the important influence of Nitrogen as an Austenite forming element. The DeLong[5] diagram utilised the same [Cr] equivalent formulae as utilised by Schaeffler[4] in equation (1). However, the [Ni] equivalent has been modified according to the following formulae:

$$[Ni]\ \text{equivalent}=\text{wt \% Ni}+30\times\text{wt \% (C+N)}+0.5\times\text{wt \% Mn} \quad (3)$$

This DeLong[5] diagram shows the ferrite content in terms of magnetically determined Ferrite content and the Welding Research Council (WRC) Ferrite number. The difference in the Ferrite number and the percentage Ferrite (i.e. at values >6% Ferrite) is related to the WRC calibration procedures and the calibration curves used with the magnetic measurements. A comparison of the Schaeffler[4] diagram and the DeLong[5] modified Schaeffler[4] diagram reveals that, for a given [Cr] equivalent and [Ni] equivalent, the DeLong[5] diagram predicts a higher Ferrite content (i.e. approximately 5% higher).

Both the Schaeffler[4] diagram and the DeLong[5] diagram have principally been developed for weldments and are therefore not strictly applicable to 'parent' material. However, they do provide a good indication of the phases likely to be present and give valuable information of the relative influence of the different alloying elements.

Schoefer[6] has demonstrated that a modified version of the Schaeffler[4] diagram can be used to describe the Ferrite number in castings This has been achieved by transforming the co-ordinates of the Schaeffler[4] diagram to either a Ferrite number or a Volume Percent Ferrite on the horizontal axis as adopted by ASTM in A800/A800M-10.[7] The vertical axis is expressed as a ratio of the [Cr] equivalent divided by the [Ni] equivalent. Schoefer[6] also modified the [Cr] equivalent and [Ni] equivalent factors according to the following formulae:

$$[Cr]\ \text{equivalent}=\text{wt \% Cr}+1.5\times\text{wt \% Si}+1.4\times\text{wt \% Mo}+\text{wt \% Nb}-4.99 \quad (4)$$

$$[Ni]\ \text{equivalent}=\text{wt \% Ni}+30\times\text{wt \% C}+0.5\times\text{wt \% Mn}+26\times\text{wt \% (N}-0.02)+2.77 \quad (5)$$

It is also suggested that other elements which are Ferrite stabilisers are also likely to influence the [Cr] equivalent factors to give a variation in such equations adopted by Schoefer[6]. These include the following elements which have been designated with the respective [Cr] equivalent factors that may be relevant to the variants of the Alloys contained herein:

| Element | [Cr] equivalent Factor |
|---|---|
| Tungsten | 0.72 |
| Vanadium | 2.27 |
| Titanium | 2.20 |
| Tantalum | 0.21 |
| Aluminium | 2.48 |

Likewise it is also suggested that other elements which are Austenite stabilisers are also likely to influence the [Ni] equivalent factors to give a variation in such equations adopted by Schoefer[6]. This includes the following element which has been designated with the respective [Ni] equivalent factor that may be relevant to the variants of the Alloys contained herein:

| Element | [Ni] equivalent Factor |
|---|---|
| Copper | 0.44 |

However, ASTM A800/A800M-10[7] states that the Schoefer[6] diagram is only applicable to Stainless Steel Alloys containing alloying elements in percentage by weight according to the following specification range:

| | C | Mn | Si | Cr | Ni | Mo | Nb | N |
|---|---|---|---|---|---|---|---|---|
| MIN | | | | 17.00 | 4.00 | | | |
| MAX | 0.20 | 2.00 | 2.00 | 28.00 | 13.00 | 4.00 | 1.00 | 0.20 |

From the foregoing, it can be deduced that the Nitrogen content in the 304LM4N stainless steel, is ≤0.70 wt % N, but preferably ≥0.40 wt % N and ≤0.70 wt % N and more preferably ≥0.40 wt % N and ≤0.60 wt % N and even more preferably ≥0.45 wt % N and ≤0.55 wt % N. This exceeds the Schoefer[6] diagram maximum limitations as adopted by ASTM A800/A800M-10[7]. Notwithstanding this, where appropriate, the Schoefer[6] diagram will give a relative comparison of the Ferrite number or Volume Percent Ferrite present in Higher Nitrogen containing Austenitic Stainless Steels.

Nitrogen is an extremely strong Austenite forming element along with Carbon. Similarly, Manganese and Nickel are also Austenite forming elements albeit to a lesser extent. The levels of Austenite forming elements such as Nitrogen and Carbon, as well as Manganese and Nickel are optimised to balance the Ferrite forming elements such as Chromium, Molybdenum and Silicon to primarily maintain an austenitic microstructure. As a result, Nitrogen indirectly limits the propensity to form intermetallic phases since diffusion rates are much slower in austenite. Thus, the kinetics of intermetallic phase formation is reduced. Likewise, in view of the fact that austenite has a good solubility for Nitrogen, this means that the potential to form deleterious precipitates such as $M_2X$. (carbo-nitrides, nitrides, borides, boro-nitrides or boro-carbides) as well as $M_{23}C_6$ carbides, in the weld metal and heat affected zone of weldments, during welding cycles, is reduced. As discussed already other variants of the stainless steels may also include elements such as Tungsten, Vanadium, Titanium, Tantalum, Aluminium and Copper.

Therefore, the 304LM4N stainless steel has been specifically developed to primarily ensure that the microstructure of the base material in the solution heat treated condition along with as-welded weld metal and heat affected zone of weldments is Austenitic. This is controlled by optimising the balance between Austenite forming elements and Ferrite forming elements. Therefore, the chemical analysis of the 304LM4N Stainless steel is optimised at the melting stage to ensure that the ratio of the [Cr] equivalent divided by the [Ni] equivalent, according to Schoefer[6], is in the range >0.40 and <1.05, but preferably >0.45 and <0.95.

As a result the 304LM4N Stainless steel exhibits a unique combination of High Strength and Ductility at ambient temperatures while at the same time guarantees excellent toughness at ambient temperatures and cryogenic temperatures. Furthermore the Alloy can be manufactured and supplied in the Non-Magnetic condition.

Optimum Chemical Composition

As a result of the forgoing, it has been determined that the optimum chemical composition range of the 304LM4N stainless steel is selective and includes in percentage by weight as follows:

(i) ≤0.030 wt % C maximum, but preferably ≥0.020 wt % C and ≤0.030 wt % C and more preferably ≤0.025 wt % C;

(ii) ≤2.0 wt % Mn, but preferably ≥1.0 wt % Mn and ≤2.0 wt % Mn and more preferably ≥1.20 wt % Mn and ≤1.50 wt % Mn, with a Mn to N ratio of ≤5.0 and preferably, ≥1.42 and ≤5.0 but more preferably, ≥1.42 and ≤3.75, for the lower Manganese range Alloys;

(iii) ≤0.030 wt % P, but preferably ≤0.025 wt % P and more preferably ≤0.020 wt % P and even more preferably ≤0.015 wt % P and even further more preferably ≤0.010 wt % P;

(iv) ≤0.010 wt % S, but preferably ≤0.005 wt % S and more preferably ≤0.003 wt % S, and even more preferably ≤0.001 wt % S;

(v) ≤0.070 wt % O, but preferably ≤0.050 wt % O, and more preferably ≤0.030 wt % O, and even more preferably ≤0.010 wt % O, and even further more preferably ≤0.005 wt % O;

(vi) ≤0.75 wt % Si, but preferably ≥0.25 wt % Si and ≤0.75 wt % Si and more preferably ≥0.40 wt % Si and ≤0.60 wt % Si;

(vii) ≤17.50 wt % Cr and ≤20.00 wt % Cr, but preferably ≥18.25 wt % Cr;

(viii) ≥8.00 wt % Ni and ≤12.00 wt % Ni, but preferably ≤11 wt % Ni and more preferably ≤10 wt % Ni;

(ix) ≤2.00 wt % Mo, but preferably ≥0.50 wt % Mo and ≤2.00 wt % Mo and more preferably ≥1.0 wt % Mo;

(x) ≤0.70 wt % N, but preferably ≥0.40 wt % N and ≤0.70 wt % N and more preferably ≥0.40 wt % N and ≤0.60 wt % N and even more preferably ≥0.45 wt % N and ≤0.55 wt % N.

The 304LM4N stainless steel has a high specified level of Nitrogen and a $PRE_N \geq 25$, but preferably $PRE_N \geq 30$. The chemical composition of the 304LM4N stainless steel is optimised at the melting stage to ensure that the ratio of the [Cr] equivalent divided by the [Ni] equivalent, according to Schoefer[6], is in the range >0.40 and <1.05, but preferably >0.45 and <0.95.

The 304LM4N stainless steel also contains principally Fe as the remainder and may also contain very small amounts of other elements such as Boron, Cerium, Aluminium, Calcium and/or Magnesium as well as other impurities which may be present in residual levels. The 304LM4N stainless steel may be manufactured without the addition of Boron and the residual level of Boron is typically ≥0.0001 wt % B and ≤0.0006 wt % B for mills which prefer not to intentionally add Boron to the heats. Alternatively, the 304LM4N stainless steel may be manufactured to specifically have a Boron content ≥0.001 wt % B and ≤0.010 wt % B, but preferably ≥0.0015 wt % B and ≤0.0035 wt % B. Cerium may be added with a Cerium content ≤0.10 wt % Ce, but preferably ≥0.01 wt % Ce and ≤0.10 wt % Ce and more preferably ≥0.03 wt % Ce and ≤0.08 wt % Ce. If the stainless steel contains Cerium it may also possibly contain other Rare Earth Metals (REM) such as Lanthanum since REMs are very often supplied to the Stainless steel manufacturers as Mischmetal. It should be noted that Rare Earth Metals may be utilised individually or together as Mischmetal providing the total amount of REMs conforms to the levels of Ce specified herein. Aluminium may be added with an Aluminium content ≤0.050 wt % Al, but preferably ≥0.005 wt % Al and ≤0.050 wt % Al and more preferably ≥0.010 wt % Al and ≤0.030 wt % Al. Calcium and/or Magnesium may be added with a Ca and/or Mg content of ≥0.001 and ≤0.01 wt % Ca and/or Mg but preferably ≤0.005 wt % Ca and/or Mg.

From the above, applications using the wrought 304LM4N stainless steel can frequently be designed with reduced wall thicknesses, thus leading to significant weight savings when specifying 304LM4N Stainless steel compared to conventional austenitic Stainless Steels such as UNS S30403 and S30453 because the minimum allowable design stresses are significantly higher. In fact, the minimum allowable design stresses for the wrought 304LM4N Stainless steel are higher than for 22 Cr Duplex Stainless Steels and similar to 25 Cr Super Duplex Stainless Steels.

It should also be appreciated that if wrought 304LM4N stainless steel is specified and utilised, this may lead to overall savings in fabrication and construction costs because thinner wall components may be designed which are easier to handle and require less fabrication time. Therefore, 304LM4N stainless steel may be utilised in a wide range of industry applications where structural integrity and corrosion resistance is demanded and is particularly suitable for offshore and onshore oil and gas applications.

Wrought 304LM4N Stainless steel is ideal for use in a wide range of Applications in various Markets and Industry Sectors such as topside piping systems and fabricated modules used for offshore Floating Liquefied Natural Gas (FLNG) vessels because of the significant weight savings and fabrication time savings that can be achieved, which in turn leads to significant cost savings. The 304LM4N stainless steel can also be specified and may be used for piping systems utilised for both offshore and onshore Applications, such as piping systems used for offshore FLNG vessels and onshore LNG plants, in view of their high mechanical strength properties and ductility, as well as possessing excellent toughness at ambient and cryogenic temperatures.

In addition to 304LM4N austenitic stainless steel, there is also proposed a second embodiment appropriately referred to as 316LM4N in this description.

316LM4N

The 316LM4N High strength austenitic stainless steel comprises a high level of Nitrogen and a specified Pitting Resistance Equivalent of $PRE_N \geq 30$, but preferably $PRE_N \geq 35$. The Pitting Resistance Equivalent as designated by $PRE_N$ is calculated according to the formulae:

$$PRE_N = \%\ Cr + (3.3 \times \%\ Mo) + (16 \times \%\ N).$$

The 316LM4N Stainless steel has been formulated to possess a unique combination of high mechanical strength properties with excellent ductility and toughness, along with good weldability and good resistance to general and localised corrosion. The chemical composition of the 316LM4N stainless steel is selective and characterised by an alloy of chemical elements in percentage by weight as follows, 0.030 wt % C max, 2.00 wt % Mn max, 0.030 wt % P max, 0.010 wt % S max, 0.75 wt % Si max, 16.00 wt % Cr—18.00 wt % Cr, 10.00 wt % Ni—14.00 wt % Ni, 2.00 wt % Mo—4.00 wt % Mo, 0.40 wt % N—0.70 wt % N.

The 316LM4N Stainless steel also comprises principally Fe as the remainder and may also contain very small amounts of other elements such as 0.010 wt % B max, 0.10 wt % Ce max, 0.050 wt % Al max, 0.01 wt % Ca max and/or 0.01 wt % Mg max and other impurities which are normally present in residual levels. The chemical composition of the 316LM4N stainless steel is optimised at the melting stage to primarily ensure an Austenitic microstructure in the base material after solution heat treatment typically performed in the range 1100 deg C. to 1250 deg C. followed by water quenching. The microstructure of the base material in the solution heat treated condition, along with as-welded weld metal and heat affected zone of weldments, is controlled by optimising the balance between Austenite forming elements and Ferrite forming elements to primarily ensure that the Alloy is Austenitic. As a result, the 316LM4N Stainless steel exhibits a unique combination of high strength and ductility at ambient temperatures, while at the same time guarantees excellent toughness at ambient temperatures and cryogenic temperatures. In view of the fact that the chemical analysis of the 316LM4N stainless steel is adjusted to guarantee a $PRE_N \geq 30$, but preferably $PRE_N \geq 35$, this ensures that the material also has a good resistance to general corrosion and localised corrosion (Pitting Corrosion and Crevice Corrosion) in a wide range of process environments. The 316LM4N Stainless steel also has improved resistance to stress corrosion cracking in Chloride containing environments when compared to conventional Austenitic Stainless Steels such as UNS S31603 and UNS S31653.

It has been determined that the optimum chemical composition range of the 316LM4N stainless steel is carefully selective to comprise the following chemical elements in percentage by weight as follows based on a second embodiment, Carbon (C)

Carbon content of the 316LM4N stainless steel is ≤0.030 wt % C maximum, but preferably ≥0.020 wt % C and ≤0.030 wt % C and more preferably ≤0.025 wt % C.

Manganese (Mn)

The 316LM4N stainless steel of the second embodiment may come in two variations: Low Manganese or high Manganese.

For the low Manganese alloys, the Manganese content of the 316LM4N stainless steel is ≤2.0 wt % Mn, but preferably ≥1.0 wt % Mn and ≤2.0 wt % Mn and more preferably ≥1.20 wt % Mn and ≤1.50 wt % Mn. With such a composition, this achieves an optimum Mn to N ratio of ≤5.0, and preferably, ≥1.42 and ≤5.0. More preferably, the ratio is ≥1.42 and ≤3.75.

For the high Manganese alloys, the Manganese content of the 316MN4N is ≤4.0 wt % Mn. Preferably, the Manganese content is ≥2.0 wt % Mn and ≤4.0 wt % Mn, and more preferably the upper limit is ≤3.0 wt % Mn. Even more preferably, the upper limit is ≤2.50 wt % Mn. With these selective ranges, this achieves a Mn to N ratio of ≤10.0, and preferably ≥2.85 and ≤10.0. More preferably, the Mn to N ratio for high Manganese alloys is ≥2.85 and ≤7.50 and even more preferably ≥2.85 and ≤6.25.

Phosphorus (P)

The Phosphorus content of the 316LM4N stainless steel is controlled to be ≤0.030 wt % P. Preferably, the 316LM4N alloy has ≤0.025 wt % P and more preferably ≤0.020 wt % P. Even more preferably, the alloy has ≤0.015 wt % P and even further more preferably ≤0.010 wt % P.

Sulphur (S)

The Sulphur content of the 316LM4N stainless steel is ≤0.010 wt % S. Preferably, the 316LM4N has ≤0.005 wt % S and more preferably ≤0.003 wt % S, and even more preferably ≤0.001 wt % S.

Oxygen (O)

The Oxygen content of the 316LM4N stainless steel is controlled to be as low as possible and in the second embodiment, the 316LM4N has ≤0.070 wt % O. Preferably, the 316LM4N has ≤0.050 wt % O and more preferably ≤0.030 wt % O. Even more preferably, the alloy has ≤0.010 wt % O and even further more preferably ≤0.005 wt % O.

Silicon (Si)

The Silicon content of the 316LM4N stainless steel has ≤0.75 wt % Si. Preferably, the alloy has ≥0.25 wt % Si and ≤0.75 wt % Si. More preferably, the range is ≥0.40 wt % Si and ≤0.60 wt % Si. However, for higher temperature applications wherein improved oxidation resistance is required, the Silicon content may be ≥0.75 wt % Si and ≤2.00 wt % Si.

Chromium (Cr)

The Chromium content of the 316LM4N stainless steel is ≥16.00 wt % Cr and ≤18.00 wt % Cr. Preferably, the alloy has ≥17.25 wt % Cr.

Nickel (Ni)

The Nickel content of the 316LM4N stainless steel is ≥10.00 wt % Ni and ≤14.00 wt % Ni. Preferably, the upper limit of Ni of the alloy is ≤13.00 wt % Ni and more preferably ≤12.00 wt % Ni.

Molybdenum (Mo)

The Molybdenum content of the 316LM4N stainless steel is ≥2.00 wt % Mo and ≤4.00 wt % Mo. Preferably, the lower limit is ≥3.0 wt % Mo.

Nitrogen (N)

The Nitrogen content of the 316LM4N stainless steel is ≤0.70 wt % N, but preferably ≥0.40 wt % N and ≤0.70 wt % N. More preferably, the 316LM4N has ≥0.40 wt % N and ≤0.60 wt % N, and even more preferably ≥0.45 wt % N and ≤0.55 wt % N.

$PRE_N$

The PITTING RESISTANCE EQUIVALENT ($PRE_N$) is calculated using the formulae:

$$PRE_N = \%\ Cr + (3.3 \times \%\ Mo) + (16 \times \%\ N).$$

The 316LM4N Stainless steel has been specifically formulated to have the following composition:

(i) Chromium content ≥16.00 wt % Cr and ≤18.00 wt % Cr, but preferably ≥17.25 wt % Cr, (ii) Molybdenum content ≥2.00 wt % Mo and ≤4.00 wt % Mo, but preferably ≥3.0 wt % Mo, (iii) Nitrogen content ≤0.70 wt % N, but preferably ≥0.40 wt % N and ≤0.70 wt % N and more preferably ≥0.40 wt % N and ≤0.60 wt % N and even more preferably ≥0.45 wt % N and ≤0.55 wt % N.

With a high level of Nitrogen, the 316LM4N stainless steel achieves a $PRE_N \geq 30$, but preferably $PRE_N \geq 35$. This ensures that the alloy also has a good resistance to general corrosion and localised corrosion (Pitting Corrosion and Crevice Corrosion) in a wide range of process environments. The 316LM4N stainless steel also has improved resistance to stress corrosion cracking in Chloride containing environments when compared to conventional Austenitic Stainless Steels such as UNS S31603 and UNS S31653. It should be emphasised that these equations ignore the effects of microstructural factors on the breakdown of passivity by pitting or crevice corrosion.

The chemical composition of the 316LM4N stainless steel is optimised at the melting stage to ensure that the ratio of the [Cr] equivalent divided by the [Ni] equivalent, according to Schoefer[6], is in the range >0.40 and <1.05, but preferably >0.45 and <0.95, in order to primarily obtain an austenitic microstructure in the base material after solution heat treatment typically performed in the range 1100 deg C.-1250 deg C. followed by water quenching. The microstructure of the base material in the solution heat treated condition, along with as-welded weld metal and heat affected zone of weldments, is controlled by optimising the balance between austenite forming elements and Ferrite forming elements to primarily ensure that the alloy is austenitic. The alloy can therefore be manufactured and supplied in the Non-Magnetic condition.

The 316LM4N Stainless steel also has principally Fe as the remainder and may also contain very small amounts of other elements such as Boron, Cerium, Aluminium, Calcium and/or Magnesium in percentage by weight and the compositions of these elements are the same as those of 304LM4N. In other words, the passages relating to these elements for 304LM4N are also applicable here.

The 316LM4N stainless steel according to the second embodiment possesses minimum yield strength of 55 ksi or 380 MPa for the wrought version. More preferably, minimum yield strength of 62 ksi or 430 MPa may be achieved for the wrought version. The cast version possesses minimum yield strength of 41 ksi or 280 MPa. More preferably, minimum yield strength of 48 ksi or 330 MPa may be achieved for the cast version. Based on the preferred values, a comparison of the wrought mechanical strength properties of the 316LM4N stainless steel, with those of UNS S31603, suggest that the minimum yield strength of the 316LM4N stainless steel might be 2.5 times higher than that specified for UNS S31603. Similarly, a comparison of the wrought mechanical strength properties of the novel and innovative 316LM4N stainless steel, with those of UNS S31653, may suggest that the minimum yield strength of the 316LM4N stainless steel is 2.1 times higher than that specified for UNS S31653.

The 316LM4N stainless steel according to the second embodiment possesses a minimum tensile strength of 102 ksi or 700 MPa for the wrought version. More preferably, a minimum tensile strength of 109 ksi or 750 MPa may be achieved and for the wrought version. The cast version possesses a minimum tensile strength of 95 ksi or 650 MPa. More preferably, a minimum tensile strength of 102 ksi or 700 MPa may be achieved for the cast version. Based on the preferred values, a comparison of the wrought mechanical strength properties of the 316LM4N stainless steel, with those of UNS S31603, may suggest that the minimum tensile strength of the 316LM4N stainless steel is more than 1.5 times higher than that specified for UNS S31603. Similarly, a comparison of the wrought mechanical strength properties of the 316LM4N stainless steel, with those of UNS S31653, may suggest that the minimum tensile strength of the 316LM4N stainless steel might be 1.45 times higher than that specified for UNS S31653. Indeed, if the wrought mechanical strength properties of the novel and innovative 316LM4N stainless steel, are compared with those of the 22 Cr Duplex Stainless Steel, then it might be demonstrated that the minimum tensile strength of the 316LM4N stainless steel might be in the region of 1.2 times higher than that specified for S31803 and similar to that specified for 25 Cr Super Duplex Stainless Steel. Therefore, the minimum mechanical strength properties of the 316LM4N stainless steel have been significantly improved compared to conventional Austenitic Stainless Steels such as UNS S31603 and UNS S31653 and the tensile strength properties are better than that specified for 22 Cr Duplex Stainless Steel and similar to those specified for 25 Cr Super Duplex Stainless Steel.

This means that applications using the wrought 316LM4N stainless steel may be frequently designed with reduced wall thicknesses, thus, leading to significant weight savings when specifying 316LM4N stainless steel compared to conventional austenitic stainless steels such as UNS S31603 and S31653 because the minimum allowable design stresses are significantly higher. In fact, the minimum allowable design stresses for the wrought 316LM4N Stainless steel may be higher than for 22 Cr Duplex Stainless Steels and similar to 25 Cr Super Duplex Stainless Steels.

For certain applications, other variants of the 316LM4N stainless steel have been purposely formulated to be manufactured containing specific levels of other alloying elements such as Copper, Tungsten and Vanadium. It has been determined that the optimum chemical composition range of the other variants of the 316LM4N stainless steel is selective and the compositions of Copper and Vanadium are the same as those of 304LM4N. In other words, the passages relating to these elements for 304LM4N are also applicable here for the 316LM4N.

Tungsten (W)

The Tungsten content of the 316LM4N stainless steel is ≤2.00 wt % W, but preferably ≥0.50 wt % W and ≤1.00 wt % W and more preferably ≥0.75 wt % W. For 316LM4N stainless steel variants containing Tungsten, the PITTING RESISTANCE EQUIVALENT is calculated using the formulae:

$$PRE_{NW}=\%\ Cr+[3.3\times\%\ (Mo+W)]+(16\times\%\ N).$$

This Tungsten containing variant of the 316LM4N stainless steel has been specifically formulated to have the following composition:

(i) Chromium content ≥16.00 wt % Cr and ≤18.00 wt % Cr, but preferably ≥17.25 wt % Cr;

(ii) Molybdenum content ≥2.00 wt % Mo and ≤4.00 wt % Mo, but preferably ≥3.0 wt % Mo;

(iii) Nitrogen content ≤0.70 wt % N, but preferably ≥0.40 wt % N and ≤0.70 wt % N and more preferably ≥0.40 wt % N and ≤0.60 wt % N and even more preferably ≥0.45 wt % N and ≤0.55 wt % N; and (iv) Tungsten content ≤2.00 wt % W, but preferably ≥0.50 wt % W and ≤1.00 wt % W and more preferably ≥0.75 wt % W.

The Tungsten containing variant of the 316LM4N Stainless steel has a high specified level of Nitrogen and a $PRE_{NW}$≥32, but preferably $PRE_{NW}$≥37. It should be emphasised that these equations ignore the effects of microstructural factors on the breakdown of passivity by pitting or crevice corrosion. Tungsten may be added individually or in conjunction with Copper, Vanadium, Titanium and/or Niobium and/or Niobium plus Tantalum in all the various combinations of these elements, to further improve the overall corrosion performance of the alloy. Tungsten is extremely costly and therefore is being purposely limited to optimise the economics of the alloy, while at the same time optimising the ductility, toughness and corrosion performance of the alloy.

Carbon (C)

For certain applications, other variants of the 316LM4N Stainless steel are desirable, which have been specifically formulated to be manufactured comprising higher levels of Carbon. Specifically, the Carbon content of the 316LM4N stainless steel may be ≥0.040 wt % C and <0.10 wt % C, but preferably ≤0.050 wt % C or >0.030 wt % C and ≤0.08 wt % C, but preferably <0.040 wt % C. These specific variants of the 316LM4N Stainless steel may be regarded as the 316HM4N or 316M4N versions respectively.

Titanium (Ti)/Niobium (Nb)/Niobium (Nb) Plus Tantalum (Ta)

Furthermore, for certain applications, other stabilised variants of the 316HM4N or 316M4N stainless steel are desirable, which have been specifically formulated to be manufactured containing higher levels of Carbon. Specifically, the amount of Carbon may be ≥0.040 wt % C and <0.10 wt % C, but preferably ≤0.050 wt % C or >0.030 wt % C and ≤0.08 wt % C, but preferably <0.040 wt % C.

(i) These include the Titanium stabilised versions which are referred to as 316HM4NTi or 316M4NTi to contrast with the generic 316LM4N stainless steel versions. The Titanium content is controlled according to the following formulae:

Ti 4×C min, 0.70 wt % Ti max or Ti 5×C min, 0.70 wt % Ti max respectively, in order to have Titanium stabilised derivatives of the alloy.

(ii) There are also the Niobium stabilised, 316HM4NNb or 316M4NNb versions where the Niobium content is controlled according to the following formulae:

Nb 8×C min, 1.0 wt % Nb max or Nb 10×C min, 1.0 wt % Nb max respectively, in order to have Niobium stabilised derivatives of the alloy.

(iii) In addition, other variants of the alloy may also be manufactured to contain Niobium plus Tantalum stabilised, 316HM4NNbTa or 316M4NNbTa versions where the Niobium plus Tantalum content is controlled according to the following formulae:

Nb+Ta 8×C min, 1.0 wt % Nb+Ta max, 0.10 wt % Ta max, or Nb+Ta 10×C min, 1.0 wt % Nb+Ta max, 0.10 wt % Ta max.

Titanium stabilised, Niobium stabilised and Niobium plus Tantalum stabilised variants of the Alloy may be given a stabilisation heat treatment at a temperature lower than the initial solution heat treatment temperature. Titanium and/or Niobium and/or Niobium plus Tantalum may be added individually or in conjunction with Copper, Tungsten and Vanadium in all the various combinations of these elements to optimise the alloy for certain applications where higher Carbon contents are desirable. These alloying elements may be utilised individually or in all the various combinations of the elements to tailor the Stainless steel for specific applications and to further improve the overall corrosion performance of the alloy.

The wrought and cast versions of the 316LM4N Stainless steel along with the other variants and embodiments discussed herein are generally supplied in the solution annealed condition. However, the weldments of Fabricated components, modules and fabrications are generally supplied in the as—welded condition, providing that suitable Weld Procedure Qualifications have been prequalified in accordance with the respective standards and specifications. For specific applications the wrought versions may also be supplied in the cold worked condition.

It should be appreciated that the effect of the various elements and their compositions as discussed in relation to 304LM4N are also applicable to 316LM4N (and the embodiments discussed below) to appreciate how the optimum chemical composition is obtained for the 316LM4N stainless steel (and the rest of the embodiments).

In addition to 304LM4N and 316LM4N austenitic stainless steels, there is also proposed a further variation appropriately referred to as 317L57M4N and this forms a third embodiment of this invention.

[317L57M4N]

The 317L57M4N High strength austenitic stainless steel has a high level of Nitrogen and a specified Pitting Resistance Equivalent of $PRE_N \geq 40$, but preferably $PRE_N \geq 45$. The Pitting Resistance Equivalent as designated by $PRE_N$ is calculated according to the formulae:

$$PRE_N = \%\ Cr + (3.3 \times \%\ Mo) + (16 \times \%\ N).$$

The 317L57M4N Stainless steel has been formulated to possess a unique combination of high mechanical strength properties with excellent ductility and toughness, along with good weldability and good resistance to general and localised corrosion. The chemical composition of the 317L57M4N stainless steel is selective and characterised by an alloy of chemical elements in percentage by weight as follows, 0.030 wt % C max, 2.00 wt % Mn max, 0.030 wt % P max, 0.010 wt % S max, 0.75 wt % Si max, 18.00 wt % Cr—20.00 wt % Cr, 11.00 wt % Ni—15.00 wt % Ni, 5.00 wt % Mo—7.00 wt % Mo, 0.40 wt % N—0.70 wt % N.

The 317L57M4N stainless steel also comprises principally Fe as the remainder and may also contain very small amounts of other elements such as 0.010 wt % B max, 0.10 wt % Ce max, 0.050 wt % Al max, 0.01 wt % Ca max and/or 0.01 wt % Mg max and other impurities which are normally present in residual levels.

The chemical composition of the 317L57M4N stainless steel is optimised at the melting stage to primarily ensure an austenitic microstructure in the base material after solution heat treatment typically performed in the range 1100 deg C.-1250 deg C. followed by water quenching. The microstructure of the base material in the solution heat treated condition, along with as-welded weld metal and heat affected zone of weldments, is controlled by optimising the balance between austenite forming elements and ferrite forming elements to primarily ensure that the alloy is austenitic. As a result, the 317L57M4N stainless steel exhibits a unique combination of high strength and ductility at ambient temperatures, while at the same time achieves excellent toughness at ambient temperatures and cryogenic temperatures. In view of the fact that the chemical analysis of the 317L57M4N stainless steel is adjusted to achieve a $PRE_N \geq 40$, but preferably $PRE_N \geq 45$, this ensures that the material also has a good resistance to general corrosion and localised corrosion (Pitting Corrosion and Crevice Corrosion) in a wide range of process environments. The 317L57M4N stainless steel also has improved resistance to stress corrosion cracking in Chloride containing environments when compared to conventional Austenitic Stainless Steels such as UNS S31703 and UNS S31753.

It has been determined that the optimum chemical composition range of the 317L57M4N stainless steel is carefully selected to comprise the following chemical elements in percentage by weight as follows based on the third embodiment, Carbon (C)

The Carbon content of the 317L57M4N stainless steel is ≤0.030 wt % C maximum. Preferably, the amount of Carbon should be ≤0.020 wt % C and ≤0.030 wt % C and more preferably ≤0.025 wt % C.

Manganese (Mn)

The 317LM57M4N stainless steel of the third embodiment may come in two variations: low Manganese or high Manganese.

For the low Manganese alloys, the Manganese content of the 317L57M4N stainless steel is ≤2.0 wt % Mn. Preferably, the range is ≥1.0 wt % Mn and ≤2.0 wt % Mn and more preferably ≥1.20 wt % Mn and ≤1.50 wt % Mn. With such compositions, this achieves an optimum Mn to N ratio of ≤5.0, and preferably ≥1.42 and ≤5.0. More preferably, the ratio is ≥1.42 and ≤3.75.

For the high Manganese alloys, the Manganese content of the 317L57M4N is ≤4.0 wt % Mn. Preferably, the Manganese content is ≥2.0 wt % Mn and ≤4.0 wt % Mn, and more preferably, the upper limit is ≤3.0 wt % Mn. Even more preferably, the upper limit is ≤2.50 wt % Mn. With such selective ranges, this achieves a Mn to N ratio of ≤10.0, and preferably ≥2.85 and ≤10.0. More preferably, the Mn to N ratio for high Manganese alloys is ≥2.85 and ≤7.50 and even more preferably ≥2.85 and ≤6.25.

Phosphorus (P)

The Phosphorus content of the 317L57M4N stainless steel is controlled to be ≤0.030 wt % P. Preferably, the 317L57M4N alloy has ≤0.025 wt % P and more preferably ≤0.020 wt % P. Even more preferably, the alloy has ≤0.015 wt % P and even further more preferably ≤0.010 wt % P.

Sulphur (S)

The Sulphur content of the 317L57M4N stainless steel of the third embodiment includes ≤0.010 wt % S. Preferably, the 317L57M4N has ≤0.005 wt % S and more preferably ≤0.003 wt % S, and even more preferably ≤0.001 wt % S.

Oxygen (O)

The Oxygen content of the 317L57M4N stainless steel is controlled to be as low as possible and in the third embodiment, the 317L57M4N also has ≤0.070 wt % O. Preferably, the 317L57M4N alloy has ≤0.050 wt % O and more preferably ≤0.030 wt % O. Even more preferably, the alloy has ≤0.010 wt % O and even further more preferably ≤0.005 wt % O.

Silicon (Si)

The Silicon content of the 317L57M4N stainless steel is ≤0.75 wt % Si. Preferably, the alloy has ≥0.25 wt % Si and ≤0.75 wt % Si. More preferably, the range is ≥0.40 wt % Si and ≤0.60 wt % Si. However, for specific higher temperature applications where improved oxidation resistance is required, the Silicon content may be ≥0.75 wt % Si and ≤2.00 wt % Si.

Chromium (Cr)

The Chromium content of the 317L57M4N stainless steel is ≥18.00 wt % Cr and ≤20.00 wt % Cr. Preferably, the alloy has ≥19.00 wt % Cr.

Nickel (Ni)

The Nickel content of the 317L57M4N stainless steel is ≥11.00 wt % Ni and ≤15.00 wt % Ni. Preferably, the upper limit of Ni of the alloy is ≤14.00 wt % Ni and more preferably ≤13.00 wt % Ni for the lower Nickel range alloys.

For higher Nickel range alloys, the Nickel content of the 317L57M4N stainless steel may have ≥13.50 wt % Ni and ≤17.50 wt % Ni. Preferably, the upper limit of the Ni is ≤16.50 wt % Ni and more preferably ≤15.50 wt % Ni for the higher Nickel range alloys.

Molybdenum (Mo)

The Molybdenum content of the 317L57M4N stainless steel alloy is ≥5.00 wt % Mo and ≤7.00 wt % Mo, but preferably ≥6.00 wt % Mo. In other words, the Molybdenum has a maximum of 7.00 wt % Mo.

Nitrogen (N)

The Nitrogen content of the 317L57M4N stainless steel is ≤0.70 wt % N, but preferably ≥0.40 wt % N and ≤0.70 wt % N. More preferably, the 317L57M4N has ≥0.40 wt % N and ≤0.60 wt % N, and even more preferably ≥0.45 wt % N and ≤0.55 wt % N.

$PRE_N$

The PITTING RESISTANCE EQUIVALENT is calculated using the formulae:

$$PRE_N = \%\ Cr + (3.3 \times \%\ Mo) + (16 \times \%\ N).$$

The 317L57M4N stainless steel has been specifically formulated to have the following composition:

(i) Chromium content ≥18.00 wt % Cr and ≤20.00 wt % Cr, but preferably ≥19.00 wt % Cr;

(ii) Molybdenum content ≥5.00 wt % Mo and ≤7.00 wt % Mo, but preferably ≥6.00 wt % Mo (iii) Nitrogen content ≤0.70 wt % N, but preferably ≥0.40 wt % N and ≤0.70 wt % N and more preferably ≥0.40 wt % N and ≤0.60 wt % N and even more preferably ≥0.45 wt % N and ≤0.55 wt % N.

With a high level of Nitrogen, the 317L57M4N stainless steel achieves a $PRE_N$ of ≥40, and preferably $PRE_N$≥45. This ensures that the alloy has a good resistance to general corrosion and localised corrosion (Pitting Corrosion and Crevice Corrosion) in a wide range of process environments. The 317L57M4N stainless steel also has improved resistance to stress corrosion cracking in Chloride containing environments when compared to conventional austenitic stainless steels such as UNS S31703 and UNS S31753. It should be emphasised that these equations ignore the effects of microstructural factors on the breakdown of passivity by pitting or crevice corrosion The chemical composition of the 317L57M4N Stainless steel is optimised at the melting stage to ensure that the ratio of the [Cr] equivalent divided by the [Ni] equivalent, according to Schoefer[6], is in the range >0.40 and <1.05, but preferably >0.45 and <0.95, in order to primarily obtain an austenitic microstructure in the base material after solution heat treatment typically performed in the range 1100 deg C.-1250 deg C. followed by water quenching. The microstructure of the base material in the solution heat treated condition, along with as-welded weld metal and heat affected zone of weldments, is controlled by optimising the balance between austenite forming elements and Ferrite forming elements to primarily ensure that the alloy is austenitic. The alloy can therefore be manufactured and supplied in the Non-Magnetic condition.

The 317L57M4N stainless steel also has principally Fe as the remainder and may also contain very small amounts of other elements such as Boron, Cerium, Aluminium, Calcium and/or Magnesium in percentage by weight, and the compositions of these elements are the same as those of 304LM4N. In other words, the passages relating to these elements for 304LM4N are also applicable here.

The 317L57M4N stainless steel according to the third embodiment possesses minimum yield strength of 55 ksi or 380 MPa for the wrought version. More preferably, minimum yield strength of 62 ksi or 430 MPa may be achieved for the wrought version. The cast version possesses minimum yield strength of 41 ksi or 280 MPa. More preferably, minimum yield strength of 48 ksi or 330 MPa may be achieved for the cast version. Based on the preferred values, a comparison of the wrought mechanical strength properties of the novel and innovative 317L57M4N stainless steel, with those of UNS S31703, suggests that the minimum yield strength of the 317L57M4N stainless steel might be 2.1 times higher than that specified for UNS S31703. Similarly, a comparison of the wrought mechanical strength properties of the 317L57M4N stainless steel, with those of UNS S31753, suggests that the minimum yield strength of the 317L57M4N stainless steel might be 1.79 times higher than that specified for UNS S31753.

The 317L57M4N stainless steel according to the third embodiment possesses a minimum tensile strength of 102 ksi or 700 MPa for the wrought version. More preferably, a minimum tensile strength of 109 ksi or 750 MPa may be achieved for the wrought version. The cast version possesses a minimum tensile strength of 95 ksi or 650 MPa. More preferably, a minimum tensile strength of 102 ksi or 700 MPa may be achieved for the cast version. Based on the preferred values a comparison of the wrought mechanical strength properties of the 317L57M4N stainless steel, with those of UNS S31703, suggests that the minimum tensile strength of the 317L57M4N Stainless steel might be more than 1.45 times higher than that specified for UNS S31703. Similarly, a comparison of the wrought mechanical strength properties of the novel and innovative 317L57M4N Stainless steel, with those of UNS 531753, suggests that the minimum tensile strength of the 317L57M4N Stainless steel might be 1.36 times higher than that specified for UNS S31753. Indeed, if the wrought mechanical strength properties of the 317L57M4N Stainless steel, are compared with those of the 22 Cr Duplex Stainless Steel in Table 2, then it may be demonstrated that the minimum tensile strength of the 317L57M4N stainless steel is in the region of 1.2 times higher than that specified for S31803 and similar to that specified for 25 Cr Super Duplex Stainless Steel. Therefore, the minimum mechanical strength properties of the 317L57M4N stainless steel have been significantly improved compared to conventional Austenitic Stainless Steels such as UNS S31703 and UNS S31753 and the tensile strength properties are better than that specified for 22 Cr Duplex Stainless Steel and similar to those specified for 25 Cr Super Duplex Stainless Steel.

This means that applications using the wrought 317L57M4N stainless steel may be frequently designed with reduced wall thicknesses, thus, leading to significant weight savings when specifying 317L57M4N stainless steel compared to conventional austenitic stainless steels such as UNS S31703 and 531753 because the minimum allowable design stresses are significantly higher. In fact, the minimum allowable design stresses for the wrought 317L57M4N stainless steel are higher than for 22 Cr Duplex Stainless Steels and similar to 25 Cr Super Duplex Stainless Steels.

For certain applications, other variants of the 317L57M4N stainless steel have been purposely formulated to be manufactured containing specific levels of other alloying elements such as Copper, Tungsten and Vanadium. It has been determined that the optimum chemical composition range of the other variants of the 317L57M4N stainless steel is selective and the compositions of Copper and Vanadium are the same as those of 304LM4N. In other words, the passages relating to these elements for 304LM4N are also applicable here for 317L57M4N.

Tungsten (W)

The Tungsten content of the 317L57M4N stainless steel is ≤2.00 wt % W, but preferably ≥0.50 wt % W and ≤1.00 wt % W and more preferably ≥0.75 wt % W. For 317L57M4N stainless steel variants containing Tungsten, the PITTING RESISTANCE EQUIVALENT is calculated using the formulae:

$$PRE_{NW}=\%\ Cr+[3.3\times\%\ (Mo+W)]+(16\times\%\ N).$$

This Tungsten containing variant of the 317L57M4N stainless steel has been specifically formulated to have the following composition:

(i) Chromium content ≥18.00 wt % Cr and ≤20.00 wt % Cr, but preferably ≥19.00 wt % Cr;

(ii) Molybdenum content ≥5.00 wt % Mo and ≤7.00 wt % Mo, but preferably ≥6.00 wt % Mo, (iii) Nitrogen content ≤0.70 wt % N, but preferably ≥0.40 wt % N and ≤0.70 wt % N and more preferably ≥0.40 wt % N and ≤0.60 wt % N and even more preferably ≥0.45 wt % N and ≤0.55 wt % N; and (iv) Tungsten content ≤2.00 wt % W, but preferably ≥0.50 wt % W and ≤1.00 wt % W and more preferably ≥0.75 wt % W.

The Tungsten containing variant of the 317L57M4N Stainless steel has a high specified level of Nitrogen and a $PRE_{NW}$≥42, but preferably $PRE_{NW}$≥47. It should be emphasised that these equations ignore the effects of microstructural factors on the breakdown of passivity by pitting or crevice corrosion. Tungsten may be added individually or in conjunction with Copper, Vanadium, Titanium and/or Niobium and/or Niobium plus Tantalum in all the various combinations of these elements, to further improve the overall corrosion performance of the alloy. Tungsten is extremely costly and therefore is being purposely limited to optimise the economics of the alloy, while at the same time optimising the ductility, toughness and corrosion performance of the alloy.

Carbon (C)

For certain applications, other variants of the 317L57M4N stainless steel are desirable, which have been specifically formulated to be manufactured comprising higher levels of Carbon. Specifically, the Carbon content of the 317L57M4N stainless steel may be ≥0.040 wt % C and <0.10 wt % C, but preferably ≤0.050 wt % C or >0.030 wt % C and ≤0.08 wt % C, but preferably <0.040 wt % C. These specific variants of the 317L57M4N stainless steel are the 317H57M4N or 31757M4N versions respectively.

Titanium (Ti)/Niobium (Nb)/Niobium (Nb) plus Tantalum (Ta)

Furthermore, for certain applications, other stabilised variants of the 317H57M4N or 31757M4N stainless steel are desirable, which have been specifically formulated to be manufactured comprising higher levels of Carbon. Specifically, the Carbon may be ≥0.040 wt % C and <0.10 wt % C, but preferably ≤0.050 wt % C or >0.030 wt % C and ≤0.08 wt % C, but preferably <0.040 wt % C.

(i) These include the Titanium stabilised versions which are referred to as 317H57M4NTi or 31757M4NTi to contrast with the generic 317L574N steel versions. The Titanium content is controlled according to the following formulae:

Ti 4×C min, 0.70 wt % Ti max or Ti 5×C min, 0.70 wt % Ti max respectively, in order to have Titanium stabilised derivatives of the alloy.

(ii) There are also the Niobium stabilised, 317H57M4NNb or 31757M4NNb versions where the Niobium content is controlled according to the following formulae:

Nb 8×C min, 1.0 wt % Nb max or Nb 10×C min, 1.0 wt % Nb max respectively, in order to have Niobium stabilised derivatives of the alloy.

(iii) In addition, other variants of the alloy may also be manufactured to contain Niobium plus Tantalum stabilised, 317H57M4NNbTa or 31757M4NNbTa versions where the Niobium plus Tantalum content is controlled according to the following formulae:

Nb+Ta 8×C min, 1.0 wt % Nb+Ta max, 0.10 wt % Ta max, or Nb+Ta 10×C min, 1.0 wt % Nb+Ta max, 0.10 wt % Ta max.

Titanium stabilised, Niobium stabilised and Niobium plus Tantalum stabilised variants of the alloy may be given a stabilisation heat treatment at a temperature lower than the initial solution heat treatment temperature. Titanium and/or Niobium and/or Niobium plus Tantalum may be added individually or in conjunction with Copper, Tungsten and Vanadium in all the various combinations of these elements to optimise the alloy for certain applications where higher Carbon contents are desirable. These alloying elements may be utilised individually or in all the various combinations of the elements to tailor the stainless steel for specific applications and to further improve the overall corrosion performance of the alloy.

The wrought and cast versions of the 317L57M4N stainless steel along with the other variants are generally supplied in the same manner as the earlier embodiments.

Further, there is proposed a further variation appropriately referred to as 317L35M4N high strength austenitic stainless steel, which is a fourth embodiment of the invention. The 317L35M4N stainless steel virtually has the same chemical compositions as 317L57M4N stainless steel with the exception of the Molybdenum content. Thus, instead of repeating the various chemical compositions, only the difference is described.

[317L35M4N]

As mentioned above, the 317L35M4N has exactly the same wt % Carbon, Manganese, Phosphorus, Sulphur, Oxygen, Silicon, Chromium, Nickel and Nitrogen content as the third embodiment, 317L57M4N stainless steel, except the Molybdenum content. In the 317L57M4N stainless steel, the Molybdenum level is between 5.00 wt % and 7.00 wt % Mo. In contrast, the 317L35M4N stainless steel's Molybdenum content is between 3.00 wt % and 5.00% Mo. In other words, the 317L35M4N may be regarded as a lower Molybdenum version of the 317L57M4N stainless steel.

It should be appreciated that the passages relating to 317L57M4N are also applicable here, except the Molybdenum content.

Molybdenum (Mo)

The Molybdenum content of the 317L35M4N stainless steel may be ≥3.00 wt % Mo and ≤5.00 wt % Mo, but preferably ≥4.00 wt % Mo. In other words, the Molybdenum content of the 317L35M4N has a maximum of 5.00 wt % Mo.

$PRE_N$

The PITTING RESISTANCE EQUIVALENT for the 317L35M4N is calculated using the same formulae as 317L57M4N, but because of the different Molybdenum content, the $PRE_N$ is ≥35, but preferably $PRE_N$≥40. This ensures that the material also has a good resistance to general corrosion and localised corrosion (Pitting Corrosion and Crevice Corrosion) in a wide range of process environments. The 317L35M4N stainless steel also has improved resistance to stress corrosion cracking in Chloride containing environments when compared to conventional Austenitic Stainless Steels such as UNS S31703 and UNS S31753. It should be emphasised that these equations ignore the effects of microstructural factors on the breakdown of passivity by pitting or crevice corrosion.

The chemical composition of the 317L35M4N Stainless steel is optimised at the melting stage to ensure that the ratio of the [Cr] equivalent divided by the [Ni] equivalent, according to Schoefer[6], is in the range >0.40 and <1.05, but preferably >0.45 and <0.95, in order to primarily obtain an austenitic microstructure in the base material after solution heat treatment typically performed in the range 1100 deg C.-1250 deg C. followed by water quenching. The microstructure of the base material in the solution heat treated condition, along with as-welded weld metal and heat affected zone of weldments, is controlled by optimising the balance between austenite forming elements and ferrite forming elements to primarily ensure that the alloy is austenitic. As a result, the 317L35M4N stainless steel exhibits a unique combination of high strength and ductility at ambient temperatures, while at the same time guarantees excellent toughness at ambient temperatures and cryogenic temperatures. The alloy can therefore be manufactured and supplied in the Non-Magnetic condition.

Like the 317L57M4N embodiment, the 317L35M4N stainless steel also contains principally Fe as the remainder and may also contain very small amounts of other elements such as Boron, Cerium, Aluminium, Calcium and/or Magnesium in percentage by weight, and the compositions of these elements are the same as those of 317L57M4N and thus, those of 304LM4N.

The 317L35M4N stainless steel of the fourth embodiment has minimum yield strength and a minimum tensile strength comparable or similar to those of the 317L57M4N stainless steel. Likewise, the strength properties of the wrought and cast versions of the 317L35M4N are also comparable to those of the 317L57M4N. Thus, the specific strength values are not repeated here and reference is made to the earlier passages of 317L57M4N. A comparison of the wrought mechanical strength properties between 317L35M4N and those of conventional austenitic stainless steel UNS S31703, and between 317L35M4N and those of UNS S31753, suggests stronger yield and tensile strengths of the magnitude similar to those found for 317L57M4N. Similarly a comparison of the tensile properties of 317L35M4N demonstrates they are better than that specified for 22 Cr Duplex Stainless Steel and similar to those specified for 25 Cr Super Duplex Stainless Steel, just like the 317L57M4N.

This means that applications using the wrought 317L35M4N stainless steel may be frequently designed with reduced wall thicknesses, thus, leading to significant weight savings when specifying 317L35M4N stainless steel compared to conventional austenitic stainless steels such as UNS S31703 and S31753 because the minimum allowable design stresses are significantly higher. In fact, the minimum allowable design stresses for the wrought 317L35M4N stainless steel are higher than for 22 Cr Duplex Stainless Steels and similar to 25 Cr Super Duplex Stainless Steels.

For certain applications, other variants of the 317L35M4N stainless steel have been purposely formulated to be manufactured containing specific levels of other alloying elements such as Copper, Tungsten and Vanadium. It has been determined that the optimum chemical composition range of the other variants of the 317L35M4N stainless steel is selective and the compositions of Copper and Vanadium are the same as those of 317L57M4N and those of 304LM4N. In other words, the passages relating to these elements for 304LM4N are also applicable here for 317L35M4N.

Tungsten (W)

The Tungsten content of the 317L35M4N stainless steel is similar to those of 317L57M4N and the PITTING RESISTANCE EQUIVALENT, $PRE_{NW}$, of 317L35M4N calculated using the same formulae as mentioned above for 317L57M4N is ≥37, and preferably $PRE_{NW}$≥42, due to the different Molybdenum content. It should be apparent that the passage relating to the use and effects of Tungsten for 317L57M4N is also applicable for 317L35M4N.

Further, the 317L35M4N may have higher levels of Carbon referred to as 317H35M4N and 31735M4N which correspond respectively to 317H57M4N and 31757M4N discussed earlier and the Carbon wt % ranges discussed earlier are also applicable for 317H35M4N and 31735M4N.

Titanium (Ti)/Niobium (Nb)/Niobium (Nb) Plus Tantalum (Ta)

Furthermore, for certain applications, other stabilised variants of the 317H35M4N or 31735M4N stainless steel are desirable, which have been specifically formulated to be manufactured containing higher levels of Carbon. Specifically, the amount of Carbon may be ≥0.040 wt % C and <0.10 wt % C, but preferably ≤0.050 wt % C or >0.030 wt % C and ≤0.08 wt % C, but preferably <0.040 wt % C.

(i) These include the Titanium stabilised versions which are referred to as 317H35M4NTi or 31735M4NTi to contrast with the generic 317L35M4N. The Titanium content is controlled according to the following formulae:

Ti 4×C min, 0.70 wt % Ti max or Ti 5×C min, 0.70 wt % Ti max respectively, in order to have Titanium stabilised derivatives of the alloy.

(ii) There are also Niobium stabilised, 317H35M4NNb or 31735M4NNb, versions where the Niobium content is controlled according to the following formulae:

Nb 8×C min, 1.0 wt % Nb max or Nb 10×C min, 1.0 wt % Nb max respectively, in order to have Niobium stabilised derivatives of the alloy.

(iii) In addition, other variants of the alloy may also be manufactured to contain Niobium plus-Tantalum stabilised, 317H35M4NNbTa or 31735M4NNbTa versions where the Niobium plus Tantalum content is controlled according to the following formulae:

Nb+Ta 8×C min, 1.0 wt % Nb+Ta max, 0.10 wt % Ta max, or Nb+Ta 10×C min, 1.0 wt % Nb+Ta max, 0.10 wt % Ta max.

Titanium stabilised, Niobium stabilised and Niobium plus Tantalum stabilised variants of the alloy may be given a stabilisation heat treatment at a temperature lower than the initial solution heat treatment temperature. Titanium and/or Niobium and/or Niobium plus Tantalum may be added individually or in conjunction with Copper, Tungsten and Vanadium in all the various combinations of these elements to optimise the alloy for certain applications where higher Carbon contents are desirable. These alloying elements may be utilised individually or in all the various combinations of the elements to tailor the stainless steel for specific applications and to further improve the overall corrosion performance of the alloy.

The wrought and cast versions of the 317L35M4N Stainless steel along with the other variants are generally supplied in the same manner as the earlier embodiments.

Further, there is proposed a further variation appropriately referred to as 312L35M4N in this description, which is a fifth embodiment of the invention.

[312L35M4N]

The 312L35M4N high strength austenitic stainless steel has a high level of Nitrogen and a specified Pitting Resistance Equivalent of $PRE_N \geq 37$, but preferably $PRE_N \geq 42$. The Pitting Resistance Equivalent as designated by $PRE_N$ is calculated according to the formulae:

$$PRE_N = \%\ Cr + (3.3 \times \%\ Mo) + (16 \times \%\ N).$$

The 312L35M4N Stainless steel has been formulated to possess a unique combination of high mechanical strength properties with excellent ductility and toughness, along with good weldability and good resistance to general and localised corrosion. The chemical composition of the 312L35M4N stainless steel is selective and characterised by an alloy of chemical analysis in percentage by weight as follows, 0.030 wt % C max, 2.00 wt % Mn max, 0.030 wt % P max, 0.010 wt % S max, 0.75 wt % Si max, 20.00 wt % Cr—22.00 wt % Cr, 15.00 wt % Ni—19.00 wt % Ni, 3.00 wt % Mo—5.00 wt % Mo, 0.40 wt % N—0.70 wt % N.

The 312L35M4N stainless steel also contains principally Fe as the remainder and may also contain very small amounts of other elements such as 0.010 wt % B max, 0.10 wt % Ce max, 0.050 wt % Al max, 0.01 wt % Ca max and/or 0.01 wt % Mg max and other impurities which are normally present in residual levels.

The chemical composition of the 312L35M4N stainless steel is optimised at the melting stage to primarily ensure an austenitic microstructure in the base material after solution heat treatment typically performed in the range 1100 deg C.-1250 deg C. followed by water quenching. The microstructure of the base material in the solution heat treated condition, along with as-welded weld metal and heat affected zone of weldments, is controlled by optimising the balance between austenite forming elements and ferrite forming elements to primarily ensure that the alloy is austenitic. As a result, the 312L35M4N stainless steel exhibits a unique combination of high strength and ductility at ambient temperatures, while at the same time guarantees excellent toughness at ambient temperatures and cryogenic temperatures. In view of the fact that the chemical composition of the 312L35M4N stainless steel is adjusted to achieve a $PRE_N \geq 37$, but preferably $PRE_N \geq 42$, this ensures that the material also has a good resistance to general corrosion and localised corrosion (Pitting Corrosion and Crevice Corrosion) in a wide range of process environments. The 312L35M4N stainless steel also has improved resistance to stress corrosion cracking in Chloride containing environments when compared to conventional Austenitic Stainless Steels such as UNS S31703 and UNS S31753.

It has been determined that the optimum chemical composition range of the 312L35M4N stainless steel is carefully selected to comprise the following chemical elements in percentage by weight as follows based on the fifth embodiment, Carbon (C)

The Carbon content of the 312L35M4N stainless steel is ≤0.030 wt % C maximum. Preferably, the amount of Carbon should be ≥0.020 wt % C and ≤0.030 wt % C and more preferably ≤0.025 wt % C.

Manganese (Mn)

The 312L35M4N stainless steel of the fifth embodiment may come in two variations: low Manganese or high Manganese.

For the low Manganese alloys, the Manganese content of the 312L35M4N stainless steel is ≤2.0 wt % Mn. Preferably, the range is ≥1.0 wt % Mn and ≤2.0 wt % Mn and more preferably ≥1.20 wt % Mn and ≤1.50 wt % Mn. With such compositions, this achieves an optimum Mn to N ratio of ≤5.0, and preferably ≥1.42 and ≤5.0. More preferably, the ratio is ≥1.42 and ≤3.75.

For the high Manganese alloys, the Manganese content of the 312L35M4N is ≤4.0 wt % Mn. Preferably, the Manganese content is ≥2.0 wt % Mn and ≤4.0 wt % Mn and more preferably, the upper limit is ≤3.0 wt % Mn. Even more preferably, the upper limit is ≤2.50 wt % Mn. With such selective ranges this achieves a Mn to N ratio of ≤10.0, and preferably ≥2.85 and ≤10.0. More preferably, the Mn to N ratio for high Manganese alloys is ≥2.85 and ≤7.50 and even more preferably ≥2.85 and ≤6.25.

Phosphorus (P)

The Phosphorus content of the 312L35M4N stainless steel is controlled to be ≤0.030 wt % P. Preferably, the 317L57M4N alloy has ≤0.025 wt % P and more preferably ≤0.020 wt % P. Even more preferably, the alloy has ≤0.015 wt % P and even further more preferably ≤0.010 wt % P.

Sulphur (S)

The Sulphur content of the 312L35M4N stainless steel of the fifth embodiment includes ≤0.010 wt % S. Preferably, the 312L35M4N has ≤0.005 wt % S and more preferably ≤0.003 wt % S, and even more preferably ≤0.001 wt % S.

Oxygen (O)

The Oxygen content of the 312L35M4N stainless steel is controlled to be as low as possible and in the fifth embodiment, the 312L35M4N has ≤0.070 wt % O. Preferably, the 312L35M4N has ≤0.050 wt % O and more preferably ≤0.030 wt % O. Even more preferably, the alloy has ≤0.010 wt % O and even further more preferably ≤0.005 wt % O.

Silicon (Si)

The Silicon content of the 312L35M4N stainless steel is ≤0.75 wt % Si. Preferably, the alloy has ≥0.25 wt % Si and ≤0.75 wt % Si. More preferably, the range is ≥0.40 wt % Si and ≤0.60 wt % Si. However, for specific higher temperature applications where improved oxidation resistance is required, the Silicon content may be ≥0.75 wt % Si and ≤2.00 wt % Si.

Chromium (Cr)

The Chromium content of the 312L35M4N stainless steel is ≥20.00 wt % Cr and ≤22.00 wt % Cr. Preferably, the alloy has ≥21.00 wt % Cr.

Nickel (Ni)

The Nickel content of the 312L35M4N stainless steel is ≥15.00 wt % Ni and ≤19.00 wt % Ni. Preferably, the upper limit of Ni of the alloy is ≤18.00 wt % Ni and more preferably ≤17.00 wt % Ni.

Molybdenum (Mo)

The Molybdenum content of the 312L35M4N stainless steel alloy is ≥3.00 wt % Mo and ≤5.00 wt % Mo, but preferably ≥4.00 wt % Mo. In other words, the Molybdenum of this embodiment has a maximum of 5.00 wt % Mo.

Nitrogen (N)

The Nitrogen content of the 312L35M4N stainless steel is ≤0.70 wt % N, but preferably ≥0.40 wt % N and ≤0.70 wt % N. More preferably, the 312L35M4N has ≤0.40 wt % N and ≤0.60 wt % N, and even more preferably ≥0.45 wt % N and ≤0.55 wt % N.

$PRE_N$

The PITTING RESISTANCE EQUIVALENT is calculated using the formulae:

$$PRE_N = \%\ Cr + (3.3 \times \%\ Mo) + (16 \times \%\ N).$$

The 312L35M4N stainless steel has been specifically formulated to have the following composition:

(i) Chromium content ≥20.00 wt % Cr and ≤22.00 wt % Cr, but preferably ≥21.00 wt % Cr;

(ii) Molybdenum content ≥3.00 wt % Mo and ≤5.00 wt % Mo, but preferably ≥4.00 wt % Mo;

(iii) Nitrogen content ≤0.70 wt % N, but preferably ≥0.40 wt % N and ≤0.70 wt % N and more preferably ≥0.40 wt % N and ≤0.60 wt % N and even more preferably ≥0.45 wt % N and ≤0.55 wt % N.

With a high level of Nitrogen, the 312L35M4N stainless steel achieves a $PRE_N$ of ≥37, and preferably $PRE_N$≥42. This ensures that the alloy has a good resistance to general corrosion and localised corrosion (Pitting Corrosion and Crevice Corrosion) in a wide range of process environments. The 312L35M4N stainless steel also has improved resistance to stress corrosion cracking in Chloride containing environments when compared to conventional austenitic stainless steels such as UNS S31703 and UNS S31753. It should be emphasised that these equations ignore the effects of microstructural factors on the breakdown of passivity by pitting or crevice corrosion The chemical composition of the 312L35M4N stainless steel is optimised at the melting stage to ensure that the ratio of the [Cr] equivalent divided by the [Ni] equivalent, according to Schoefer[6], is in the range >0.40 and <1.05, but preferably >0.45 and <0.95, in order to primarily obtain an austenitic microstructure in the base material after solution heat treatment typically performed in the range 1100 deg C.-1250 deg C. followed by water quenching. The microstructure of the base material in the solution heat treated condition, along with as-welded weld metal and heat affected zone of weldments, is controlled by optimising the balance between austenite forming elements and Ferrite forming elements to primarily ensure that the alloy is austenitic. The alloy can therefore be manufactured and supplied in the Non-Magnetic condition.

The 312L35M4N stainless steel also has principally Fe as the remainder and may also contain very small amounts of other elements such as Boron, Cerium, Aluminium, Calcium and/or Magnesium in percentage by weight, and the compositions of these elements are the same as those of 304LM4N. In other words, the passages relating to these elements for 304LM4N are also applicable here.

The 312L35M4N stainless steel according to the fifth embodiment possesses minimum yield strength of 55 ksi or 380 MPa for the wrought version. More preferably minimum yield strength of 62 ksi or 430 MPa may be achieved for the wrought version. The cast version possesses minimum yield strength of 41 ksi or 280 MPa. More preferably, minimum yield strength of 48 ksi or 330 MPa may be achieved for the cast version. Based on the preferred values, a comparison of the wrought mechanical strength properties of the novel and innovative 312L35M4N stainless steel, with those of UNS S31703, suggests that the minimum yield strength of the 312L35M4N stainless steel might be 2.1 times higher than that specified for UNS S31703. Similarly, a comparison of the wrought mechanical strength properties of the 312L35M4N stainless steel, with those of UNS S31753, suggests that the minimum yield strength of the 312L35M4N stainless steel might be 1.79 times higher than that specified for UNS S31753. Likewise, a comparison of the wrought mechanical strength properties of the 312L35M4N stainless steel, with those of UNS S31254, suggests that the minimum yield strength of the 312L35M4N stainless steel might be 1.38 times higher than that specified for UNS S31254.

The 312L35M4N stainless steel according to the fifth embodiment possesses a minimum tensile strength of 102 ksi or 700 MPa for the wrought version. More preferably, a minimum tensile strength of 109 ksi or 750 MPa may be achieved for the wrought version. The cast version possesses a minimum tensile strength of 95 ksi or 650 MPa. More preferably a minimum tensile strength of 102 ksi or 700 MPa may be achieved for the cast version. Based on the preferred values, a comparison of the wrought mechanical strength properties of the 312L35M4N stainless steel, with those of UNS S31703, suggests that the minimum tensile strength of the 312L35M4N stainless steel might be more than 1.45 times higher than that specified for UNS S31703. Similarly, a comparison of the wrought mechanical strength properties of the 312L35M4N stainless steel, with those of UNS S31753, suggests that the minimum tensile strength of the 312L35M4N stainless steel might be 1.36 times higher than that specified for UNS S31753. Likewise, a comparison of the wrought mechanical strength properties of the 312L35M4N stainless steel, with those of UNS S31254, suggests that the minimum tensile strength of the 312L35M4N stainless steel might be 1.14 times higher than that specified for UNS S31254. Indeed, if the wrought mechanical strength properties of the 312L35M4N stainless steel, are compared with those of the 22 Cr Duplex Stainless Steel, then it may be demonstrated that the minimum tensile strength of the 312L35M4N stainless steel is in the region of 1.2 times higher than that specified for S31803 and similar to that specified for 25 Cr Super Duplex Stainless Steel. Therefore, the minimum mechanical strength properties of the 312L35M4N stainless steel have been significantly improved compared to conventional austenitic stainless steels such as UNS S31703, UNS S31753 and UNS S31254 and the tensile strength properties are better than that specified for 22 Cr Duplex Stainless Steel and similar to those specified for 25 Cr Super Duplex Stainless Steel.

This means that applications using the wrought 312L35M4N stainless steel may be frequently designed with reduced wall thicknesses, thus, leading to significant weight savings when specifying 312L35M4N stainless steel compared to conventional austenitic stainless steels such as UNS S31703, S31753 and S31254 because the minimum allowable design stresses are significantly higher. In fact, the minimum allowable design stresses for the wrought 312L35M4N stainless steel are higher than for 22 Cr Duplex Stainless Steels and similar to 25 Cr Super Duplex Stainless Steels.

For certain applications, other variants of the 312L35M4N stainless steel have been purposely formulated to be manufactured containing specific levels of other alloying elements such as Copper, Tungsten and Vanadium. It has been determined that the optimum chemical composition range of the other variants of the 312L35M4N stainless steel is selective and the compositions of Copper and Vanadium are the same as those of 304LM4N. In other words, passages relating to these elements for 304LM4N are also applicable for 312L35M4N.

Tungsten (W)

The Tungsten content of the 312L35M4N stainless steel is ≤2.00 wt % W, but preferably ≥0.50 wt % W and ≤1.00 wt % W, and more preferably ≥0.75 wt % W. For 312L35M4N stainless steel variants containing Tungsten, the PITTING RESISTANCE EQUIVALENT is calculated using the formulae:

$$PRE_{NW}=\%\ Cr+[3.3\times\%\ (Mo+W)]+(16\times\%\ N).$$

This Tungsten containing variant of the 312L35M4N stainless steel has been specifically formulated to have the following composition:

(i) Chromium content ≥20.00 wt % Cr and ≤22.00 wt % Cr, but preferably ≥21.00 wt % Cr;

(ii) Molybdenum content ≥3.00 wt % Mo and ≤5.00 wt % Mo, but preferably ≥4.00 wt % Mo;

(iii) Nitrogen content ≤0.70 wt % N, but preferably ≥0.40 wt % N and ≤0.70 wt % N and more preferably ≥0.40 wt % N and ≤0.60 wt % N and even more preferably ≥0.45 wt % N and ≤0.55 wt % N; and (iv) Tungsten content ≤2.00 wt % W, but preferably ≥0.50 wt % W and ≤1.00 wt % W and more preferably ≥0.75 wt % W.

The Tungsten containing variant of the 312L35M4N stainless steel has a high specified level of Nitrogen and a $PRE_{NW}$≥39, but preferably $PRE_{NW}$≥44. It should be emphasised that these equations ignore the effects of microstructural factors on the breakdown of passivity by pitting or crevice corrosion. Tungsten may be added individually or in conjunction with Copper, Vanadium, Titanium and/or Niobium and/or Niobium plus Tantalum in all the various combinations of these elements, to further improve the overall corrosion performance of the alloy. Tungsten is extremely costly and therefore is being purposely limited to optimise the economics of the alloy, while at the same time optimising the ductility, toughness and corrosion performance of the alloy.

Carbon

For certain applications, other variants of the 312L35M4N stainless steel are desirable, which have been specifically formulated to be manufactured comprising higher levels of Carbon. Specifically, the Carbon content of the 312L35M4N stainless steel may be ≥0.040 wt % C and <0.10 wt % C, but preferably ≤0.050 wt % C or >0.030 wt % C and ≤0.08 wt % C, but preferably <0.040 wt % C. These specific variants of the 312L35M4N stainless steel are the 312H35M4N or 31235M4N versions respectively.

Titanium (Ti)/Niobium (Nb)/Niobium (Nb) Plus Tantalum (Ta)

Furthermore, for certain applications, other stabilised variants of the 312H35M4N or 31235M4N stainless steel are desirable, which have been specifically formulated to be manufactured comprising higher levels of Carbon. Specifically, the Carbon may be ≥0.040 wt % C and <0.10 wt % C, but preferably ≤0.050 wt % C or >0.030 wt % C and ≤0.08 wt % C, but preferably <0.040 wt % C.

(i) These include the Titanium stabilised versions which are referred to as 312H35M4NTi or 31235M4NTi to contrast with the generic 312L35M4N steel versions. The Titanium content is controlled according to the following formulae:

Ti 4×C min, 0.70 wt % Ti max or Ti 5×C min, 0.70 wt % Ti max respectively, in order to have Titanium stabilised derivatives of the alloy.

(ii) There are also the Niobium stabilised, 312H35M4NNb or 31235M4NNb versions where the Niobium content is controlled according to the following formulae:

Nb 8×C min, 1.0 wt % Nb max or Nb 10×C min, 1.0 wt % Nb max respectively, in order to have Niobium stabilised derivatives of the Alloy.

(iii) In addition, other variants of the Alloy may also be manufactured to contain Niobium plus Tantalum stabilised, 312H35M4NNbTa or 31235M4NNbTa versions where the Niobium plus Tantalum content is controlled according to the following formulae:

Nb+Ta 8×C min, 1.0 wt % Nb+Ta max, 0.10 wt % Ta max, or Nb+Ta 10×C min, 1.0 wt % Nb+Ta max, 0.10 wt % Ta max.

Titanium stabilised, Niobium stabilised and Niobium plus Tantalum stabilised variants of the alloy may be given a stabilisation heat treatment at a temperature lower than the initial solution heat treatment temperature. Titanium and/or Niobium and/or Niobium plus Tantalum may be added individually or in conjunction with Copper, Tungsten and Vanadium in all the various combinations of these elements to optimise the alloy for certain applications where higher Carbon contents are desirable. These alloying elements may be utilised individually or in all the various combinations of the elements to tailor the stainless steel for specific applications and to further improve the overall corrosion performance of the Alloy.

The wrought and cast versions of the 312L35M4N stainless steel along with the other variants are generally supplied in the same manner as the earlier embodiments.

Further, there is proposed a further variation appropriately referred to as 312L57M4N high strength austenitic stainless steel, which is a sixth embodiment of the invention. The 312L57M4N stainless virtually has the same chemical composition as 312L35M4N stainless steel with the exception of the Molybdenum content. Thus, instead of repeating the various chemical compositions, only the difference is described.

[312L57M4N]

As mentioned above, the 312L57M4N has exactly the same wt % Carbon, Manganese, Phosphorus, Sulphur, Oxygen, Silicon, Chromium, Nickel and Nitrogen content as the fifth embodiment, 312L35M4N stainless steel, except the Molybdenum content. In the 312L35M4N, the Molybdenum content is between 3.00 wt % and 5.00 wt %. In contrast, the 312L57M4N stainless steel's Molybdenum content is between 5.00 wt % and 7.00 wt %. In other words, the 312L57M4N may be regarded as a higher Molybdenum version of the 312L35M4N stainless steel.

It should be appreciated that the passages relating to 312L35M4N are also applicable here, except the Molybdenum content.

Molybdenum (Mo)

The Molybdenum content of the 312L57M4N stainless steel may be ≥5.00 wt % Mo and ≤7.00 wt % Mo, but preferably ≥6.00 wt % Mo. In other words, the Molybdenum content of the 312L57M4N has a maximum of 7.00 wt % Mo.

$PRE_N$

The PITTING RESISTANCE EQUIVALENT for the 312L57M4N is calculated using the same formulae as 312L35M4N but because of the Molybdenum content, the $PRE_N$ is ≥43, but preferably $PRE_N$≥48. This ensures that the material also has a good resistance to general corrosion and localised corrosion (Pitting Corrosion and Crevice Corrosion) in a wide range of process environments. The 312L57M4N stainless steel also has improved resistance to stress corrosion cracking in Chloride containing environments when compared to conventional Austenitic Stainless Steels such as UNS S31703 and UNS S31753. It should be emphasised that these equations ignore the effects of microstructural factors on the breakdown of passivity by pitting or crevice corrosion The chemical composition of the 312L57M4N stainless steel is optimised at the melting stage to ensure that the ratio of the [Cr] equivalent divided by the [Ni] equivalent, according to Schoefer[6], is in the range >0.40 and <1.05, but preferably >0.45 and <0.95, in order to primarily obtain an austenitic microstructure in the base material after solution heat treatment typically performed in the range 1100 deg C.-1250 deg C. followed by water quenching. The microstructure of the base material in the solution heat treated condition, along with as-welded weld metal and heat affected zone of weldments, is controlled by optimising the balance between austenite forming elements and ferrite forming elements to primarily ensure that the alloy is austenitic. The alloy can therefore be manufactured and supplied in the Non-Magnetic condition.

Like the 312L35M4N embodiment, the 312L57M4N stainless steel also contains principally Fe as the remainder and may also contain very small amounts of other elements such as Boron, Cerium, Aluminium, Calcium and/or Magnesium in percentage by weight, and the compositions of these elements are the same as those of 312L35M4N and thus, those of 304LM4N.

The 312L57M4N stainless steel of the sixth embodiment has minimum yield strength and a minimum tensile strength comparable or similar to those of the 312L35M4N stainless steel. Likewise, the strength properties of the wrought and cast versions of the 312L57M4N are also comparable to those of the 312L35M4N. Thus, the specific strength values are not repeated here and reference is made to the earlier passages of 312L35M4N. A comparison of the wrought mechanical strength properties between 312L57M4N and those of conventional austenitic stainless steel UNS S31703, and between 312L57M4N and those of UNS S31753/UNS S31254, suggests stronger yield and tensile strengths of the magnitude similar to those found for 312L35M4N. Similarly, a comparison of the tensile properties of 312L57M4N demonstrates that they are better than that specified for 22Cr Duplex Stainless Steel and similar to those specified for 25 Cr Super Duplex Stainless Steel, just like the 312L35M4N.

This means that applications using the wrought 312L57M4N stainless steel may be frequently designed with reduced wall thicknesses, thus, leading to significant weight savings when specifying 312L57M4N stainless steel compared to conventional austenitic stainless steels such as UNS S31703, S31753 and S31254 because the minimum allowable design stresses are significantly higher. In fact, the minimum allowable design stresses for the wrought 312L57M4N stainless steel are higher than for 22 Cr Duplex Stainless Steels and similar to 25 Cr Super Duplex Stainless Steels.

For certain applications, other variants of the 312L57M4N stainless steel have been purposely formulated to be manufactured containing specific levels of other alloying elements such as Copper, Tungsten and Vanadium. It has been determined that the optimum chemical composition range of the other variants of the 312L57M4N stainless steel is selective and the compositions of Copper and Vanadium are the same as those of 312L35M4N and those of 304LM4N. In other words, the passages relating to these elements for 304LM4N are also applicable here for 312L57M4N.

Tungsten (W)

The Tungsten content of the 312L57M4N stainless steel is similar to those of the 312L35M4N and the PITTING RESISTANCE EQUIVALENT, $PRE_{NW}$, of 312L57M4N calculated using the same formulae as mentioned above for 312L35M4N is $PRE_{NW}$≥45, and preferably $PRE_{NW}$≥50, due to the different Molybdenum content. It should be apparent that the passage relating to the use and effects of Tungsten for 312L35M4N is also applicable for 312L57M4N.

Further, the 312L57M4N may have higher levels of Carbon referred to as 312H57M4N or 31257M4N which correspond respectively to 312H35M4N and 31235M4N discussed earlier and the Carbon wt % ranges discussed earlier are also applicable for 312H57M4N and 31257M4N.

Titanium (Ti)/Niobium (Nb)/Niobium (Nb) Plus Tantalum (Ta)

Furthermore, for certain applications, other stabilised variants of the 312H57M4N or 31257M4N stainless steel are desirable, which have been specifically formulated to be manufactured comprising higher levels of Carbon. Specifically, the Carbon may be ≥0.040 wt % C and <0.10 wt % C, but preferably ≤0.050 wt % C or >0.030 wt % C and ≤0.08 wt % C, but preferably <0.040 wt % C.

(i) These include the Titanium stabilised versions which are referred to as 312H57M4NTi or 31257M4NTi to contrast with the generic 312L57M4N stainless steel versions. The Titanium content is controlled according to the following formulae:

Ti 4×C min, 0.70 wt % Ti max or Ti 5×C min, 0.70 wt % Ti max respectively, in order to have Titanium stabilised derivatives of the alloy.

(ii) There are also the Niobium stabilised, 312H57M4NNb or 31257M4NNb versions where the Niobium content is controlled according to the following formulae:

Nb 8×C min, 1.0 wt % Nb max or Nb 10×C min, 1.0 wt % Nb max respectively, in order to have Niobium stabilised derivatives of the alloy.

(iii) In addition, other variants of the alloy may also be manufactured to contain Niobium plus Tantalum stabilised, 312H57M4NNbTa or 31257M4NNbTa versions where the Niobium plus Tantalum content is controlled according to the following formulae:

Nb+Ta 8×C min, 1.0 wt % Nb+Ta max, 0.10 wt % Ta max, or Nb+Ta 10×C min, 1.0 wt % Nb+Ta max, 0.10 wt % Ta max.

Titanium stabilised, Niobium stabilised and Niobium plus Tantalum stabilised variants of the alloy may be given a stabilisation heat treatment at a temperature lower than the initial solution heat treatment temperature. Titanium and/or Niobium and/or Niobium plus Tantalum may be added individually or in conjunction with Copper, Tungsten and Vanadium in all the various combinations of these elements to optimise the alloy for certain applications where higher Carbon contents are desirable. These alloying elements may be utilised individually or in all the various combinations of the elements to tailor the stainless steel for specific applications and to further improve the overall corrosion performance of the alloy.

The wrought and cast versions of the 312L57M4N stainless steel along with the other variants are generally supplied in the same manner as the earlier embodiments.

Further, there is proposed a further variation appropriately referred to as 320L35M4N in this description, which is a seventh embodiment of the invention.

[320L35M4N]

The 320L35M4N high strength austenitic stainless steel has a high level of Nitrogen and a specified Pitting Resistance Equivalent of $PRE_N \geq 39$, but preferably $PRE_N \geq 44$. The Pitting Resistance Equivalent as designated by $PRE_N$ is calculated according to the formulae:

$$PRE_N = \%\ Cr + (3.3 \times \%\ Mo) + (16 \times \%\ N).$$

The 320L35M4N stainless steel has been formulated to possess a unique combination of high mechanical strength properties with excellent ductility and toughness, along with good weldability and good resistance to general and localised corrosion. The chemical composition of the 320L35M4N stainless steel is selective and characterised by an alloy of chemical analysis in percentage by weight as follows, 0.030 wt % C max, 2.00 wt % Mn max, 0.030 wt % P max, 0.010 wt % S max, 0.75 wt % Si max, 22.00 wt % Cr—24.00 wt % Cr, 17.00 wt % Ni—21.00 wt % Ni, 3.00 wt % Mo—5.00 wt % Mo, 0.40 wt % N—0.70 wt % N.

The 320L35M4N stainless steel also contains principally Fe as the remainder and may also contain very small amounts of other elements such as 0.010 wt % B max, 0.10 wt % Ce max, 0.050 wt % Al max, 0.01 wt % Ca max and/or 0.01 wt % Mg max and other impurities which are normally present in residual levels.

The chemical composition of the 320L35M4N stainless steel is optimised at the melting stage to primarily ensure an austenitic microstructure in the base material after solution heat treatment typically performed in the range 1100 deg C.-1250 deg C. followed by water quenching. The microstructure of the base material in the solution heat treated condition, along with as-welded weld metal and heat affected zone of weldments, is controlled by optimising the balance between austenite forming elements and ferrite forming elements to primarily ensure that the alloy is austenitic. As a result, the 320L35M4N stainless steel exhibits a unique combination of high strength and ductility at ambient temperatures, while at the same time guarantees excellent toughness at ambient temperatures and cryogenic temperatures. In view of the fact that the chemical composition of the 320L35M4N stainless steel is adjusted to achieve a $PRE_N \geq 39$, but preferably $PRE_N \geq 44$, this ensures that the material also has a good resistance to general corrosion and localised corrosion (Pitting Corrosion and Crevice Corrosion) in a wide range of process environments. The 320L35M4N stainless steel also has improved resistance to stress corrosion cracking in Chloride containing environments when compared to conventional Austenitic Stainless Steels such as UNS S31703 and UNS S31753.

It has been determined that the optimum chemical composition range of the 320L35M4N stainless steel is carefully selected to comprise the following chemical elements in percentage by weight as follows, based on the seventh embodiment, Carbon (C)

The Carbon content of the 320L35M4N stainless steel is <0.030 wt % C maximum. Preferably, the amount of Carbon should be ≥0.020 wt % C and ≤0.030 wt % C and more preferably ≤0.025 wt % C.

Manganese (Mn)

The 320L35M4N stainless steel of the seventh embodiment may come in two variations: low Manganese or high Manganese.

For the low Manganese alloys, the Manganese content of the 320L35M4N stainless steel is ≤2.0 wt % Mn. Preferably, the range is ≥1.0 wt % Mn and ≤2.0 wt % Mn and more preferably ≥1.20 wt % Mn and ≤1.50 wt % Mn. With such compositions, this achieves an optimum Mn to N ratio of ≤5.0, and preferably ≥1.42 and ≤5.0. More preferably, the ratio is ≥1.42 and ≤3.75.

For the high Manganese alloys, the Manganese content of the 320L35M4N is ≤4.0 wt % Mn. Preferably, the Manganese content is ≥2.0 wt % Mn and ≤4.0 wt % Mn and more preferably, the upper limit is ≤3.0 wt % Mn. Even more preferably, the upper limit is ≤2.50 wt % Mn. With such selective ranges, this achieves a Mn to N ratio of ≤10.0, and preferably ≥2.85 and ≤10.0. More preferably, the Mn to N ratio for high Manganese alloys is ≥2.85 and ≤7.50 and even more preferably ≥2.85 and ≤6.25.

Phosphorus (P)

The Phosphorus content of the 320L35M4N stainless steel is controlled to be ≤0.030 wt % P. Preferably, the 320L35M4N alloy has ≤0.025 wt % P and more preferably ≤0.020 wt % P. Even more preferably, the alloy has ≤0.015 wt % P and even further more preferably ≤0.010 wt % P.

Sulphur (S)

The Sulphur content of the 320L35M4N stainless steel of the seventh embodiment includes ≤0.010 wt % S. Preferably, the 320L35M4N has ≤0.005 wt % S and more preferably ≤0.003 wt % S, and even more preferably ≤0.001 wt % S.

Oxygen (O)

The Oxygen content of the 320L35M4N stainless steel is controlled to be as low as possible and in the seventh embodiment, the 320L35M4N has ≤0.070 wt % O. Preferably, the 320L35M4N has ≤0.050 wt % O and more preferably ≤0.030 wt % O. Even more preferably, the alloy has ≤0.010 wt % O and even further more preferably ≤0.005 wt % O.

Silicon (Si)

The Silicon content of the 320L35M4N stainless steel is ≤0.75 wt % Si. Preferably, the alloy has ≥0.25 wt % Si and ≤0.75 wt % Si. More preferably, the range is ≥0.40 wt % Si and ≤0.60 wt % Si. However, for specific higher temperature applications where improved oxidation resistance is required, the Silicon content may be ≥0.75 wt % Si and ≤2.00 wt % Si.

Chromium (Cr)

The Chromium content of the 320L35M4N stainless steel is ≥22.00 wt % Cr and ≤24.00 wt % Cr. Preferably, the alloy has ≥23.00 wt % Cr.

Nickel (Ni)

The Nickel content of the 320L35M4N stainless steel is ≥17.00 wt % Ni and ≤21.00 wt % Ni. Preferably, the upper limit of Ni of the alloy is ≤20.00 wt % Ni and more preferably ≤19.00 wt % Ni.

Molybdenum (Mo)

The Molybdenum content of the 320L35M4N stainless steel alloy is ≥3.00 wt % Mo and ≤5.00 wt % Mo, but preferably ≥4.00 wt % Mo.

Nitrogen (N)

The Nitrogen content of the 320L35M4N stainless steel is ≤0.70 wt % N, but preferably ≥0.40 wt % N and ≤0.70 wt % N. More preferably, the 320L35M4N has ≥0.40 wt % N and ≤0.60 wt % N, and even more preferably ≥0.45 wt % N and ≤0.55 wt % N.

$PRE_N$

The PITTING RESISTANCE EQUIVALENT is calculated using the formulae:

$$PRE_N = \%\ Cr + (3.3 \times \%\ Mo) + (16 \times \%\ N).$$

The 320L35M4N stainless steel has been specifically formulated to have the following composition:

(i) Chromium content ≥22.00 wt % Cr and ≤24.00 wt % Cr, but preferably ≥23.00 wt % Cr;

(ii) Molybdenum content ≥3.00 wt % Mo and ≤5.00 wt % Mo, but preferably ≥4.00 wt % Mo, (iii) Nitrogen content ≤0.70 wt % N, but preferably ≥0.40 wt % N and ≤0.70 wt % N and more preferably ≥0.40 wt % N and ≤0.60 wt % N and even more preferably ≥0.45 wt % N and ≤0.55 wt % N.

With a high level of Nitrogen, the 320L35M4N stainless steel achieves a $PRE_N$ of ≥39, and preferably $PRE_N$≥44. This ensures that the alloy has a good resistance to general corrosion and localised corrosion (Pitting Corrosion and Crevice Corrosion) in a wide range of process environments. The 320L35M4N stainless steel also has improved resistance to stress corrosion cracking in Chloride containing environments when compared to conventional Austenitic Stainless Steels such as UNS S31703 and UNS S31753. It should be emphasised that these equations ignore the effects of microstructural factors on the breakdown of passivity by pitting or crevice corrosion The chemical composition of the 320L35M4N stainless steel is optimised at the melting stage to ensure that the ratio of the [Cr] equivalent divided by the [Ni] equivalent, according to Schoefer[6], is in the range >0.40 and <1.05, but preferably >0.45 and <0.95, in order to primarily obtain an austenitic microstructure in the base material after solution heat treatment typically performed in the range 1100 deg C.-1250 deg C. followed by water quenching. The microstructure of the base material in the solution heat treated condition, along with as-welded weld metal and heat affected zone of weldments, is controlled by optimising the balance between austenite forming elements and ferrite forming elements to primarily ensure that the alloy is austenitic. The alloy can therefore be manufactured and supplied in the Non-Magnetic condition.

The 320L35M4N stainless steel also has principally Fe as the remainder and may also contain very small amounts of other elements such as Boron, Cerium, Aluminium, Calcium and/or Magnesium in percentage by weight, and the compositions of these elements are the same as those of 304LM4N. In other words, the passages relating to these elements for 304LM4N are also applicable here.

The 320L35M4N stainless steel according to the seventh embodiment possesses minimum yield strength of 55 ksi or 380 MPa for the wrought version. More preferably, minimum yield strength of 62 ksi or 430 MPa may be achieved for the wrought version. The cast version possesses minimum yield strength of 41 ksi or 280 MPa. More preferably, minimum yield strength of 48 ksi or 330 MPa may be achieved for the cast version. Based on the preferred values, a comparison of the wrought mechanical strength properties of the 320L35M4N stainless steel, with those of UNS S31703, suggests that the minimum yield strength of the 320L35M4N stainless steel might be 2.1 times higher than that specified for UNS S31703. Similarly, a comparison of the wrought mechanical strength properties of the 320L35M4N stainless steel, with those of UNS S31753, suggests that the minimum yield strength of the 320L35M4N stainless steel might be 1.79 times higher than that specified for UNS S31753. Likewise, a comparison of the wrought mechanical strength properties of the 320L35M4N stainless steel, with those of UNS S32053, suggests that the minimum yield strength of the 320L35M4N Stainless steel might be 1.45 times higher than that specified for UNS S32053.

The 320L35M4N Stainless steel according to the seventh embodiment possesses a minimum tensile strength of 102 ksi or 700 MPa for the wrought version. More preferably, a minimum tensile strength of 109 ksi or 750 MPa may be achieved for the wrought version. The cast version possesses a minimum tensile strength of 95 ksi or 650 MPa. More preferably, a minimum tensile strength of 102 ksi or 700 MPa may be achieved for the cast version. Based on the preferred values, a comparison of the wrought mechanical strength properties of the 320L35M4N stainless steel, with those of UNS S31703, suggests that the minimum tensile strength of the 320L35M4N stainless steel might be more than 1.45 times higher than that specified for UNS S31703. Similarly, a comparison of the wrought mechanical strength properties of the 320L35M4N stainless steel, with those of UNS S31753, suggests that the minimum tensile strength of the 320L35M4N stainless steel might be 1.36 times higher than that specified for UNS S31753. Likewise, a comparison of the wrought mechanical strength properties of the 320L35M4N stainless steel, with those of UNS S32053, suggests that the minimum tensile strength of the 320L35M4N stainless steel might be 1.17 times higher than that specified for UNS $32053. Indeed, if the wrought mechanical strength properties of the 320L35M4N stainless steel, are compared with those of the 22 Cr Duplex Stainless Steel, then it may be demonstrated that the minimum tensile strength of the 320L35M4N stainless steel is in the region of 1.2 times higher than that specified for S31803 and similar to that specified for 25 Cr Super Duplex Stainless Steel.

Therefore, the minimum mechanical strength properties of the novel and innovative 320L35M4N stainless steel have been significantly improved compared to conventional austenitic stainless steels such as UNS S31703, UNS S31753 and UNS S32053 and the tensile strength properties are better than that specified for 22 Cr Duplex Stainless Steel and similar to those specified for 25 Cr Super Duplex Stainless Steel.

This means that applications using the wrought 320L35M4N stainless steel may be frequently designed with reduced wall thicknesses, thus, leading to significant weight savings when specifying 320L35M4N stainless steel compared to conventional austenitic stainless steels such as UNS S31703, S31753 and S32053 because the minimum allowable design stresses are significantly higher. In fact, the minimum allowable design stresses for the wrought 320L35M4N stainless steel are higher than for 22 Cr Duplex Stainless Steels and similar to 25 Cr Super Duplex Stainless Steels.

For certain applications, other variants of the 320L35M4N stainless steel have been purposely formulated to be manufactured containing specific levels of other alloying elements such as Copper, Tungsten and Vanadium. It has been determined that the optimum chemical composition range of the other variants of the 320L35M4N stainless steel is selective and the compositions of Copper and Vanadium are the same as those of 304LM4N. In other words, passages relating to these elements for 304LM4N are also applicable for 320L35M4N.

Tungsten (W)

The Tungsten content of the 320L35M4N stainless steel is ≤2.00 wt % W, but preferably ≥0.50 wt % W and ≤1.00 wt % W, and more preferably ≥0.75 wt % W. For 320L35M4N stainless steel variants containing Tungsten, the PITTING RESISTANCE EQUIVALENT is calculated using the formulae:

$$PRE_{NW}=\%\ Cr+[3.3\times\%\ (Mo+W)]+(16\times\%\ N).$$

This Tungsten containing variant of the 320L35M4N stainless steel has been specifically formulated to have the following composition:

(i) Chromium content ≥22.00 wt % Cr and ≤24.00 wt % Cr, but preferably ≥23.00 wt % Cr;

(ii) Molybdenum content ≥3.00 wt % Mo and ≤5.00 wt % Mo, but preferably ≥4.00 wt % Mo;

(iii) Nitrogen content ≤0.70 wt % N, but preferably ≥0.40 wt % N and ≤0.70 wt % N and more preferably ≥0.40 wt % N and ≤0.60 wt % N and even more preferably ≥0.45 wt % N and ≤0.55 wt % N; and (iv) Tungsten content ≤2.00 wt % W, but preferably ≥0.50 wt % W and ≤1.00 wt % W and more preferably ≥0.75 wt % W.

The Tungsten containing variant of the 320L35M4N stainless steel has a high specified level of Nitrogen and a $PRE_{NW}$≥41, but preferably $PRE_{NW}$≥46. It should be emphasised that these equations ignore the effects of microstructural factors on the breakdown of passivity by pitting or crevice corrosion. Tungsten may be added individually or in conjunction with Copper, Vanadium, Titanium and/or Niobium and/or Niobium plus Tantalum in all the various combinations of these elements, to further improve the overall corrosion performance of the alloy. Tungsten is extremely costly and therefore is being purposely limited to optimise the economics of the alloy, while at the same time optimising the ductility, toughness and corrosion performance of the alloy.

Carbon (C)

For certain applications, other variants of the 320L35M4N stainless steel are desirable, which have been specifically formulated to be manufactured comprising higher levels of Carbon. Specifically, the Carbon content of the 320L35M4N stainless steel may be ≥0.040 wt % C and <0.10 wt % C, but preferably ≤0.050 wt % C or >0.030 wt % C and ≤0.08 wt % C, but preferably <0.040 wt % C. These specific variants of the 320L35M4N stainless steel are the 320H35M4N or 32035M4N versions respectively.

Titanium (Ti)/Niobium (Nb)/Niobium (Nb) Plus Tantalum (Ta)

Furthermore, for certain applications, other stabilised variants of the 320H35M4N or 32035M4N stainless steel are desirable, which have been specifically formulated to be manufactured comprising higher levels of Carbon. Specifically, the amount of Carbon may be ≥0.040 wt % C and <0.10 wt % C, but preferably ≤0.050 wt % C or >0.030 wt % C and ≤0.08 wt % C, but preferably <0.040 wt % C.

(i) These include the Titanium stabilised versions which are referred to as 320H35M4NTi or 32035M4NTi to contrast with the generic 320L35M4N versions. The Titanium content is controlled according to the following formulae:

Ti 4×C min, 0.70 wt % Ti max or Ti 5×C min, 0.70 wt % Ti max respectively, in order to have Titanium stabilised derivatives of the alloy.

(ii) There are also the Niobium stabilised, 320H35M4NNb or 32035M4NNb versions where the Niobium content is controlled according to the following formulae:

Nb 8×C min, 1.0 wt % Nb max or Nb 10×C min, 1.0 wt % Nb max respectively, in order to have Niobium stabilised derivatives of the alloy.

(iii) In addition, other variants of the alloy may also be manufactured to contain Niobium plus Tantalum stabilised, 320H35M4NNbTa or 32035M4NNbTa versions where the Niobium plus Tantalum content is controlled according to the following formulae:

Nb+Ta 8×C min, 1.0 wt % Nb+Ta max, 0.10 wt % Ta max, or Nb+Ta 10×C min, 1.0 wt % Nb+Ta max, 0.10 wt % Ta max.

Titanium stabilised, Niobium stabilised and Niobium plus Tantalum stabilised variants of the alloy may be given a stabilisation heat treatment at a temperature lower than the initial solution heat treatment temperature. Titanium and/or Niobium and/or Niobium plus Tantalum may be added individually or in conjunction with Copper, Tungsten and Vanadium in all the various combinations of these elements to optimise the alloy for certain applications where higher Carbon contents are desirable. These alloying elements may be utilised individually or in all the various combinations of the elements to tailor the stainless steel for specific applications and to further improve the overall corrosion performance of the alloy.

The wrought and cast versions of the 320L35M4N stainless steel along with the other variants are generally supplied in the same manner as the earlier embodiments.

Further, there is proposed a further variation appropriately referred to as 320L57M4N high strength austenitic stainless steel, which is an eighth embodiment of the invention. The 320L57M4N stainless steel virtually has the same chemical composition as 320L35M4N with the exception of the Molybdenum content. Thus, instead of repeating the various chemical compositions, only the difference is described.

[320L57M4N]

As mentioned above, the 320L57M4N has exactly the same wt % Carbon, Manganese, Phosphorus, Sulphur, Oxygen, Silicon, Chromium, Nickel and Nitrogen content as the seventh embodiment, 320L35M4N stainless steel, except the Molybdenum content. In the 320L35M4N, the Molybdenum content is between 3.00 wt % and 5.00 wt % Mo. In contrast, the 320L57M4N stainless steel's Molybdenum content is between 5.00 wt % and 7.00 wt % Mo. In other words, the 320L57M4N may be regarded as a higher Molybdenum version of the 320L35M4N stainless steel.

It should be appreciated that the passages relating to 320L35M4N are also applicable here, except the Molybdenum content.

Molybdenum (Mo)

The Molybdenum content of the 320L57M4N stainless steel may be ≥5.00 wt % Mo and ≤7.00 wt % Mo, but preferably ≥6.00 wt % Mo. In other words, the Molybdenum content of the 320L57M4N has a maximum of 7.00 wt % Mo.

$PRE_N$

The PITTING RESISTANCE EQUIVALENT for the 320L57M4N is calculated using the same formulae as 320L35M4N but because of the Molybdenum content, the $PRE_N$ is ≥45, but preferably $PRE_N$≥50. This ensures that the material also has a good resistance to general corrosion and localised corrosion (Pitting Corrosion and Crevice Corrosion) in a wide range of process environments. The 320L57M4N stainless steel also has improved resistance to stress corrosion cracking in Chloride containing environments when compared to conventional Austenitic Stainless Steels such as UNS S31703 and UNS S31753. It should be emphasised that these equations ignore the effects of microstructural factors on the breakdown of passivity by pitting or crevice corrosion The chemical composition of the 320L57M4N stainless steel is optimised at the melting stage to ensure that the ratio of the [Cr] equivalent divided by the [Ni] equivalent, according to Schoefer[6], is in the range >0.40 and <1.05, but preferably >0.45 and <0.95, in order to primarily obtain an austenitic microstructure in the base material after solution heat treatment typically performed in the range 1100 deg C.-1250 deg C. followed by water quenching. The microstructure of the base material in the solution heat treated condition, along with as-welded weld metal and heat affected zone of weldments, is controlled by optimising the balance between austenite forming elements and Ferrite forming elements to primarily ensure that the alloy is austenitic. The alloy can therefore be manufactured and supplied in the Non-Magnetic condition.

Like the 320L35M4N embodiment, the 320L57M4N stainless steel also contains principally Fe as the remainder and may also contain very small amounts of other elements such as Boron, Cerium, Aluminium, Calcium and/or Magnesium in percentage by weight and the compositions of these elements are the same as those of 320L35M4N and thus, those of 304LM4N.

The 320L57M4N stainless steel of the eighth embodiment has minimum yield strength and a minimum tensile strength comparable or similar to those of the 320L35M4N stainless steel. Likewise, the strength properties of the wrought and cast versions of the 320L57M4N are also comparable to those of the 320L35M4N. Thus, the specific strength values are not repeated here and reference is made to the earlier passages of 320L35M4N. A comparison of the wrought mechanical strength properties between 320L57M4N and those of conventional austenitic stainless steel UNS S31703, and between 320L57M4N and those of UNS S31753/UNS S32053, suggests stronger yield and tensile strengths of the magnitude similar to those found for 320L35M4N. Similarly, a comparison of the tensile properties of 320L57M4N demonstrates they are better than that specified for 22 Cr Duplex Stainless Steel and similar to those specified for 25 Cr Super Duplex Stainless Steel, just like the 320L35M4N.

This means that applications using the wrought 320L57M4N stainless steel may be frequently designed with reduced wall thicknesses, thus, leading to significant weight savings when specifying 320L57M4N stainless steel compared to conventional austenitic stainless steels such as UNS S31703, S31753 and S32053 because the minimum allowable design stresses are significantly higher. In fact, the minimum allowable design stresses for the wrought 320L57M4N stainless steel are higher than for 22 Cr Duplex Stainless Steels and similar to 25 Cr Super Duplex Stainless Steels.

For certain applications, other variants of the 320L57M4N stainless steel have been purposely formulated to be manufactured containing specific levels of other alloying elements such as Copper, Tungsten and Vanadium. It has been determined that the optimum chemical composition range of the other variants of the 320L57M4N stainless steel is selective and the compositions of Copper and Vanadium are the same as those of 320L35M4N and those of 304LM4N. In other words, the passages relating to these elements for 304LM4N are also applicable here for 320L57M4N Tungsten (W)

The Tungsten content of the 320L57M4N stainless steel is similar to those of the 320L35M4N and the PITTING RESISTANCE EQUIVALENT, $PRE_{NW}$, of 320L57M4N calculated using the same formulae as mentioned above for 320L35M4N is $PRE_{NW}$≥47, and preferably $PRE_{NW}$≥52, due to the different Molybdenum content. It should be apparent that the passage relating to the use and effects of Tungsten for 320L35M4N is also applicable for 320L57M4N.

Further, the 320L57M4N may have higher levels of Carbon referred to as 320H57M4N or 32057M4N which correspond respectively to 320H35M4N and 32035M4N discussed earlier and the Carbon wt % ranges discussed earlier are also applicable for 320H57M4N and 32057M4N.

Titanium (Ti)/Niobium (Nb)/Niobium (Nb) Plus Tantalum (Ta)

Furthermore, for certain applications, other stabilised variants of the 320H57M4N or 32057M4N stainless steel are desirable, which have been specifically formulated to be manufactured comprising higher levels of Carbon. Specifically, the Carbon may be ≥0.040 wt % C and <0.10 wt % C, but preferably ≤0.050 wt % C or >0.030 wt % C and ≤0.08 wt % C, but preferably <0.040 wt % C.

(i) These include the Titanium stabilised versions which are referred to as 320H57M4NTi or 32057M4NTi to contrast with the generic 320L57M4N. The Titanium content is controlled according to the following formulae:

Ti 4×C min, 0.70 wt % Ti max or Ti 5×C min, 0.70 wt % Ti max respectively, in order to have Titanium stabilised derivatives of the alloy.

(ii) There are also the Niobium stabilised, 320H57M4NNb or 32057M4NNb versions where the Niobium content is controlled according to the following formulae:

Nb 8×C min, 1.0 wt % Nb max or Nb 10×C min, 1.0 wt % Nb max respectively, in order to have Niobium stabilised derivatives of the alloy.

(iii) In addition, other variants of the alloy may also be manufactured to contain Niobium plus Tantalum stabilised, 320H57M4NNbTa or 32057M4NNbTa versions where the Niobium plus Tantalum content is controlled according to the following formulae:

Nb+Ta 8×C min, 1.0 wt % Nb+Ta max, 0.10 wt % Ta max, or Nb+Ta 10×C min, 1.0 wt % Nb+Ta max, 0.10 wt % Ta max.

Titanium stabilised, Niobium stabilised and Niobium plus Tantalum stabilised variants of the alloy may be given a stabilisation heat treatment at a temperature lower than the initial solution heat treatment temperature. Titanium and/or Niobium and/or Niobium plus Tantalum may be added individually or in conjunction with Copper, Tungsten and Vanadium in all the various combinations of these elements to optimise the alloy for certain applications where higher Carbon contents are desirable. These alloying elements may be utilised individually or in all the various combinations of the elements to tailor the stainless steel for specific applications and to further improve the overall corrosion performance of the Alloy.

The wrought and cast versions of the 320L57M4N stainless steel along with the other variants are generally supplied in the same manner as the earlier embodiments.

Further, there is proposed a further variation appropriately referred to as 326L35M4N in this description, which is a ninth embodiment of the invention.

[326L35M4N]

The 326L35M4N high strength austenitic stainless steel has a high level of Nitrogen and a specified Pitting Resistance Equivalent of $PRE_N \geq 42$, but preferably $PRE_N \geq 47$. The Pitting Resistance Equivalent as designated by $PRE_N$ is calculated according to the formulae:

$$PRE_N = \%\ Cr + (3.3 \times \%\ Mo) + (16 \times \%\ N).$$

The 326L35M4N stainless steel has been formulated to possess a unique combination of high mechanical strength properties with excellent ductility and toughness, along with good weldability and good resistance to general and localised corrosion. The chemical composition of the 326L35M4N stainless steel is selective and characterised by an alloy of chemical analysis in percentage by weight as follows, 0.030 wt % C max, 2.00 wt % Mn max, 0.030 wt % P max, 0.010 wt % S max, 0.75 wt % Si max, 24.00 wt % Cr—26.00 wt % Cr, 19.00 wt % Ni—23.00 wt % Ni, 3.00 wt % Mo—5.00 wt % Mo, 0.40 wt % N—0.70 wt % N.

The 326L35M4N stainless steel also contains principally Fe as the remainder and may also contain very small amounts of other elements such as 0.010 wt % B max, 0.10 wt % Ce max, 0.050 wt % Al max, 0.01 wt % Ca max and/or 0.01 wt % Mg max and other impurities which are normally present in residual levels.

The chemical composition of the 326L35M4N stainless steel is optimised at the melting stage to primarily ensure an Austenitic microstructure in the base material after solution heat treatment typically performed in the range 1100 deg C.-1250 deg C. followed by water quenching. The microstructure of the base material in the solution heat treated condition, along with as-welded weld metal and heat affected zone of weldments, is controlled by optimising the balance between austenite forming elements and Ferrite forming elements to primarily ensure that the alloy is austenitic. As a result, the 326L35M4N stainless steel exhibits a unique combination of high strength and ductility at ambient temperatures, while at the same time guarantees excellent toughness at ambient temperatures and cryogenic temperatures. In view of the fact that the chemical composition of the 326L35M4N stainless steel is adjusted to achieve a $PRE_N \geq 42$, but preferably $PRE_N \geq 47$, this ensures that the material also has a good resistance to general corrosion and localised corrosion (Pitting Corrosion and Crevice Corrosion) in a wide range of process environments. The 326L35M4N stainless steel also has improved resistance to stress corrosion cracking in Chloride containing environments when compared to conventional Austenitic Stainless Steels such as UNS S31703 and UNS S31753.

It has been determined that the optimum chemical composition range of the 326L35M4N stainless steel is carefully selected to comprise the following chemical elements in percentage by weight as follows, based on the ninth embodiment, Carbon (C)

The Carbon content of the 326L35M4N stainless steel is ≤0.030 wt % C maximum. Preferably, the amount of Carbon should be ≥0.020 wt % C and ≤0.030 wt % C and more preferably ≤0.025 wt % C.

Manganese (Mn)

The 326L35M4N stainless steel of the ninth embodiment may come in two variations: low Manganese or high Manganese.

For the low Manganese alloys, the Manganese content of the 326L35M4N Stainless steel is 2.0 wt % Mn. Preferably, the range is ≥1.0 wt % Mn and ≤2.0 wt % Mn and more preferably ≥1.20 wt % Mn and ≤1.50 wt % Mn. With such compositions, this achieves an optimum Mn to N ratio of ≤5.0, and preferably ≥1.42 and ≤5.0. More preferably, the ratio is ≥1.42 and ≤3.75.

For high Manganese alloys, the Manganese content of the 326L35M4N is ≤4.0 wt % Mn. Preferably, the Manganese content is ≥2.0 wt % Mn and ≤4.0 wt % Mn and more preferably, the upper limit is ≤3.0 wt % Mn. Even more preferably, the upper limit is ≤2.50 wt % Mn. With such selective ranges, this achieves a Mn to N ratio of ≤10.0, and preferably ≥2.85 and ≤10.0. More preferably, the Mn to N ratio for high Manganese alloys is ≥2.85 and ≤7.50 and even more preferably ≥2.85 and ≤6.25 for the higher Manganese range Alloys.

Phosphorus (P)

The Phosphorus content of the 326L35M4N stainless steel is controlled to be ≤0.030 wt % P. Preferably, the 326L35M4N alloy has <0.025 wt % P and more preferably ≤0.020 wt % P. Even more preferably, the alloy has ≤0.015 wt % P and even further more preferably ≤0.010 wt % P.

Sulphur (S)

The Sulphur content of the 326L35M4N stainless steel of the ninth embodiment includes ≤0.010 wt % S. Preferably, the 326L35M4N has ≤0.005 wt % S and more preferably ≤0.003 wt % S, and even more preferably ≤0.001 wt % S.

Oxygen (O)

The Oxygen content of the 326L35M4N stainless steel is controlled to be as low as possible and in the ninth embodiment, the 326L35M4N has ≤0.070 wt % O. Preferably, the 326L35M4N has ≤0.050 wt % O and more preferably ≤0.030 wt % O. Even more preferably, the alloy has ≤0.010 wt % O and even further more preferably ≤0.005 wt % O.

Silicon (Si)

The Silicon content of the 326L35M4N stainless steel is ≤0.75 wt % Si. Preferably, the alloy has ≥0.25 wt % Si and ≤0.75 wt % Si. More preferably, the range is ≥0.40 wt % Si and ≤0.60 wt % Si. However, for specific higher temperature applications where improved oxidation resistance is required, the Silicon content may be ≥0.75 wt % Si and ≤2.00 wt % Si.

Chromium (Cr)

The Chromium content of the 326L35M4N Stainless steel is ≥24.00 wt % Cr and ≤26.00 wt % Cr. Preferably, the alloy has ≥25.00 wt % Cr.

Nickel (Ni)

The Nickel content of the 326L35M4N stainless steel is ≥19.00 wt % Ni and ≤23.00 wt % Ni. Preferably, the upper limit of Ni of the alloy is ≤22.00 wt % Ni and more preferably ≤21.00 wt % Ni.

Molybdenum (Mo)

The Molybdenum content of the 326L35M4N stainless steel alloy is ≥3.00 wt % Mo and ≤5.00 wt % Mo, but preferably ≥4.00 wt % Mo.

Nitrogen (N)

The Nitrogen content of the 326L35M4N Stainless steel is ≤0.70 wt % N, but preferably ≥0.40 wt % N and ≤0.70 wt % N. More preferably, the 326L35M4N has ≥0.40 wt % N and ≤0.60 wt % N and even more preferably ≥0.45 wt % N and ≤0.55 wt % N.

$PRE_N$

The PITTING RESISTANCE EQUIVALENT is calculated using the formulae:

$$PRE_N = \%\ Cr + (3.3 \times \%\ Mo) + (16 \times \%\ N).$$

The 326L35M4N stainless steel has been specifically formulated to have the following composition:

i) Chromium content ≥24.00 wt % Cr and ≤26.00 wt % Cr, but preferably ≥25.00 wt % Cr;

ii) Molybdenum content ≥3.00 wt % Mo and ≤5.00 wt % Mo, but preferably ≥4.00 wt % Mo;

iii) Nitrogen content ≤0.70 wt % N, but preferably ≥0.40 wt % N and ≤0.70 wt % N and more preferably ≥0.40 wt % N and ≤0.60 wt % N and even more preferably ≥0.45 wt % N and ≤0.55 wt % N.

With a high level of Nitrogen, the 326L35M4N stainless steel achieves a $PRE_N \geq 42$, but preferably $PRE_N \geq 47$. This ensures that the alloy has a good resistance to general corrosion and localised corrosion (Pitting Corrosion and Crevice Corrosion) in a wide range of process environments. The 326L35M4N stainless steel also has improved resistance to stress corrosion cracking in Chloride containing environments when compared to conventional austenitic stainless steels such as UNS S31703 and UNS S31753. It should be emphasised that these equations ignore the effects of microstructural factors on the breakdown of passivity by pitting or crevice corrosion The chemical composition of the 326L35M4N stainless steel is optimised at the melting stage to ensure that the ratio of the [Cr] equivalent divided by the [Ni] equivalent, according to Schoefer[6], is in the range >0.40 and <1.05, but preferably >0.45 and <0.95, in order to primarily obtain an austenitic microstructure in the base material after solution heat treatment typically performed in the range 1100 deg C.-1250 deg C. followed by water quenching. The microstructure of the base material in the solution heat treated condition, along with as-welded weld metal and heat affected zone of weldments, is controlled by optimising the balance between austenite forming elements and ferrite forming elements to primarily ensure that the alloy is austenitic. The alloy can therefore be manufactured and supplied in the Non-Magnetic condition.

The 326L35M4N stainless steel also has principally Fe as the remainder and may also contain very small amounts of other elements such as Boron, Cerium, Aluminium, Calcium and/or Magnesium in percentage by weight, and the compositions of these elements are the same as those of 304LM4N. In other words, the passages relating to these elements for 304LM4N are also applicable here.

The 326L35M4N stainless steel according to the ninth embodiment possesses minimum yield strength of 55 ksi or 380 MPa for the wrought version. More preferably, minimum yield strength of 62 ksi or 430 MPa may be achieved for the wrought version. The cast version possesses minimum yield strength of 41 ksi or 280 MPa. More preferably, minimum yield strength of 48 ksi or 330 MPa may be achieved for the cast version. Based on the preferred values, a comparison of the wrought mechanical strength properties of the 326L35M4N stainless steel, with those of UNS S31703, suggests that the minimum yield strength of the 326L35M4N Stainless steel might be 2.1 times higher than that specified for UNS S31703. Similarly, a comparison of the wrought mechanical strength properties of the 326L35M4N stainless steel, with those of UNS S31753, suggests that the minimum yield strength of the 326L35M4N stainless steel might be 1.79 times higher than that specified for UNS S31753. Likewise, a comparison of the wrought mechanical strength properties of the 326L35M4N stainless steel, with those of UNS S32615, suggests that the minimum yield strength of the 326L35M4N stainless steel might be 1.95 times higher than that specified for UNS S32615.

The 326L35M4N stainless steel according to the ninth embodiment possesses a minimum tensile strength of 102 ksi or 700 MPa for the wrought version. More preferably a minimum tensile strength of 109 ksi or 750 MPa may be achieved for the wrought version. The cast version possesses a minimum tensile strength of 95 ksi or 650 MPa. More preferably a minimum tensile strength of 102 ksi or 700 MPa may be achieved for the cast version. Based on the preferred values, a comparison of the wrought mechanical strength properties of the 326L35M4N stainless steel, with those of UNS S31703, suggests that the minimum tensile strength of the 326L35M4N stainless steel might be more than 1.45 times higher than that specified for UNS S31703. Similarly, a comparison of the wrought mechanical strength properties of the 326L35M4N Stainless steel, with those of UNS S31753, suggests that the minimum tensile strength of the 326L35M4N stainless steel might be 1.36 times higher than that specified for UNS S31753. Likewise, a comparison of the wrought mechanical strength properties of the 326L35M4N stainless steel, with those of UNS S32615, suggests that the minimum tensile strength of the 326L35M4N Stainless steel might be 1.36 times higher than that specified for UNS S32615. Indeed, if the wrought mechanical strength properties of the 326L35M4N stainless steel, are compared with those of the 22 Cr Duplex Stainless Steel, then it may be demonstrated that the minimum tensile strength of the 326L35M4N stainless steel is in the region of 1.2 times higher than that specified for S31803 and similar to that specified for 25 Cr Super Duplex Stainless Steel. Therefore, the minimum mechanical strength properties of the 326L35M4N stainless steel have been significantly improved compared to conventional austenitic stainless steels such as UNS S31703, UNS S31753 and UNS S32615 and the tensile strength properties are better than that specified for 22 Cr Duplex Stainless Steel and similar to those specified for 25 Cr Super Duplex Stainless Steel.

This means that applications using the wrought 326L35M4N stainless steel may be frequently designed with reduced wall thicknesses, thus, leading to significant weight savings when specifying 326L35M4N stainless steel compared to conventional austenitic stainless steels such as UNS S31703, S31753 and 532615 because the minimum allowable design stresses are significantly higher. In fact, the minimum allowable design stresses for the wrought 326L35M4N stainless steel are higher than for 22 Cr Duplex Stainless Steels and similar to 25 Cr Super Duplex Stainless Steels.

For certain applications, other variants of the 326L35M4N stainless steel have been purposely formulated to be manufactured containing specific levels of other alloying elements such as Copper, Tungsten and Vanadium. It has been determined that the optimum chemical composition range of the other variants of the 326L35M4N stainless steel is selective and the compositions of Copper and Vanadium are the same as those of 304LM4N. In other words, passages relating to these elements for 304LM4N are also applicable for 320L35M4N.

Tungsten (W)

The Tungsten content of the 326L35M4N stainless steel is ≤2.00 wt % W, but preferably ≥0.50 wt % W and ≤1.00 wt % W, and more preferably ≥0.75 wt % W. For 326L35M4N stainless steel variants containing Tungsten, the PITTING RESISTANCE EQUIVALENT is calculated using the formulae:

$$PRE_{NW}=\%\ Cr+[3.3\times\%\ (Mo+W)]+(16\times\%\ N).$$

This Tungsten containing variant of the 326L35M4N stainless steel has been specifically formulated to have the following composition:

(i) Chromium content ≥24.00 wt % Cr and ≤26.00 wt % Cr, but preferably ≥25.00 wt % Cr;

(ii) Molybdenum content ≥3.00 wt % Mo and ≤5.00 wt % Mo, but preferably ≥4.00 wt % Mo;

(iii) Nitrogen content ≤0.70 wt % N, but preferably ≥0.40 wt % N and ≤0.70 wt % N and more preferably ≥0.40 wt % N and ≤0.60 wt % N and even more preferably ≥0.45 wt % N and ≤0.55 wt % N; and (iv) Tungsten content ≤2.00 wt % W, but preferably ≥0.50 wt % W and ≤1.00 wt % Wand more preferably ≥0.75 wt % W.

The Tungsten containing variant of the 326L35M4N stainless steel has a high specified level of Nitrogen and a $PRE_{NW}$≥44, but preferably $PRE_{NW}$≥49. It should be emphasised that these equations ignore the effects of microstructural factors on the breakdown of passivity by pitting or crevice corrosion. Tungsten may be added individually or in conjunction with Copper, Vanadium, Titanium and/or Niobium and/or Niobium plus Tantalum in all the various combinations of these elements, to further improve the overall corrosion performance of the alloy. Tungsten is extremely costly and therefore is being purposely limited to optimise the economics of the alloy, while at the same time optimising the ductility, toughness and corrosion performance of the alloy.

Carbon (C)

For certain applications, other variants of the 326L35M4N stainless steel are desirable, which have been specifically formulated to be manufactured comprising higher levels of Carbon. Specifically, the Carbon content of the 320L35M4N stainless steel may be ≥0.040 wt % C and <0.10 wt % C, but preferably ≤0.050 wt % C or >0.030 wt % C and ≤0.08 wt % C, but preferably <0.040 wt % C. These specific variants of the 326L35M4N stainless steel are the 326H35M4N or 32635M4N versions respectively.

Titanium (Ti)/Niobium (Nb)/Niobium (Nb) Plus Tantalum (Ta)

Furthermore, for certain applications, other stabilised variants of the 326H35M4N or 32635M4N stainless steel are desirable, which have been specifically formulated to be manufactured comprising higher levels of Carbon. Specifically, the Carbon may be ≥0.040 wt % C and <0.10 wt % C, but preferably ≤0.050 wt % C or >0.030 wt % C and ≤0.08 wt % C, but preferably <0.040 wt % C.

(i) These include the Titanium stabilised versions which are referred to as 326H35M4NTi or 32635M4NTi to contrast with the generic 326L35M4N versions. The Titanium content is controlled according to the following formulae:

Ti 4×C min, 0.70 wt % Ti max or Ti 5×C min, 0.70 wt % Ti max respectively, in order to have Titanium stabilised derivatives of the alloy.

(ii) There are also the Niobium stabilised, 326H35M4NNb or 32635M4NNb versions where the Niobium content is controlled according to the following formulae:

Nb 8×C min, 1.0 wt % Nb max or Nb 10×C min, 1.0 wt % Nb max respectively, in order to have Niobium stabilised derivatives of the alloy.

(iii) In addition, other variants of the Alloy may also be manufactured to contain Niobium plus Tantalum stabilised, 326H35M4NNbTa or 32635M4NNbTa versions where the Niobium plus Tantalum content is controlled according to the following formulae:

Nb+Ta 8×C min, 1.0 wt % Nb+Ta max, 0.10 wt % Ta max, or Nb+Ta 10×C min, 1.0 wt % Nb+Ta max, 0.10 wt % Ta max.

Titanium stabilised, Niobium stabilised and Niobium plus Tantalum stabilised variants of the alloy may be given a stabilisation heat treatment at a temperature lower than the initial solution heat treatment temperature. Titanium and/or Niobium and/or Niobium plus Tantalum may be added individually or in conjunction with Copper, Tungsten and Vanadium in all the various combinations of these elements to optimise the Alloy for certain applications where higher Carbon contents are desirable. These alloying elements may be utilised individually or in all the various combinations of the elements to tailor the stainless steel for specific applications and to further improve the overall corrosion performance of the alloy.

The wrought and cast versions of the 326L35M4N Stainless steel along with the other variants are generally supplied in the same manner as the earlier embodiments.

Further, there is proposed a further variation appropriately referred to as 326L57M4N high strength austenitic stainless steel, which is a tenth embodiment of the invention. The 326L57M4N stainless steel virtually has the same chemical composition as 326L35M4N stainless steel with the exception of the Molybdenum content. Thus, instead of repeating the various chemical compositions, only the difference is described.

[326L57M4N]

As mentioned above, the 326L57M4N has exactly the same wt % Carbon, Manganese, Phosphorus, Sulphur, Oxygen, Silicon, Chromium, Nickel and Nitrogen content as the ninth embodiment, 326L35M4N stainless steel, except the Molybdenum content. In the 326L35M4N, the Molybdenum content is between 3.00 wt % and 5.00 wt % Mo. In contrast, the 326L57M4N stainless steel's Molybdenum content is between 5.00 wt % and 7.00 wt % Mo. In other words, the 326L57M4N may be regarded as a higher Molybdenum version of the 326L35M4N stainless steel.

It should be appreciated that the passages relating to 326L35M4N are also applicable here, except the Molybdenum content.

Molybdenum (Mo)

The Molybdenum content of the 326L57M4N stainless steel may be ≥5.00 wt % Mo and ≤7.00 wt % Mo, but preferably ≥6.00 wt % Mo and ≤7.00 wt % Mo, and more preferably ≥6.50 wt % Mo. In other words, the Molybdenum content of the 326L57M4N has a maximum of 7.00 wt % Mo.

$PRE_N$

The PITTING RESISTANCE EQUIVALENT for the 326L57M4N is calculated using the same formulae as 326L35M4N but because of the Molybdenum content, the $PRE_N$ is ≥48.5, but preferably $PRE_N$≥53.5. This ensures that the material also has a good resistance to general corrosion and localised corrosion (Pitting Corrosion and Crevice Corrosion) in a wide range of process environments. The 326L57M4N stainless steel also has improved resistance to stress corrosion cracking in Chloride containing environments when compared to conventional Austenitic Stainless Steels such as UNS S31703 and UNS S31753. It should be emphasised that these equations ignore the effects of microstructural factors on the breakdown of passivity by pitting or crevice corrosion The chemical composition of the 326L57M4N stainless steel is optimised at the melting stage to ensure that the ratio of the [Cr] equivalent divided by the [Ni] equivalent, according to Schoefer[6], is in the range >0.40 and <1.05, but preferably >0.45 and <0.95, in order to primarily obtain an austenitic microstructure in the base material after solution heat treatment typically performed in the range 1100 deg C.-1250 deg C. followed by water quenching. The microstructure of the base material in the solution heat treated condition, along with as-welded weld metal and heat affected zone of weldments, is controlled by optimising the balance between austenite forming elements and ferrite forming elements to primarily ensure that the alloy is austenitic. The alloy can therefore be manufactured and supplied in the Non-Magnetic condition.

Like the 326L35M4N embodiment, the 326L57M4N stainless steel also contains principally Fe as the remainder and may also contain very small amounts of other elements such as Boron, Cerium, Aluminium, Calcium and/or Magnesium in percentage by weight and the compositions of these elements are the same as those of 326L35M4N, and thus, those of 304LM4N.

The 326L57M4N stainless steel of the tenth embodiment has a minimum yield strength and a minimum tensile strength comparable or similar to those of 326L35M4N stainless steel. Likewise, the strength properties of the wrought and cast versions of the 326L57M4N are also comparable to those of the 326L35M4N. Thus, the specific strength values are not repeated here and reference is made to the earlier passages of 326L35M4N. A comparison of the wrought mechanical strength properties between 326L57M4N and those of conventional austenitic stainless steel UNS S31703, and between 326L57M4N and those of UNS S31753/UNS S32615, suggests stronger yield and tensile strengths of the magnitude similar to those found for 326L35M4N. Similarly, a comparison of the tensile strength properties of 326L57M4N demonstrates that they are better than that specified for 22Cr Duplex Stainless Steel and similar to those specified for 25 Cr Super Duplex Stainless Steel, just like the 326L35M4N.

This means that applications using the wrought 326L57M4N stainless steel may be frequently designed with reduced wall thicknesses, thus, leading to significant weight savings when specifying 326L57M4N Stainless steel compared to conventional austenitic stainless steels such as UNS S31703, S31753 and S32615 because the minimum allowable design stresses are significantly higher. In fact, the minimum allowable design stresses for the wrought 326L57M4N stainless steel are higher than for 22 Cr Duplex Stainless Steels and similar to 25 Cr Super Duplex Stainless Steels.

For certain applications, other variants of the 326L57M4N stainless steel, have been purposely formulated to be manufactured containing specific levels of other alloying elements such as Copper, Tungsten and Vanadium. It has been determined that the optimum chemical composition range of the other variants of the 326L57M4N stainless steel is selective and the compositions of Copper and Vanadium are the same as those of 326L35M4N and those of 304LM4N. In other words, the passages relating to these elements for 304LM4N are also applicable here for 326L57M4N Tungsten (W)

The Tungsten content of the 326L57M4N stainless steel is similar to those of the 326L35M4N and the PITTING RESISTANCE EQUIVALENT, $PRE_{NW}$, of 326L57M4N calculated using the same formulae as mentioned above for 326L35M4N is $PRE_{NW}$≥50.5, and preferably $PRE_{NW}$≥55.5, due to the different Molybdenum content. It should be apparent that the passage relating to the use and effects of Tungsten for 326L35M4N is also applicable for 326L57M4N.

Further, the 326L57M4N may have higher levels of Carbon referred to as 326H57M4N or 32657M4N which correspond respectively to 326H35M4N and 32635M4N discussed earlier and the Carbon wt % ranges discussed earlier are also applicable for 326H57M4N and 32657M4N.

Titanium (Ti)/Niobium (Nb)/Niobium (Nb) Plus Tantalum (Ta)

Furthermore, for certain applications, other stabilised variants of the 326H57M4N or 32657M4N stainless steel are desirable, which have been specifically formulated to be manufactured comprising higher levels of Carbon. Specifically, the amount of Carbon may be ≥0.040 wt % C and <0.10 wt % C, but preferably ≤0.050 wt % C or >0.030 wt % C and ≤0.08 wt % C, but preferably <0.040 wt % C.

(i) These include the Titanium stabilised versions which are referred to as 326H57M4NTi or 32657M4NTi to contrast with the generic 326L57M4N. The Titanium content is controlled according to the following formulae:

Ti 4×C min, 0.70 wt % Ti max or Ti 5×C min, 0.70 wt % Ti max respectively, in order to have Titanium stabilised derivatives of the alloy.

(ii) There are also the Niobium stabilised, 326H57M4NNb or 32657M4NNb versions where the Niobium content is controlled according to the following formulae:

Nb 8×C min, 1.0 wt % Nb max or Nb 10×C min, 1.0 wt % Nb max respectively, in order to have Niobium stabilised derivatives of the alloy.

(iii) In addition, other variants of the alloy may also be manufactured to contain Niobium plus Tantalum stabilised, 326H57M4NNbTa or 32657M4NNbTa versions where the Niobium plus Tantalum content is controlled according to the following formulae:

Nb+Ta 8×C min, 1.0 wt % Nb+Ta max, 0.10 wt % Ta max, or Nb+Ta 10×C min, 1.0 wt % Nb+Ta max, 0.10 wt % Ta max.

Titanium stabilised, Niobium stabilised and Niobium plus Tantalum stabilised variants of the Alloy may be given a stabilisation heat treatment at a temperature lower than the initial solution heat treatment temperature. Titanium and/or Niobium and/or Niobium plus Tantalum may be added individually or in conjunction with Copper, Tungsten and Vanadium in all the various combinations of these elements to optimise the alloy for certain applications where higher Carbon contents are desirable. These alloying elements may be utilised individually or in all the various combinations of the elements to tailor the stainless steel for specific applications and to further improve the overall corrosion performance of the alloy.

The wrought and cast versions of the 326L57M4N stainless steel along with the other variants, are generally supplied in the same manner as the earlier embodiments.

Further, there is proposed a further variation appropriately referred to as 351L35M4N in this description, which is an eleventh embodiment of the invention.

[351L35M4N]

The 351L35M4N stainless steel has a high level of Nitrogen and a specified Pitting Resistance Equivalent of $PRE_N \geq 44$, but preferably $PRE_N \geq 49$. The Pitting Resistance Equivalent as designated by $PRE_N$ is calculated according to the formulae:

$$PRE_N = \%\ Cr + (3.3 \times \%\ Mo) + (16 \times \%\ N).$$

The 351L35M4N stainless steel has been formulated to possess a unique combination of high mechanical strength properties with excellent ductility and toughness, along with good weldability and good resistance to general and localised corrosion. The chemical composition of the 351L35M4N stainless steel is selective and characterised by an alloy of chemical analysis in percentage by weight as follows, 0.030 wt % C max, 2.00 wt % Mn max, 0.030 wt % P max, 0.010 wt % S max, 0.75 wt % Si max, 26.00 wt % Cr—28.00 wt % Cr, 21.00 wt % Ni—25.00 wt % Ni, 3.00 wt % Mo—5.00 wt % Mo, 0.40 wt % N—0.70 wt % N.

The 351L35M4N stainless steel also contains principally Fe as the remainder and may also contain very small amounts of other elements such as 0.010 wt % B max, 0.10 wt % Ce max, 0.050 wt % Al max, 0.01 wt % Ca max and/or 0.01 wt % Mg max and other impurities which are normally present in residual levels.

The chemical composition of the 351L35M4N stainless steel is optimised at the melting stage to primarily ensure an Austenitic microstructure in the base material after solution heat treatment typically performed in the range 1100 deg C.-1250 deg C. followed by water quenching. The microstructure of the base material in the solution heat treated condition, along with as-welded weld metal and heat affected zone of weldments, is controlled by optimising the balance between Austenite forming elements and Ferrite forming elements to primarily ensure that the Alloy is Austenitic. As a result, the 351L35M4N stainless steel exhibits a unique combination of high strength and ductility at ambient temperatures, while at the same time guarantees excellent toughness at ambient temperatures and cryogenic temperatures. In view of the fact that the chemical analysis of the 351L35M4N stainless steel is adjusted to achieve a $PRE_N \geq 44$, but preferably $PRE_N \geq 49$, this ensures that the material also has a good resistance to general corrosion and localised corrosion (Pitting Corrosion and Crevice Corrosion) in a wide range of process environments. The 351L35M4N stainless steel also has improved resistance to stress corrosion cracking in Chloride containing environments when compared to conventional Austenitic Stainless Steels such as UNS S31703 and UNS S31753.

It has been determined that the optimum chemical composition range of the 351L35M4N stainless steel is carefully selected to comprise the following chemical elements in percentage by weight as follows, based on the eleventh embodiment, Carbon (C)

The Carbon content of the 351L35M4N stainless steel is ≤0.030 wt % C maximum. Preferably, the amount of Carbon should be ≥0.020 wt % C and ≤0.030 wt % C and more preferably ≤0.025 wt % C.

Manganese (Mn)

The 351L35M4N stainless steel of the eleventh embodiment may come in two variations: low Manganese or high Manganese.

For low Manganese alloys, the Manganese content of the 351L35M4N stainless steel is ≤2.0 wt % Mn. Preferably, the range is ≥1.0 wt % Mn and ≤2.0 wt % Mn and more preferably ≥1.20 wt % Mn and ≤1.50 wt % Mn. With such compositions, this achieves an optimum Mn to N ratio of ≤5.0, and preferably ≥1.42 and ≤5.0. More preferably, the ratio is ≥1.42 and ≤3.75.

For the high Manganese alloys, the Manganese content of the 351L35M4N is ≤4.0 wt % Mn. Preferably, the Manganese content is ≥2.0 wt % Mn and ≤4.0 wt % Mn and more preferably, the upper limit is ≤3.0 wt % Mn. Even more preferably, the upper limit is ≤2.50 wt % Mn. With such selective ranges, this achieves a Mn to N ratio of ≤10.0, and preferably ≥2.85 and ≤10.0. More preferably, the Mn to N ratio for high Manganese alloys is ≥2.85 and ≤7.50 and even more preferably ≥2.85 and ≤6.25.

Phosphorus (P)

The Phosphorus content of the 351L35M4N stainless steel is controlled to be ≤0.030 wt % P. Preferably, the 351L35M4N alloy has ≤0.025 wt % P and more preferably ≤0.020 wt % P. Even more preferably, the alloy has ≤0.015 wt % P and even further more preferably ≤0.010 wt % P.

Sulphur (S)

The Sulphur content of the 351L35M4N stainless steel of the eleventh embodiment includes ≤0.010 wt % S. Preferably, the 351L35M4N has ≤0.005 wt % S and more preferably ≤0.003 wt % S, and even more preferably ≤0.001 wt % S.

Oxygen (O)

The Oxygen content of the 351L35M4N stainless steel is controlled to be as low as possible and in the eleventh embodiment, the 351L35M4N has ≤0.070 wt % O. Preferably, the 351L35M4N has ≤0.050 wt % O and more preferably ≤0.030 wt % O. Even more preferably, the alloy has ≤0.010 wt % O and even further more preferably ≤0.005 wt % O.

Silicon (Si)

The Silicon content of the 351L35M4N stainless steel is ≤0.75 wt % Si. Preferably, the alloy has ≥0.25 wt % Si and ≤0.75 wt % Si. More preferably, the range is ≥0.40 wt % Si and ≤0.60 wt % Si. However, for specific higher temperature applications where improved oxidation resistance is required, the Silicon content may be ≥0.75 wt % Si and ≤2.00 wt % Si.

Chromium (Cr)

The Chromium content of the 351L35M4N stainless steel is ≥26.00 wt % Cr and ≤28.00 wt % Cr. Preferably, the alloy has ≥27.00 wt % Cr.

Nickel (Ni)

The Nickel content of the 351L35M4N stainless steel is ≥21.00 wt % Ni and ≤25.00 wt % Ni. Preferably, the upper limit of Ni of the alloy is ≤24.00 wt % Ni and more preferably ≤23.00 wt % Ni.

Molybdenum (Mo)

The Molybdenum content of the 351L35M4N stainless steel is ≥3.00 wt % Mo and ≤5.00 wt % Mo, but preferably ≥4.00 wt % Mo.

Nitrogen (N)

The Nitrogen content of the 351L35M4N stainless steel is ≤0.70 wt % N, but preferably ≥0.40 wt % N and ≤0.70 wt % N. More preferably, the 351L35M4N has ≥0.40 wt % N and ≤0.60 wt % N and even more preferably ≥0.45 wt % N and ≤0.55 wt % N.

$PRE_N$

The PITTING RESISTANCE EQUIVALENT is calculated using the formulae:

$$PRE_N = \%\ Cr + (3.3 \times \%\ Mo) + (16 \times \%\ N).$$

The 351L35M4N stainless steel has been specifically formulated to have the following composition:

(i) Chromium content ≥26.00 wt % Cr and ≤28.00 wt % Cr, but preferably ≥27.00 wt % Cr;

(ii) Molybdenum content ≥3.00 wt % Mo and ≤5.00 wt % Mo, but preferably ≥4.00 wt % Mo, (iii) Nitrogen content ≤0.70 wt % N, but preferably ≥0.40 wt % N and ≤0.70 wt % N and more preferably ≥0.40 wt % N and ≤0.60 wt % N and even more preferably ≥0.45 wt % N and ≤0.55 wt % N.

With a high level of Nitrogen, the 351L35M4N stainless steel achieves a $PRE_N \geq 44$, but preferably $PRE_N \geq 49$. This ensures that the material also has a good resistance to general corrosion and localised corrosion (Pitting Corrosion and Crevice Corrosion) in a wide range of process environments. The 351L35M4N stainless steel also has improved resistance to stress corrosion cracking in Chloride containing environments when compared to conventional Austenitic Stainless Steels such as UNS S31703 and UNS S31753. It should be emphasised that these equations ignore the effects of microstructural factors on the breakdown of passivity by pitting or crevice corrosion The chemical composition of the 351L35M4N stainless steel is optimised at the melting stage to ensure that the ratio of the [Cr] equivalent divided by the [Ni] equivalent, according to Schoefer[6], is in the range >0.40 and <1.05, but preferably >0.45 and <0.95, in order to primarily obtain an Austenitic microstructure in the base material after solution heat treatment typically performed in the range 1100 deg C.-1250 deg C. followed by water quenching. The microstructure of the base material in the solution heat treated condition, along with as-welded weld metal and heat affected zone of weldments, is controlled by optimising the balance between austenite forming elements and Ferrite forming elements to primarily ensure that the alloy is austenitic. The alloy can therefore be manufactured and supplied in the Non-Magnetic condition.

The 351L35M4N stainless steel also has principally Fe as the remainder and may also contain very small amounts of other elements such as Boron, Cerium, Aluminium, Calcium and/or Magnesium in percentage by weight, and the compositions of these elements are the same as those of 304LM4N. In other words, the passages relating to these elements for 304LM4N are also applicable here.

The 351L35M4N stainless steel according to the eleventh embodiment possesses minimum yield strength of 55 ksi or 380 MPa for the wrought version. More preferably minimum yield strength of 62 ksi or 430 MPa may be achieved for the wrought version. The cast version possesses minimum yield strength of 41 ksi or 280 MPa. More preferably, minimum yield strength of 48 ksi or 330 MPa may be achieved for the cast version. Based on the preferred values, a comparison of the wrought mechanical strength properties of the 351L35M4N stainless steel, with those of UNS S31703, suggests that the minimum yield strength of the 351L35M4N stainless steel might be 2.1 times higher than that specified for UNS S31703. Similarly, a comparison of the wrought mechanical strength properties of the 351L35M4N stainless steel, with those of UNS S31753, suggests that the minimum yield strength of the 351L35M4N stainless steel might be 1.79 times higher than that specified for UNS S31753. Likewise, a comparison of the wrought mechanical strength properties of the 351L35M4N stainless steel, with those of UNS S35115, suggests that the minimum yield strength of the 351L35M4N stainless steel might be 1.56 times higher than that specified for UNS S35115.

The 351L35M4N stainless steel according to the eleventh embodiment possesses a minimum tensile strength of 102 ksi or 700 MPa for the wrought version. More preferably, a minimum tensile strength of 109 ksi or 750 MPa may be achieved for the wrought version. The cast version possesses a minimum tensile strength of 95 ksi or 650 MPa. More preferably, a minimum tensile strength of 102 ksi or 700 MPa may be achieved for the cast version. Based on the preferred values, a comparison of the wrought mechanical strength properties of the 351L35M4N stainless steel, with those of UNS S31703, suggests that the minimum tensile strength of the 351L35M4N stainless steel might be more than 1.45 times higher than that specified for UNS S31703. Similarly, a comparison of the wrought mechanical strength properties of the 351L35M4N stainless steel, with those of UNS S31753, suggests that the minimum tensile strength of the 351L35M4N stainless steel might be 1.36 times higher than that specified for UNS S31753. Likewise, a comparison of the wrought mechanical strength properties of the 351L35M4N Stainless steel, with those of UNS S35115, suggests that the minimum tensile strength of the 351L35M4N stainless steel might be 1.28 times higher than that specified for UNS S35115. Indeed, if the wrought mechanical strength properties of the 351L35M4N stainless steel, are compared with those of the 22 Cr Duplex Stainless Steel, then it may be demonstrated that the minimum tensile strength of the 351L35M4N stainless steel is in the region of 1.2 times higher than that specified for S31803 and similar to that specified for 25 Cr Super Duplex Stainless Steel. Therefore, the minimum mechanical strength properties of the 351L35M4N Stainless steel have been significantly improved compared to conventional austenitic stainless steels such as UNS S31703, UNS S31753 and UNS S35115 and the tensile strength properties are better than that specified for 22 Cr Duplex Stainless Steel and similar to those specified for 25 Cr Super Duplex Stainless Steel.

This means that applications using the wrought 351L35M4N stainless steel may be frequently designed with reduced wall thicknesses, thus, leading to significant weight savings when specifying 351L35M4N stainless steel compared to conventional austenitic stainless steels such as UNS S31703, S31753 and $35115 because the minimum allowable design stresses are significantly higher. In fact, the minimum allowable design stresses for the wrought 351L35M4N stainless steel are higher than for 22 Cr Duplex Stainless Steels and similar to 25 Cr Super Duplex Stainless Steels.

For certain applications, other variants of the 351L35M4N stainless steel have been purposely formulated to be manufactured containing specific levels of other alloying elements such as Copper, Tungsten and Vanadium. It has been determined that the optimum chemical composition range of the other variants of the 351L35M4N stainless steel is selective and the compositions of Copper and Vanadium are the same as those of 304LM4N. In other words, passages relating to these elements for 304LM4N are also applicable for 351L35M4N.

Tungsten (W)

The Tungsten content of the 351L35M4N stainless steel is ≤2.00 wt % W, but preferably ≥0.50 wt % W and ≤1.00 wt % W, and more preferably ≥0.75 wt % W. For 351L35M4N stainless steel variants containing Tungsten, the PITTING RESISTANCE EQUIVALENT is calculated using the formulae:

$$PRE_{NW}=\%\ Cr+[3.3\times\%\ (Mo+W)]+(16\times\%\ N).$$

This Tungsten containing variant of the 351L35M4N stainless steel has been specifically formulated to have the following composition:

(i) Chromium content ≥26.00 wt % Cr and ≤28.00 wt % Cr, but preferably ≥27.00 wt % Cr;

(ii) Molybdenum content ≥3.00 wt % Mo and ≤5.00 wt % Mo, but preferably ≥4.00 wt % Mo, (iii) Nitrogen content ≤0.70 wt % N, but preferably ≥0.40 wt % N and ≤0.70 wt % N and more preferably ≥0.40 wt % N and ≤0.60 wt % N and even more preferably ≥0.45 wt % N and ≤0.55 wt % N; and (iv) Tungsten content ≤2.00 wt % W, but preferably ≥0.50 wt % W and ≤1.00 wt % W and more preferably ≥0.75 wt % W.

The Tungsten containing variant of the 351L35M4N stainless steel has a high specified level of Nitrogen and a $PRE_{NW}$≥46, but preferably $PRE_{NW}$≥51. It should be emphasised that these equations ignore the effects of microstructural factors on the breakdown of passivity by pitting or crevice corrosion. Tungsten may be added individually or in conjunction with Copper, Vanadium, Titanium and/or Niobium and/or Niobium plus Tantalum in all the various combinations of these elements, to further improve the overall corrosion performance of the alloy. Tungsten is extremely costly and therefore is being purposely limited to optimise the economics of the alloy, while at the same time optimising the ductility, toughness and corrosion performance of the alloy.

Carbon (C)

For certain applications, other variants of the 351L35M4N stainless steel are desirable, which have been specifically formulated to be manufactured comprising higher levels of Carbon. Specifically, the Carbon content of the 351L35M4N stainless steel may be ≥0.040 wt % C and <0.10 wt % C, but preferably ≤0.050 wt % C or >0.030 wt % C and ≤0.08 wt % C, but preferably <0.040 wt % C. These specific variants of the 351L35M4N stainless steel are the 351H35M4N or 35135M4N versions respectively.

Titanium (Ti)/Niobium (Nb)/Niobium (Nb) Plus Tantalum (Ta)

Furthermore, for certain applications, other stabilised variants of the 351H35M4N or 35135M4N stainless steel are desirable, which have been specifically formulated to be manufactured comprising higher levels of Carbon. Specifically, the amount of Carbon may be ≥0.040 wt % C and <0.10 wt % C, but preferably ≤0.050 wt % C or >0.030 wt % C and ≤0.08 wt % C, but preferably <0.040 wt % C.

(i) These include the Titanium stabilised versions which are referred to as 351H35M4NTi or 35135M4NTi to contrast with the generic 351L35M4N.

The Titanium content is controlled according to the following formulae:

Ti 4×C min, 0.70 wt % Ti max or Ti 5×C min, 0.70 wt % Ti max respectively, in order to have Titanium stabilised derivatives of the alloy.

(ii) There are also Niobium stabilised, 351H35M4NNb or 35135M4NNb versions where the Niobium content is controlled according to the following formulae:

Nb 8×C min, 1.0 wt % Nb max or Nb 10×C min, 1.0 wt % Nb max respectively, in order to have Niobium stabilised derivatives of the alloy.

(iii) In addition, other variants of the Alloy may also be manufactured to contain Niobium plus Tantalum stabilised, 351H35M4NNbTa or 35135M4NNbTa versions where the Niobium plus Tantalum content is controlled according to the following formulae:

Nb+Ta 8×C min, 1.0 wt % Nb+Ta max, 0.10 wt % Ta max, or Nb+Ta 10×C min, 1.0 wt % Nb+Ta max, 0.10 wt % Ta max.

Titanium stabilised, Niobium stabilised and Niobium plus Tantalum stabilised variants of the alloy may be given a stabilisation heat treatment at a temperature lower than the initial solution heat treatment temperature. Titanium and/or Niobium and/or Niobium plus Tantalum may be added individually or in conjunction with Copper, Tungsten and Vanadium in all the various combinations of these elements to optimise the alloy for certain applications where higher Carbon contents are desirable. These alloying elements may be utilised individually or in all the various combinations of the elements to tailor the stainless steel for specific applications and to further improve the overall corrosion performance of the alloy.

The wrought and cast versions of the 351L35M4N stainless steel along with the other variants are generally supplied in the same manner as the earlier embodiments.

Further, there is proposed a further variation appropriately referred to as 351L57M4N high strength austenitic stainless steel, which is a twelfth embodiment of the invention. The 351L57M4N stainless steel virtually has the same chemical composition as 351L35M4N with the exception of the Molybdenum content. Thus, instead of repeating the various chemical compositions, only the difference is described.

[351L57M4N]

As mentioned above, the 351L57M4N has exactly the same wt % Carbon, Manganese, Phosphorus, Sulphur, Oxygen, Silicon, Chromium, Nickel and Nitrogen content as the eleventh embodiment, 351L35M4N stainless steel, except the Molybdenum content. In the 351L35M4N, the Molybdenum content is between 3.00 wt % and 5.00 wt % Mo. In contrast, the 351L57M4N stainless steel's Molybdenum content is between 5.00 wt % and 7.00 wt % Mo. In other words, the 351L57M4N may be regarded as a higher Molybdenum version of the 351L35M4N stainless steel.

It should be appreciated that the passages relating to 351L35M4N are also applicable here, except the Molybdenum content.

Molybdenum (Mo)

The Molybdenum content of the 351L57M4N stainless steel may be >5.00 wt % Mo and ≤7.00 wt % Mo, but preferably ≥5.50 wt % Mo and ≤6.50 wt % Mo and more preferably ≥6.00 wt % Mo. In other words, the Molybdenum content of the 351L57M4N has a maximum of 7.00 wt % Mo.

$PRE_N$

The PITTING RESISTANCE EQUIVALENT for the 351L57M4N is calculated using the same formulae as 351L35M4N but because of the Molybdenum content, the $PRE_N$ is ≥50.5, but preferably $PRE_N$≥55.5. This ensures that the material also has a good resistance to general corrosion and localised corrosion (Pitting Corrosion and Crevice Corrosion) in a wide range of process environments. The 351L57M4N stainless steel also has improved resistance to stress corrosion cracking in Chloride containing environments when compared to conventional Austenitic Stainless Steels such as UNS S31703 and UNS S31753. It should be emphasised that these equations ignore the effects of microstructural factors on the breakdown of passivity by pitting or crevice corrosion The chemical composition of the 351L57M4N stainless steel is optimised at the melting stage to ensure that the ratio of the [Cr] equivalent divided by the [Ni] equivalent, according to Schoefer[6], is in the range >0.40 and <1.05, but preferably >0.45 and <0.95, in order to primarily obtain an austenitic microstructure in the base material after solution heat treatment typically performed in the range 1100 deg C.-1250 deg C. followed by water quenching. The microstructure of the base material in the solution heat treated condition, along with as-welded weld metal and heat affected zone of weldments, is controlled by optimising the balance between Austenite forming elements and Ferrite forming elements to primarily ensure that the alloy is austenitic. The alloy can therefore be manufactured and supplied in the Non-Magnetic condition.

Like the 351L35M4N embodiment, the 351L57M4N stainless steel also comprise principally Fe as the remainder and may also contain very small amounts of other elements such as Boron, Cerium, Aluminium, Calcium and/or Magnesium in percentage by weight and the compositions of these elements are the same as those of 351L35M4N, and thus, those of 304LM4N.

The 351L57M4N stainless steel of the twelfth embodiment has a minimum yield strength and a minimum tensile strength comparable or similar to those of 351L35M4N stainless steel. Likewise, the strength properties of the wrought and cast versions of the 351L57M4N are also comparable to those of the 351L35M4N. Thus, the specific strength values are not repeated here and reference is made to the earlier passages of 351L35M4N. A comparison of the wrought mechanical strength properties between 351L57M4N and those of conventional austenitic stainless steel UNS S31703, and between 351L57M4N and those of UNS S31753/UNS S35115, suggests stronger yield and tensile strengths of the magnitude similar to those found for 351L35M4N. Similarly, a comparison of the tensile properties of 351L57M4N demonstrates they are better than that specified for 22 Cr Duplex Stainless Steel and similar to those specified for 25 Cr Super Duplex Stainless Steel, just like the 351L35M4N.

This means that applications using the wrought 351L57M4N stainless steel may be frequently designed with reduced wall thicknesses, thus, leading to significant weight savings when specifying 351L57M4N stainless steel compared to conventional austenitic stainless steels such as UNS S31703, 531753 and 535115 because the minimum allowable design stresses are significantly higher. In fact, the minimum allowable design stresses for the wrought 351L57M4N stainless steel are higher than for 22 Cr Duplex Stainless Steels and similar to 25 Cr Super Duplex Stainless Steels.

For certain applications, other variants of the 351L57M4N stainless steel, have been purposely formulated to be manufactured containing specific levels of other alloying elements such as Copper, Tungsten and Vanadium. It has been determined that the optimum chemical composition range of the other variants of the 351L57M4N stainless steel is selective and the compositions of Copper and Vanadium are the same as those of 351L35M4N and those of 304LM4N. In other words, the passages relating to these elements for 304LM4N are also applicable here for 351L57M4N.

Tungsten (W)

The Tungsten content of the 351L57M4N stainless steel is similar to those of the 351L35M4N and the PITTING RESISTANCE EQUIVALENT, $PRE_{NW}$, of 351L57M4N calculated using the same formulae as mentioned above for 351L35M4N is $PRE_{NW}$≥52.5, and preferably $PRE_{NW}$≥57.5, due to the different Molybdenum content. It should be apparent that the passage relating to the use and effects of Tungsten for 351L35M4N is also applicable for 351L57M4N.

Further, the 351L57M4N may have higher levels of Carbon referred to as 351H57M4N or 35157M4N which correspond respectively to 351H35M4N and 35135M4N discussed earlier and the Carbon wt % ranges discussed earlier are also applicable for 351H57M4N and 35157M4N.

Titanium (Ti)/Niobium (Nb)/Niobium (Nb) Plus Tantalum (Ta)

Furthermore, for certain applications, other stabilised variants of the 351H57M4N or 35157M4N stainless steel are desirable, which have been specifically formulated to be manufactured comprising higher levels of Carbon. Specifically, the amount of Carbon may be ≥0.040 wt % C and <0.10 wt % C, but preferably ≤0.050 wt % C or >0.030 wt % C and ≤0.08 wt % C, but preferably <0.040 wt % C.

(i) These include the Titanium stabilised versions which are referred to as 351H57M4NTi or 35157M4NTi to contrast with the generic 351L57M4N.

The Titanium content is controlled according to the following formulae:

Ti 4×C min, 0.70 wt % Ti max or Ti 5×C min, 0.70 wt % Ti max respectively, in order to have Titanium stabilised derivatives of the alloy.

(ii) There are also the Niobium stabilised, 351H57M4NNb or 35157M4NNb versions where the Niobium content is controlled according to the following formulae:

Nb 8×C min, 1.0 wt % Nb max or Nb 10×C min, 1.0 wt % Nb max respectively, in order to have Niobium stabilised derivatives of the alloy.

(iii) In addition, other variants of the alloy may also be manufactured to contain Niobium plus Tantalum stabilised, 351H57M4NNbTa or 35157M4NNbTa versions where the Niobium plus Tantalum content is controlled according to the following formulae:

Nb+Ta 8×C min, 1.0 wt % Nb+Ta max, 0.10 wt % Ta max, or Nb+Ta 10×C min, 1.0 wt % Nb+Ta max, 0.10 wt % Ta max.

Titanium stabilised, Niobium stabilised and Niobium plus Tantalum stabilised variants of the Alloy may be given a stabilisation heat treatment at a temperature lower than the initial solution heat treatment temperature. Titanium and/or Niobium and/or Niobium plus Tantalum may be added individually or in conjunction with Copper, Tungsten and Vanadium in all the various combinations of these elements to optimise the alloy for certain applications where higher Carbon contents are desirable. These alloying elements may be utilised individually or in all the various combinations of the elements to tailor the stainless steel for specific applications and to further improve the overall corrosion performance of the alloy.

The wrought and cast versions of the 351L57M4N Stainless steel, along with the other variants, are generally supplied in the same manner as the earlier embodiments.

Further, there is proposed a further variation appropriately referred to as 353L35M4N in this description, which is a thirteenth embodiment of the invention.

[353L35M4N]

The 353L35M4N stainless steel has a high level of Nitrogen and a specified Pitting Resistance Equivalent of $PRE_N \geq 46$, but preferably $PRE_N \geq 51$. The Pitting Resistance Equivalent as designated by $PRE_N$ is calculated according to the formulae:

$$PRE_N = \%\ Cr + (3.3 \times \%\ Mo) + (16 \times \%\ N).$$

The 353L35M4N stainless steel has been formulated to possess a unique combination of high mechanical strength properties with excellent ductility and toughness, along with good weldability and good resistance to general and localised corrosion. The chemical composition of the 353L35M4N stainless steel is selective and characterised by an alloy of chemical analysis in percentage by weight as follows, 0.030 wt % C max, 2.00 wt % Mn max, 0.030 wt % P max, 0.010 wt % S max, 0.75 wt % Si max, 28.00 wt % Cr—30.00 wt % Cr, 23.00 wt % Ni—27.00 wt % Ni, 3.00 wt % Mo—5.00 wt % Mo, 0.40 wt % N—0.70 wt % N.

The 353L35M4N stainless steel also contains principally Fe as the remainder and may also contain very small amounts of other elements such as 0.010 wt % B max, 0.10 wt % Ce max, 0.050 wt % Al max, 0.01 wt % Ca max and/or 0.01 wt % Mg max and other impurities which are normally present in residual levels.

The chemical composition of the 353L35M4N stainless steel is optimised at the melting stage to primarily ensure an Austenitic microstructure in the base material after solution heat treatment typically performed in the range 1100 deg C.-1250 deg C. followed by water quenching. The microstructure of the base material in the solution heat treated condition, along with as-welded weld metal and heat affected zone of weldments, is controlled by optimising the balance between Austenite forming elements and Ferrite forming elements to primarily ensure that the Alloy is Austenitic. As a result, the 353L35M4N stainless steel exhibits a unique combination of high strength and ductility at ambient temperatures, while at the same time guarantees excellent toughness at ambient temperatures and cryogenic temperatures. In view of the fact that the chemical analysis of the 353L35M4N stainless steel is adjusted to achieve a $PRE_N \geq 46$, but preferably $PRE_N \geq 51$, this ensures that the material also has a good resistance to general corrosion and localised corrosion (Pitting Corrosion and Crevice Corrosion) in a wide range of process environments. The 353L35M4N stainless steel also has improved resistance to stress corrosion cracking in Chloride containing environments when compared to conventional Austenitic Stainless Steels such as UNS S31703 and UNS S31753.

It has been determined that the optimum chemical composition range of the 353L35M4N stainless steel is carefully selected to comprise the following chemical elements in percentage by weight as follows, based on the thirteenth embodiment, Carbon (C)

The Carbon content of the 353L35M4N stainless steel is ≤0.030 wt % C maximum. Preferably, the amount of Carbon should be ≥0.020 wt % C and ≤0.030 wt % C and more preferably ≤0.025 wt % C.

Manganese (Mn)

The 353L35M4N stainless steel of the thirteenth embodiment may come in two variations: low Manganese or high Manganese.

For the low Manganese alloys, the Manganese content of the 353L35M4N stainless steel is ≤2.0 wt % Mn. Preferably, the range is ≥1.0 wt % Mn and ≤2.0 wt % Mn and more preferably ≥1.20 wt % Mn and ≤1.50 wt % Mn. With such compositions, this achieves an optimum Mn to N ratio of ≤5.0, and preferably ≥1.42 and ≤5.0. More preferably, the ratio is ≥1.42 and ≤3.75.

For the high Manganese alloys, the Manganese content of the 353L35M4N is ≤4.0 wt % Mn. Preferably, the Manganese content is ≥2.0 wt % Mn and ≤4.0 wt % Mn and more preferably, the upper limit is ≤3.0 wt % Mn. Even more preferably, the upper limit is ≤2.50 wt % Mn. With such selective ranges, this achieves a Mn to N ratio of ≤10.0, and preferably ≥2.85 and ≤10.0. More preferably, the Mn to N ratio of high Manganese alloys is ≥2.85 and ≤7.50 and even more preferably ≥2.85 and ≤6.25.

Phosphorus (P)

The Phosphorus content of the 353L35M4N stainless steel is controlled to be ≤0.030 wt % P. Preferably, the 353L35M4N alloy has ≤0.025 wt % P and more preferably ≤0.020 wt % P. Even more preferably, the alloy has ≤0.015 wt % P and even further more preferably ≤0.010 wt % P.

Sulphur (S)

The Sulphur content of the 353L35M4N stainless steel of the thirteenth embodiment includes ≤0.010 wt % S. Preferably, the 353L35M4N has ≤0.005 wt % S and more preferably ≤0.003 wt % S, and even more preferably ≤0.001 wt % S.

Oxygen (O)

The Oxygen content of the 353L35M4N stainless steel is controlled to be as low as possible and in the thirteenth embodiment, the 353L35M4N has ≤0.070 wt % O. Preferably, the 353L35M4N has ≤0.050 wt % O and more preferably ≤0.030 wt % O. Even more preferably, the alloy has ≤0.010 wt % O and even further more preferably ≤0.005 wt % O.

Silicon (Si)

The Silicon content of the 353L35M4N stainless steel is ≤0.75 wt % Si. Preferably, the alloy has ≥0.25 wt % Si and ≤0.75 wt % Si. More preferably, the range is ≥0.40 wt % Si and ≤0.60 wt % Si. However, for specific higher temperature applications where improved oxidation resistance is required, the Silicon content may be ≥0.75 wt % Si and ≤2.00 wt % Si.

Chromium (Cr)

The Chromium content of the 353L35M4N stainless steel is ≥28.00 wt % Cr and ≤30.00 wt % Cr. Preferably, the alloy has ≥29.00 wt % Cr.

Nickel (Ni)

The Nickel content of the 353L35M4N stainless steel is ≥23.00 wt % Ni and ≤27.00 wt % Ni. Preferably, the upper limit of Ni of the alloy is <26.00 wt % Ni and more preferably ≤25.00 wt % Ni.

Molybdenum (Mo)

The Molybdenum content of the 353L35M4N stainless steel is ≥3.00 wt % Mo and ≤5.00 wt % Mo, but preferably ≥4.00 wt % Mo.

Nitrogen (N)

The Nitrogen content of the 353L35M4N stainless steel is ≤0.70 wt % N, but preferably ≥0.40 wt % N and ≤0.70 wt % N. More preferably, the 353L35M4N has ≥0.40 wt % N and ≤0.60 wt % N and even more preferably ≥0.45 wt % N and ≤0.55 wt % N.

$PRE_N$

The PITTING RESISTANCE EQUIVALENT is calculated using the formulae:

$$PRE_N = \%\ Cr + (3.3 \times \%\ Mo) + (16 \times \%\ N).$$

The 353L35M4N stainless steel has been specifically formulated to have (i) Chromium content ≥28.00 wt % Cr and ≤30.00 wt % Cr, but preferably ≥29.00 wt % Cr;

(ii) Molybdenum content ≥3.00 wt % Mo and ≤5.00 wt % Mo, but preferably ≥4.00 wt % Mo;

(iii) Nitrogen content ≤0.70 wt % N, but preferably ≥0.40 wt % N and ≤0.70 wt % N and more preferably ≥0.40 wt % N and ≤0.60 wt % N and even more preferably ≥0.45 wt % N and ≤0.55 wt % N.

With a high level of Nitrogen, the 353L35M4N stainless steel achieves a $PRE_N \geq 46$, but preferably $PRE_N \geq 51$. This ensures that the material also has a good resistance to general corrosion and localised corrosion (Pitting Corrosion and Crevice Corrosion) in a wide range of process environments. The 353L35M4N stainless steel also has improved resistance to stress corrosion cracking in Chloride containing environments when compared to conventional Austenitic Stainless Steels such as UNS S31703 and UNS S31753. It should be emphasised that these equations ignore the effects of microstructural factors on the breakdown of passivity by pitting or crevice corrosion.

The chemical composition of the 353L35M4N stainless steel is optimised at the melting stage to ensure that the ratio of the [Cr] equivalent divided by the [Ni] equivalent, according to Schoefer[6], is in the range >0.40 and <1.05, but preferably >0.45 and <0.95, in order to primarily obtain an Austenitic microstructure in the base material after solution heat treatment typically performed in the range 1100 deg C.-1250 deg C. followed by water quenching. The microstructure of the base material in the solution heat treated condition, along with as-welded weld metal and heat affected zone of weldments, is controlled by optimising the balance between austenite forming elements and ferrite forming elements to primarily ensure that the alloy is austenitic. The alloy can therefore be manufactured and supplied in the Non-Magnetic condition.

The 353L35M4N stainless steel also has principally Fe as the remainder and may also contain very small amounts of other elements such as Boron, Cerium, Aluminium, Calcium and/or Magnesium in percentage by weight, and the compositions of these elements are the same as those of 304LM4N. In other words, the passages relating to these elements for 304LM4N are also applicable here.

The 353L35M4N stainless steel according to the thirteenth embodiment possesses minimum yield strength of 55 ksi or 380 MPa for the wrought version. More preferably minimum yield strength of 62 ksi or 430 MPa may be achieved for the wrought version. The cast version possesses minimum yield strength of 41 ksi or 280 MPa. More preferably, minimum yield strength of 48 ksi or 330 MPa may be achieved for the cast version. Based on the preferred values, a comparison of the wrought mechanical strength properties of the 353L35M4N stainless steel, with those of UNS S31703, suggests that the minimum yield strength of the 353L35M4N stainless steel might be 2.1 times higher than that specified for UNS S31703. Similarly, a comparison of the wrought mechanical strength properties of the 353L35M4N stainless steel, with those of UNS S31753, suggests that the minimum yield strength of the 353L35M4N stainless steel might be 1.79 times higher than that specified for UNS S31753. Likewise, a comparison of the wrought mechanical strength properties of the 353L35M4N stainless steel, with those of UNS S35315, suggests that the minimum yield strength of the 353L35M4N stainless steel might be 1.59 times higher than that specified for UNS S35315.

The 353L35M4N stainless steel according to the thirteenth embodiment has a minimum tensile strength of 102 ksi or 700 MPa for the wrought version. More preferably, a minimum tensile strength of 109 ksi or 750 MPa may be achieved for the wrought version. The cast version possesses a minimum tensile strength of 95 ksi or 650 MPa. More preferably, a minimum tensile strength of 102 ksi or 700 MPa may be achieved for the cast version. Based on the preferred values, a comparison of the wrought mechanical strength properties of the 353L35M4N stainless steel, with those of UNS S31703, suggests that the minimum tensile strength of the 353L35M4N stainless steel might be more than 1.45 times higher than that specified for UNS S31703. Similarly, a comparison of the wrought mechanical strength properties of the 353L35M4N stainless steel, with those of UNS S31753, suggests that the minimum tensile strength of the 353L35M4N stainless steel might be 1.36 times higher than that specified for UNS S31753. Likewise, a comparison of the wrought mechanical strength properties of the 353L35M4N Stainless steel, with those of UNS S35315, suggests that the minimum tensile strength of the 353L35M4N stainless steel might be 1.15 times higher than that specified for UNS S35315. Indeed, if the wrought mechanical strength properties of the 353L35M4N stainless steel, are compared with those of the 22 Cr Duplex Stainless Steel, then it may be demonstrated that the minimum tensile strength of the 353L35M4N stainless steel is in the region of 1.2 times higher than that specified for S31803 and similar to that specified for 25 Cr Super Duplex Stainless Steel. Therefore, the minimum mechanical strength properties of the 353L35M4N stainless steel have been significantly improved compared to conventional austenitic stainless steels such as UNS S31703, UNS S31753 and UNS S35315 and the tensile strength properties are better than that specified for 22 Cr Duplex Stainless Steel and similar to those specified for 25 Cr Super Duplex Stainless Steel.

This means that applications using the wrought 353L35M4N stainless steel may be frequently formulated with reduced wall thicknesses, thus, leading to significant weight savings when specifying 353L35M4N stainless steel compared to conventional austenitic stainless steels such as UNS S31703, S31753 and 535315 because the minimum allowable design stresses are significantly higher. In fact, the minimum allowable design stresses for the wrought 353L35M4N stainless steel are higher than for 22 Cr Duplex Stainless Steels and similar to 25 Cr Super Duplex Stainless Steels.

For certain applications, other variants of the 353L35M4N stainless steel have been purposely formulated to be manufactured containing specific levels of other alloying elements such as Copper, Tungsten and Vanadium. It has been determined that the optimum chemical composition range of the other variants of the 353L35M4N stainless steel according to claim 1, is selective and the compositions of Copper and Vanadium are the same as those of 304LM4N. In other words, passages relating to these elements for 304LM4N are also applicable for 353L35M4N.

Tungsten (W)

The Tungsten content of the 353L35M4N stainless steel is ≤2.00 wt % W, but preferably ≥0.50 wt % W and ≤1.00 wt % W, and more preferably ≥0.75 wt % W. For 353L35M4N stainless steel variants containing Tungsten, the PITTING RESISTANCE EQUIVALENT is calculated using the formulae:

$$PRE_{NW}=\%\ Cr+[3.3\times\%\ (Mo+W)]+(16\times\%\ N).$$

This Tungsten containing variant of the 353L35M4N stainless steel has been specifically formulated to have the following composition:

(i) Chromium content ≥28.00 wt % Cr and ≤30.00 wt % Cr, but preferably ≥29.00 wt % Cr;

(ii) Molybdenum content ≥3.00 wt % Mo and ≤5.00 wt % Mo, but preferably ≥4.00 wt % Mo;

(iii) Nitrogen content ≤0.70 wt % N, but preferably ≥0.40 wt % N and ≤0.70 wt % N and more preferably ≥0.40 wt % N and ≤0.60 wt % N and even more preferably ≥0.45 wt % N and ≤0.55 wt % N; and (iv) Tungsten content ≤2.00 wt % W, but preferably ≥0.50 wt % W and ≤1.00 wt % W and more preferably ≥0.75 wt % W.

The Tungsten containing variant of the 353L35M4N stainless steel has a high specified level of Nitrogen and a $PRE_{NW}$≥48, but preferably $PRE_{NW}$≥53. It should be emphasised that these equations ignore the effects of microstructural factors on the breakdown of passivity by pitting or crevice corrosion. Tungsten may be added individually or in conjunction with Copper, Vanadium, Titanium and/or Niobium and/or Niobium plus Tantalum in all the various combinations of these elements, to further improve the overall corrosion performance of the alloy. Tungsten is extremely costly and therefore is being purposely limited to optimise the economics of the alloy, while at the same time optimising the ductility, toughness and corrosion performance of the alloy.

Carbon (C)

For certain applications, other variants of the 353L35M4N stainless steel are desirable, which have been specifically formulated to be manufactured comprising higher levels of Carbon. Specifically, the Carbon content of the 353L35M4N may be ≥0.040 wt % C and <0.10 wt % C, but preferably ≤0.050 wt % C or >0.030 wt % C and ≤0.08 wt % C, but preferably <0.040 wt % C. These specific variants of the 353L35M4N stainless steel are the 353H35M4N or 35335M4N versions respectively.

Titanium (Ti)/Niobium (Nb)/Niobium (Nb) Plus Tantalum (Ta)

Furthermore, for certain applications, other stabilised variants of the 353H35M4N or 35335M4N stainless steel are desirable, which have been specifically formulated to be manufactured comprising higher levels of Carbon Specifically, the amount of Carbon may be ≥0.040 wt % C and <0.10 wt % C, but preferably ≤0.050 wt % C or >0.030 wt % C and ≤0.08 wt % C, but preferably <0.040 wt % C.

(i) These include the Titanium stabilised versions which are referred to as 353H35M4NTi or 35335M4NTi to contrast with the generic 353L35M4N.

The Titanium content is controlled according to the following formulae:

Ti 4×C min, 0.70 wt % Ti max or Ti 5×C min, 0.70 wt % Ti max respectively, in order to have Titanium stabilised derivatives of the alloy.

(ii) There are also the Niobium stabilised, 353H35M4NNb or 35335M4NNb versions where the Niobium content is controlled according to the following formulae:

Nb 8×C min, 1.0 wt % Nb max or Nb 10×C min, 1.0 wt % Nb max respectively, in order to have Niobium stabilised derivatives of the alloy.

(iii) In addition, other variants of the Alloy may also be manufactured to contain Niobium plus Tantalum stabilised, 353H35M4NNbTa or 35335M4NNbTa versions where the Niobium plus Tantalum content is controlled according to the following formulae:

Nb+Ta 8×C min, 1.0 wt % Nb+Ta max, 0.10 wt % Ta max, or Nb+Ta 10×C min, 1.0 wt % Nb+Ta max, 0.10 wt % Ta max.

Titanium stabilised, Niobium stabilised and Niobium plus Tantalum stabilised variants of the alloy may be given a stabilisation heat treatment at a temperature lower than the initial solution heat treatment temperature. Titanium and/or Niobium and/or Niobium plus Tantalum may be added individually or in conjunction with Copper, Tungsten and Vanadium in all the various combinations of these elements to optimise the alloy for certain applications where higher Carbon contents are desirable. These alloying elements may be utilised individually or in all the various combinations of the elements to tailor the stainless steel for specific applications and to further improve the overall corrosion performance of the alloy.

The wrought and cast versions of the 353L35M4N stainless steel along with the other variants are generally supplied in the same manner as the earlier embodiments.

Further, there is proposed a further variation appropriately referred to as 353L57M4N high strength austenitic stainless steel, which is a fourteenth embodiment of the invention. The 353L57M4N stainless steel virtually has the same chemical composition as 353L35M4N with the exception of the Molybdenum content. Thus, instead of repeating the various chemical compositions, only the difference is described.

[353L57M4N]

As mentioned above, the 353L57M4N has exactly the same wt % Carbon, Manganese, Phosphorus, Sulphur, Oxygen, Silicon, Chromium, Nickel and Nitrogen content as the thirteenth embodiment, 353L35M4N stainless steel, except the Molybdenum content. In the 353L35M4N, the Molybdenum content is between 3.00 wt % and 5.00 wt % Mo. In contrast, the 353L57M4N stainless steel's Molybdenum content is between 5.00 wt % and 7.00 wt % Mo. In other words, the 353L57M4N may be regarded as a higher Molybdenum version of the 353L35M4N stainless steel.

It should be appreciated that the passages relating to 353L35M4N are also applicable here, except the Molybdenum content.

Molybdenum (Mo)

The Molybdenum content of the 353L57M4N stainless steel may be ≥5.00 wt % Mo and ≤7.00 wt % Mo, but preferably ≥5.50 wt % Mo and ≤6.50 wt % Mo, and more preferably ≥6.00 wt % Mo. In other words, the Molybdenum content of the 353L57M4N has a maximum of 7.00 wt % Mo.

$PRE_N$

The PITTING RESISTANCE EQUIVALENT for the 353L57M4N is calculated using the same formulae as 353L35M4N but because of the Molybdenum content, the $PRE_N$ is ≥52.5, but preferably $PRE_N$≥57.5. This ensures that the material also has a good resistance to general corrosion and localised corrosion (Pitting Corrosion and Crevice Corrosion) in a wide range of process environments. The 353L57M4N stainless steel also has improved resistance to stress corrosion cracking in Chloride containing environments when compared to conventional Austenitic Stainless Steels such as UNS S31703 and UNS S31753. It should be emphasised that these equations ignore the effects of microstructural factors on the breakdown of passivity by pitting or crevice corrosion The chemical composition of the 353L57M4N stainless steel is optimised at the melting stage to ensure that the ratio of the [Cr] equivalent divided by the [Ni] equivalent, according to Schoefer[6], is in the range >0.40 and <1.05, but preferably >0.45 and <0.95, in order to primarily obtain an austenitic microstructure in the base material after solution heat treatment typically performed in the range 1100 deg C.-1250 deg C. followed by water quenching. The microstructure of the base material in the solution heat treated condition, along with as-welded weld metal and heat affected zone of weldments, is controlled by optimising the balance between austenite forming elements and ferrite forming elements to primarily ensure that the alloy is austenitic. The alloy can therefore be manufactured and supplied in the Non-Magnetic condition.

Like the 353L35M4N, the 353L57M4N stainless steel also comprises principally Fe as the remainder and may also contain very small amounts of other elements such as Boron, Cerium, Aluminium, Calcium and/or Magnesium in percentage by weight and the compositions of these elements are the same as those of 353L35M4N and thus, those of 304LM4N.

The 353L57M4N stainless steel of the fourteenth embodiment has a minimum yield strength and a minimum tensile strength comparable or similar to those of 353L35M4N stainless steel. Likewise, the strength properties of the wrought and cast versions of the 353L57M4N are also comparable to those of the 353L35M4N. Thus, the specific strength values are not repeated here and reference is made to the earlier passages of 353L35M4N. A comparison of the wrought mechanical strength properties between 353L57M4N and those of conventional austenitic stainless steel UNS S31703, and between 353L57M4N and those of UNS S31753/UNS S35315, suggests stronger yield and tensile strengths of the magnitude similar to those found for 353L35M4N. Similarly, a comparison of the tensile properties of 353L57M4N demonstrates they are better than that specified for 22 Cr Duplex Stainless Steel and similar to those specified for 25 Cr Super Duplex Stainless Steel, just like the 353L35M4N.

This means that applications using the wrought 353L57M4N stainless steel may be frequently designed with reduced wall thicknesses, thus, leading to significant weight savings when specifying 353L57M4N stainless steel compared to conventional austenitic stainless steels such as UNS S31703, S31753 and S35315 because the minimum allowable design stresses are significantly higher. In fact, the minimum allowable design stresses for the wrought 353L57M4N stainless steel are higher than for 22 Cr Duplex Stainless Steels and similar to 25 Cr Super Duplex Stainless Steels.

For certain applications, other variants of the 353L57M4N stainless steel, have been purposely formulated to be manufactured containing specific levels of other alloying elements such as Copper, Tungsten and Vanadium. It has been determined that the optimum chemical composition range of the other variants of the 353L57M4N stainless steel is selective and the compositions of Copper and Vanadium are the same as those of 353L35M4N and those of 304LM4N. In other words, the passages relating to these elements for 304LM4N are also applicable here for 353L57M4N.

Tungsten (W)

The Tungsten content of the 353L57M4N stainless steel is similar to those of the 353L35M4N and the PITTING RESISTANCE EQUIVALENT, $PRE_{NW}$, of 353L57M4N calculated using the same formulae as mentioned above for 353L35M4N is $PRE_{NW} \geq 54.5$, and preferably $PRE_{NW} \geq 59.5$, due to the different Molybdenum content. It should be apparent that the passage relating to the use and effects of Tungsten for 353L35M4N is also applicable for 353L57M4N.

Further, the 353L57M4N may have higher levels of Carbon referred to as 353H57M4N or 35357M4N which correspond respectively to 353H35M4N and 35335M4N discussed earlier and the Carbon wt % ranges discussed earlier are also applicable for 353H57M4N and 35357M4N.

Titanium (Ti)/Niobium (Nb)/Niobium (Nb) Plus Tantalum (Ta)

Furthermore, for certain applications, other stabilised variants of the 353H57M4N or 35357M4N stainless steel are desirable, which have been specifically formulated to be manufactured comprising higher levels of Carbon. Specifically, the Carbon may be ≥0.040 wt % C and <0.10 wt % C, but preferably ≤0.050 wt % C or >0.030 wt % C and ≤0.08 wt % C, but preferably <0.040 wt % C.

(i) These include the Titanium stabilised versions which are referred to as 353H57M4NTi or 35357M4NTi to contrast with the generic 353L57M4N. The Titanium content is controlled according to the following formulae:

Ti 4×C min, 0.70 wt % Ti max or Ti 5×C min, 0.70 wt % Ti max respectively, in order to have Titanium stabilised derivatives of the alloy.

(ii) There are also the Niobium stabilised, 353H57M4NNb or 35357M4NNb versions where the Niobium content is controlled according to the following formulae:

Nb 8×C min, 1.0 wt % Nb max or Nb 10×C min, 1.0 wt % Nb max respectively, in order to have Niobium stabilised derivatives of the alloy.

(iii) In addition, other variants of the alloy may also be manufactured to contain Niobium plus Tantalum stabilised, 353H57M4NNbTa or 35357M4NNbTa versions where the Niobium plus Tantalum content is controlled according to the following formulae:

Nb+Ta 8×C min, 1.0 wt % Nb+Ta max, 0.10 wt % Ta max, or Nb+Ta 10×C min, 1.0 wt % Nb+Ta max, 0.10 wt % Ta max.

Titanium stabilised, Niobium stabilised and Niobium plus Tantalum stabilised variants of the Alloy may be given a stabilisation heat treatment at a temperature lower than the initial solution heat treatment temperature. Titanium and/or Niobium and/or Niobium plus Tantalum may be added individually or in conjunction with Copper, Tungsten and Vanadium in all the various combinations of these elements to optimise the Alloy for certain applications where higher Carbon contents are desirable. These alloying elements may be utilised individually or in all the various combinations of the elements to tailor the stainless steel for specific applications and to further improve the overall corrosion performance of the alloy.

The wrought and cast versions of the 353L57M4N stainless steel along with the other variants are generally supplied in the same manner as the earlier embodiments.

The described embodiments should not be construed as limitative and others may be formulated in addition to the ones described herein. For example, the aforementioned embodiments or series of austenitic stainless steels for all the different types of alloy compositions and their variants may be produced with tailored chemical compositions for specific applications. One such example is the use of a higher Manganese content of >2.00 wt % Mn and ≤4.00 wt % Mn, in order to reduce the level of the Nickel content by a pro rata amount according to the equations proposed by Schoefer.[6] This would reduce the overall cost of the alloys since Nickel is extremely costly. Therefore the Nickel content may be purposely limited to optimise the economics of the alloys.

The described embodiments may also be controlled to satisfy other criteria to the ones already defined herein. For example in addition to the Manganese to Nitrogen ratios, the embodiments are also controlled to have specific Manganese to Carbon+Nitrogen ratios.

For the "LM4N," types of the low Manganese range Alloys this achieves an optimum Mn to C+N ratio of ≤4.76, and preferably ≥1.37 and ≤4.76. More preferably, the Mn to C+N ratio is ≥1.37 and ≤3.57. For the "LM4N," types of the high Manganese range Alloys this achieves an optimum Mn to C+N ratio of ≤9.52, and preferably ≥2.74 and ≤9.52. More preferably, the Mn to C+N ratio for these "LM4N," types of high Manganese alloys is ≥2.74 and ≤7.14 and even more preferably the Mn to C+N ratio is ≥2.74 to ≤5.95. The current embodiments include the following: the 304LM4N, 316LM4N, 317L35M4N, 317L57M4N, 312L35M4N, 312L57M4N, 320L35M4N, 320L57M4N, 326L35M4N and 326L57M4N, 351L35M4N, 351L57M4N, 353L35M4N, 353L57M4N types of Alloy and their variants which may comprise up to 0.030 wt % of Carbon maximum, For the "HM4N," types of the low Manganese range Alloys this achieves an optimum Mn to C+N ratio of ≤4.55, and preferably ≥1.25 and ≤4.55. More preferably, the Mn to C+N ratio is ≥1.25 and ≤3.41. For the "HM4N," types of the high Manganese range Alloys this achieves an optimum Mn to C+N ratio of ≤9.10, and preferably ≥2.50 and ≤9.10. More preferably, the Mn to C+N ratio for these "HM4N," types of high Manganese alloys is ≥2.50 and ≤6.82 and even more preferably the Mn to C+N ratio is ≥2.50 to ≤5.68. The current embodiments include the following: the 304HM4N, 316HM4N 317H57M4N, 317H35M4N, 312H35M4N, 312H57M4N, 320H35M4N, 320H57M4N, 326H35M4N, 326H57M4N, 351H35M4N, 351H57M4N, 353H35M4N and 353H57M4N types of Alloy and their variants which may comprise from 0.040 wt % of Carbon up to 0.10 wt % of Carbon, and For the "M4N," types of the low Manganese range Alloys this achieves an optimum Mn to C+N ratio of ≤4.64, and preferably ≥1.28 and ≤4.64. More preferably, the Mn to C+N ratio is ≥1.28 and ≤3.48. For the "M4N," types of the high Manganese range Alloys this achieves an optimum Mn to C+N ratio of ≤9.28, and preferably ≥2.56 and ≤9.28. More preferably, the Mn to C+N ratio for these "M4N," types of high Manganese alloys is ≥2.56 and ≤6.96 and even more preferably the Mn to C+N ratio is ≥2.56 to ≤5.80. The current embodiments include the following: the 304M4N, 316M4N 31757M4N, 31735M4N, 31235M4N, 31257M4N, 32035M4N, 32057M4N, 32635M4N, 32657M4N, 35135M4N, 35157M4N, 35335M4N and 35357M4N types of Alloy and their variants which may comprise from more than 0.030 wt % of Carbon up to 0.080 wt % of Carbon.

The series of N'GENIUS™ high strength austenitic and super austenitic stainless steels including the "LM4N," "HM4N" and "M4N" types of Alloy, as well as the other variants discussed herein, may be specified and utilised as range of Products and Product Packages for complete systems.

It should be evident that chemical composition ranges specified for one element (e.g. Chromium, Nickel, Molybdenum, Carbon and Nitrogen etc) for specific alloy composition types and their variants may also be applicable to the elements in other alloy composition types and their variants.

Products, Markets, Industry Sectors and Applications

The proposed series of N'GENIUS™ high strength austenitic and super austenitic stainless steels may be specified to international standards and specifications and used for a range of products utilised for both offshore and onshore applications in view of their high mechanical strength properties, excellent ductility and toughness at ambient and cryogenic temperatures, along with good weldability and good resistance to general and localised corrosion.

Products

Products include but are not limited to Primary and Secondary Products such as Ingots, Continuous Cast Slabs, Rolled Skelps, Blooms, Billet, Bar, Flat Bar, Shapes, Rod, Wire, Welding wire, Welding Consumables, Plate, Sheet, Strip and Coiled Strip, Forgings, Static Castings, Die Castings, Centrifugal Castings, Powder Metallurgical Products, Hot Isostatic Pressings, Seamless Line Pipe, Seamless Pipe and Tube, Drill Pipe, Oil Country Tubular Goods, Casings, Condenser and Heat Exchanger Tubes, Welded Line Pipe, Welded Pipe and Tube, Tubular Products, Induction Bends, Butt Welded Fittings, Seamless Fittings, Fasteners, Bolting, Screws and Studs, Cold Drawn and Cold Reduced Bar, Rod and Wire, Cold Drawn and Cold Reduced Pipe and Tube, Flanges, Compact Flanges, Clamp-Lock Connectors, Forged Fittings, Pumps, Valves, Separators, Vessels and Ancillary Products. The Primary and Secondary Products above are also relevant to Metallurgically Clad Products (e.g. Thermo-Mechanically Bonded, Hot Roll Bonded, Explosively Bonded etc.), Weld Overlayed Clad Products, Mechanically Lined Products or Hydraulically Lined Products or CRA Lined Products.

As it can be appreciated from the number of alternative alloy compositions discussed above, the proposed N'GENIUS™ High Strength Austenitic and Super Austenitic Stainless Steels may be specified and used in various markets and industry sectors in a wide range of applications. Significant weight savings and fabrication time savings may be achieved when utilising these Alloys which in turn leads to significant cost savings in the overall construction costs.

Markets, Industry Sectors and Applications

Upstream and Downstream Oil and Gas Industries (Onshore and Offshore Including Shallow Water, Deep Water and Ultra Deep Water Technology)

Finished Product Applications may include but are not limited to the following:

Onshore and Offshore Pipelines including Interfield Pipelines and Flowlines, Infield Pipelines and Flowlines, Buckle Arrestors, High Pressure and High Temperature (HPHT) Pipelines for multiphase fluids such as Oil, Gas and Condensates containing Chlorides, $CO_2$ and $H_2S$, and other constituents, Seawater Injection and Formation Water Injection Pipelines, Subsea Production System Equipment, Manifolds, Jumpers, Tie-ins, Spools, Pigging Loops, Tubulars, OCTG and Casings, Steel Catenary Risers, Riser Pipes, Structural Splash Zone Riser Pipes, River and Waterway Crossings, Valves, Pumps, Separators, Vessels, Filtration Systems, Forgings, Fasteners and all associated Ancillary Products and Equipment.

Piping Package Systems: such as, Process systems and Utilities systems, Seawater Cooling systems and Firewater systems which can be utilised in all types of Onshore and Offshore applications. The Offshore applications include but are not limited to Fixed Platforms, Floating Platforms, SPA's and Hulls such as Process Platforms, Utilities Platforms, Wellhead Platforms, Riser Platforms, Compression Platforms, FPSO's, FSO's, SPA and Hull Infrastructure, Fabrications, Fabricated Modules and all associated Ancillary Products and Equipment.

Tubing Package Systems: such as, Umbilicals, Condensers, Heat Exchangers, Desalination, Desulphidation and all associated Ancillary Products and Equipment.

LNG Industries

Finished Product Applications may include but are not limited to the following: Pipelines and Piping Package Systems Infrastructure, Fabrications, Fabricated Modules, Valves, Vessels, Pumps, Filtration Systems, Forgings, Fasteners and all associated Ancillary Products and Equipment used for the Fabrication of offshore Floating Liquefied Natural Gas (FLNG) vessels, FSRU's or onshore Liquefied Natural Gas (LNG) Plants, Ships and Vessels as well as Terminals for the processing, storage and transportation of Liquefied Natural Gas (LNG) at cryogenic temperatures.

Chemical Process, Petrochemical, GTL and Refining Industries

Finished Product Applications may include but are not limited to the following:

Pipelines and Piping Package Systems, Infrastructure, Fabrications, Fabricated modules, Valves, Pumps, Vessels, Filtration Systems, Forgings, Fasteners and all associated Ancillary Products and Equipment, including Rail and Road Chemical Tankers used for the processing and transportation of corrosive aggressive fluids from the Chemical Process, Petrochemical, Gas to Liquids and Refining Industries as well as acids, alkalis and other corrosive fluids including chemicals typically found in Vacuum Towers, Atmospheric Towers and Hydro Treaters.

Environmental Protection Industries

Finished Product Applications may include but are not limited to the following:

Pipelines and Piping Package Systems, Infrastructure, Fabrications, Fabricated modules, Valves, Pumps, Vessels, Filtration Systems, Forgings, Fasteners and all associated Ancillary Products and Equipment used for waste products and wet toxic gases from the Chemical Process and Refining Industries, Pollution Control e.g. Vapour Recovery systems, containment of $CO_2$ and Flue Gas Desulphurisation.

Iron and Steel Industries

Finished Product Applications may include but are not limited to the following:

Pipelines and Piping Package Systems, Infrastructure, Fabrications, Fabricated modules, Valves, Pumps, Vessels, Filtration Systems, Forgings, Fasteners and all associated Ancillary Products and Equipment used for the manufacture and processing of Iron and Steel.

Mining and Minerals Industries

Finished Product Applications may include but are not limited to the following:

Pipelines and Piping Package Systems, Infrastructure, Fabrications, Fabricated Modules, Valves, Pumps, Vessels, Filtration Systems, Forgings, Fasteners and all associated Ancillary Products and Equipment used for the Mining and Minerals extraction and for the transportation of erosive-corrosive slurries as well as mine dewatering.

Power Industries

Finished Product Applications may include but are not limited to the following:

Pipelines and Piping Package Systems, Infrastructure, Fabrications, Fabricated modules, Valves, Pumps, Vessels, Filtration Systems, Forgings, Fasteners and all associated Ancillary Products and Equipment used for the generation of Power and for the transportation of corrosive media associated with power generation i.e. fossil fuel, gas fired, nuclear fuel, geothermal power, hydro-electric power and all other forms of power generation.

Pulp and Paper Industries

Finished Product Applications may include but are not limited to the following:

Pipelines and Piping Package Systems, Infrastructure, Fabrications, Fabricated modules, Valves, Pumps, Vessels, Filtration Systems, Forgings, Fasteners and all associated Ancillary Products and Equipment used in the Pulp and Paper Industries and for the transportation of aggressive fluids in pulp bleach plants.

Desalination Industries

Finished Product Applications may include but are not limited to the following:

Pipelines and Piping Package Systems, Infrastructure, Fabrications, Fabricated modules, Valves, Pumps, Vessels, Filtration Systems, Forgings, Fasteners and all associated Ancillary Products and Equipment used in the Desalination Industries and for the transportation of seawater and brines used in desalination plants.

Marine, Naval and Defence Industries

Finished Product Applications may include but are not limited to the following:

Pipelines and Piping Package Systems, Fabrications, Fabricated modules, Valves, Pumps, Vessels, Filtration Systems, Forgings, Fasteners and all associated Ancillary Products and Equipment used for the Marine Naval and Defence Industries and for the transportation of aggressive media and utilities piping systems for chemical tankers, ship building and submarines.

Water and Waste Water Industries

Finished Product Applications may include but are not limited to the following:

Pipelines and Piping Package Systems, Infrastructure, Fabrications, Fabricated modules, Valves, Pumps, Vessels, Filtration Systems, Forgings, Fasteners and all associated Ancillary Products and Equipment used in the Water and Waste Water Industries including Casing Pipe used for water wells, utility distribution networks, sewage networks and irrigation systems.

Architectural, Engineering and Construction Industries

Finished Product Applications may include but are not limited to the following:

Pipe, Piping, Infrastructure, Fabrications, Forgings and Fasteners and all associated Ancillary Products and Equipment utilised for Structural Integrity and Decorative applications in the Architectural, Civil and Mechanical Engineering and the Construction industries.

Food and Brewing Industries

Finished Product Applications may include but are not limited to the following:

Pipelines and Piping Package Systems, Infrastructure, Fabrications, Fabricated modules, Valves, Pumps, Vessels, Filtration Systems, Forgings, Fasteners and all associated Ancillary Products and Equipment used in Food and Drinks Industries as well as the related Consumer Products.

Pharmaceutical, Bio-Chemical, Health and Medical Industries

Finished Product Applications may include but are not limited to the following:

Pipelines and Piping Package Systems, Infrastructure, Fabrications, Fabricated modules, Valves, Pumps, Vessels, Filtration Systems, Forgings, Fasteners and all associated Ancillary Products and Equipment used in the Pharmaceuticals, Bio-chemicals, Health and Medical Industries as well as related Consumer Products.

Automotive Industries

Finished Product Applications may include but are not limited to the following:

Pipelines and Piping Package Systems, Infrastructure, Fabrications, Fabricated modules, Valves, Pumps, Vessels, Filtration Systems, Forgings, Fasteners, Components and all associated Ancillary Products and Equipment used in the Automotive Industries including the manufacture of vehicles for Road and Rail applications as well as Surface and Underground Mass Transit Systems.

Specialist Research and Development Industries

Finished Product Applications may include but are not limited to the following:

Pipelines and Piping Package Systems, Infrastructure, Fabrications, Fabricated modules, Valves, Pumps, Vessels, Filtration Systems, Forgings, Fasteners and all associated Ancillary Products and Equipment used in the Specialist Research and Development Industries.

This invention relates austenitic stainless steels, comprising a high level of Nitrogen and a minimum specified Pitting Resistance Equivalent for each designated type of Alloy. The Pitting Resistance Equivalent as designated by $PRE_N$ is calculated according to the formulae:

$$PRE_N = \%\ Cr + (3.3 \times \%\ Mo) + (16 \times \%\ N);\ \text{and/or}$$

$$PRE_{NW} = \%\ Cr + [3.3 \times \%\ (Mo+W)] + (16 \times \%\ N),$$

where applicable, as discussed above, for each designated type of Alloy.

The low Carbon range of alloys for the different embodiments or types of Austenitic stainless steels and/or Super Austenitic Stainless Steels, have been referred to as 304LM4N, 316LM4N, 317L35M4N, 317L57M4N, 312L35M4N, 312L57M4N, 320L35M4N, 320L57M4N, 326L35M4N, 326L57M4N, 351L35M4N, 351L57M4N, 353L35M4N and 353L57M4N and these among other variants have been disclosed. In the described embodiments, the Austenitic stainless steels and/or Super Austenitic Stainless Steels, comprise 16.00 wt % of Chromium to 30.00 wt % of Chromium; 8.00 wt % of Nickel to 27.00 wt % of Nickel; no more than 7.00 wt % of Molybdenum and no more than 0.70 wt % of Nitrogen, but preferably 0.40 wt % of Nitrogen to 0.70 wt % of Nitrogen. For the lower Carbon range Alloys these comprise no more than 0.030 wt % of Carbon. For the lower Manganese range Alloys these comprise no more than 2.00 wt % of Manganese with the Manganese to Nitrogen ratio controlled to less than or equal to 5.0 and preferably a minimum of 1.42 and less than or equal to 5.0, or more preferably a minimum of 1.42 and less than or equal to 3.75. For the higher Manganese range Alloys these comprise no more than 4.00 wt % of Manganese with the Manganese to Nitrogen ratio controlled to less than or equal to 10.0 and preferably a minimum of 2.85 and less than or equal to 10.0, or more preferably to a minimum of 2.85 and less than or equal to 7.50, or even more preferably to a minimum of 2.85 and less than or equal to 6.25, or even further more preferably to a minimum of 2.85 and less than or equal to 5.0, or even more further more preferably to a minimum of 2.85 and less than or equal to 3.75. The level of Phosphorus is no more than 0.030 wt % of Phosphorus and is controlled to as low as possible so that it may be less than or equal to 0.010 wt % of Phosphorus. The level of Sulphur is no more than 0.010 wt % of Sulphur and is controlled to as low as possible so that it may be less than or equal to 0.001 wt % of Sulphur. The level of Oxygen in the Alloys is no more than 0.070 wt % of Oxygen and is crucially controlled to as low as possible so that it may be less than or equal to 0.005 wt % of Oxygen. The level of Silicon in the Alloys is no more than 0.75 wt % of Silicon, except for specific higher temperature applications where improved oxidation resistance is required, wherein the Silicon content may be from 0.75 wt % of Silicon to 2.00 wt % of Silicon. For certain applications, other variants of the Stainless steel and Super Austenitic Stainless Steels, have been purposely formulated to be manufactured containing specific levels of other alloying elements such as Copper of no more than 1.50 wt % of Copper for the lower Copper range Alloys and Copper of no more than 3.50 wt % of Copper for the higher Copper range Alloys, Tungsten of no more than 2.00 wt % of Tungsten and Vanadium of no more than 0.50 wt % of Vanadium. The Austenitic Stainless steels and Super Austenitic Stainless Steels, also contains principally Fe as the remainder and may also contain very small amounts of other elements such as Boron of no more than 0.010 wt % of Boron, Cerium of no more than 0.10 wt % of Cerium, Aluminium of no more than 0.050 wt % of Aluminium and Calcium and/or Magnesium of no more than 0.010 wt % of Calcium and/or Magnesium. The Austenitic Stainless steels and Super Austenitic Stainless Steels have been formulated to possess a unique combination of High mechanical strength properties with excellent ductility and toughness, along with good weldability and good resistance to general and localised corrosion. The chemical analysis of the Stainless steels and Super Austenitic Stainless Steels, is characterised in that it is optimised at the melting stage to ensure that the ratio of the [Cr] equivalent divided by the [Ni] equivalent, according to Schoefer[6], is in the range >0.40 and <1.05, or preferably >0.45 and <0.95, in order to primarily obtain an Austenitic microstructure in the base material after solution heat treatment, typically performed in the range 1100 deg C.-1250 deg C. followed by water quenching. The microstructure of the base material in the solution heat treated condition, along with as-welded weld metal and heat affected zone of weldments, is controlled by optimising the balance between Austenite forming elements and Ferrite forming elements to primarily ensure that the Alloy is Austenitic. The Alloys can therefore be manufactured and supplied in the Non-Magnetic condition. The minimum specified mechanical strength properties of the novel and innovative Stainless steels and Super Austenitic Stainless Steels, have been significantly improved compared to their respective counterparts, including Austenitic Stainless Steels such as, UNS S30403, UNS S30453, UNS S31603, UNS S31703, UNS S31753, UNS S31254, UNS S32053, UNS S32615, UNS S35115 and UNS S35315. Furthermore the minimum specified tensile strength properties can be better than that specified for 22 Cr Duplex Stainless Steel (UNS S31803) and similar to those specified for 25 Cr Super Duplex Stainless Steel (UNS S32760). This means that System components for different applications using the wrought Stainless steels are characterised in that the Alloys can frequently be designed with reduced wall thicknesses, thus, leading to significant weight savings when specifying Stainless steels compared to conventional Austenitic Stainless Steels such as those detailed herein because the minimum allowable design stresses may be significantly higher. In fact, the minimum allowable design stresses for the wrought Austenitic Stainless steel may be higher than that specified for 22 Cr Duplex Stainless Steels and similar to that specified for 25 Cr Super Duplex Stainless Steels.

For certain applications, other variants of the Austenitic Stainless steel and Super Austenitic Stainless Steels, have been specifically formulated to be manufactured containing higher levels of Carbon than that defined previously herein above. The higher Carbon range of alloys for the different types of Austenitic Stainless steels and Super Austenitic Stainless Steels, have been referred to as 304HM4N, 316HM4N, 317H35M4N, 317H57M4N, 312H35M4N, 312H57M4N, 320H35M4N, 320H57M4N, 326H35M4N, 326H57M4N, 351H35M4N, 351H57M4N, 353H35M4N and 353H57M4N and these types of Alloy comprise from 0.040 wt % of Carbon up to less than 0.10 wt % of Carbon. Whereas the 304M4N, 316M4N, 31735M4N, 31757M4N, 31235M4N, 31257M4N, 32035M4N, 32057M4N, 32635M4N, 32657M4N, 35135M4N, 35157M4N, 35335M4N and 35357M4N types of Alloy comprise from more than 0.030 wt % of Carbon up to 0.080 wt % of Carbon.

Furthermore, for certain applications, other variants of the higher Carbon ranges of Alloys for the Austenitic Stainless steel and Super Austenitic Stainless Steels, are desirable, which have been specifically formulated to be manufactured as stabilised versions. These specific variants of the Austenitic Stainless steel and Super Austenitic Stainless Steels, are the Titanium stabilised, "HM4NTi" or "M4NTi" types of Alloy where the Titanium content is controlled according to the following formulae: Ti 4×C min, 0.70 wt % Ti max or Ti 5×C min, 0.70 wt % Ti max respectively, in order to have Titanium stabilised derivatives of the Alloy. Similarly there are Niobium stabilised, "HM4NNb" or "M4NNb" types of Alloy where the Niobium content is controlled according to the following formulae: Nb 8×C min, 1.0 wt % Nb max or Nb 10×C min, 1.0 wt % Nb max respectively, in order to have Niobium stabilised derivatives of the Alloy. In addition, other variants of the Alloy may also be manufactured to contain Niobium plus Tantalum stabilised, "HM4NNbTa" or "M4NNbTa" types of alloy where the Niobium plus Tantalum content is controlled according to the following formulae: Nb+Ta 8×C min, 1.0 wt % Nb+Ta max, 0.10 wt % Ta max, or Nb+Ta 10×C min, 1.0 wt % Nb+Ta max, 0.10 wt % Ta max. Titanium stabilised, Niobium stabilised and Niobium plus Tantalum stabilised variants of the Alloy may be given a stabilisation heat treatment at a temperature lower than the initial solution heat treatment temperature. Titanium and/or Niobium and/or Niobium plus Tantalum may also be added individually or in conjunction with Copper, Tungsten and Vanadium in all the various combinations of these elements to optimise the Alloy for certain applications where higher Carbon contents are desirable. These alloying elements may be utilised individually or in all the various combinations of the elements to tailor the Austenitic Stainless steels for specific applications and to further optimise the overall corrosion performance of the Alloys.

REFERENCES

1. A. J. Sedriks, Stainless Steels '84, Proceedings of Göteborg Conference, Book No 320. The Institute of Metals, 1 Carlton House Terrace, London SW1Y 5DB, p. 125, 1985.
2. P. Guha and C. A. Clark, Duplex Stainless Steel Conference Proceedings, ASM Metals/Materials Technology Series, Paper (8201-018) p. 355, 1982.
3. N. Bui, A. Irhzo, F. Dabosi and Y. Limouzin-Maire, Corrosion NACE, Vol. 39, p. 491, 1983.
4. A. L. Schaeffler, Metal Progress, Vol. 56, p. 680, 1949.
5. C. L. Long and W. T. DeLong, Welding Journal, Vol. 52, p. 281s, 1973.
6. E. A. Schoefer, Welding Journal, Vol. 53, p. 10s, 1974.
7. ASTM A800/A800M-10

The invention claimed is:

1. Austenitic stainless steel base metal having a non-magnetic austenitic base metal microstructure comprising 16.00 wt % of Chromium to 30.00 wt % of Chromium (Cr); 8.00 wt % of Nickel to 27.00 wt % of Nickel (Ni); no more than 7.00 wt % of Molybdenum (Mo); 0.40 wt % of Nitrogen to 0.70 wt % of Nitrogen (N), 1.0 wt % of Manganese to less than 4.00 wt % of Manganese (Mn), no more than 1.0 wt % of Niobium (Nb), less than 0.10 wt % of Carbon (C), ≤0.070 wt % Oxygen, no more than 2.00 wt % of Silicon (Si), ≥0.03 wt % of Cerium and ≤0.08 wt % of Cerium, and a balance of iron and inevitable impurity, wherein ratio of the Manganese (Mn) to the Nitrogen (N) is controlled to less than 10.0; and wherein ratio of Chromium Equivalent [Cr] to Nickel Equivalent [Ni] is determined and controlled to more than 0.40 and less than 1.05; and wherein the Chromium Equivalent is determined and controlled according to a first formula:

$$[Cr]=(wt\ \%\ Cr)+(1.5\times wt\ \%\ Si)+(1.4\times wt\ \%\ Mo)+(wt\ \%\ Nb)-4.99;\ \text{and}$$

wherein the Nickel Equivalent is determined and controlled according to a second formula:

$$[Ni]=(wt\ \%\ Ni)+(30\times wt\ \%\ C)+(0.5\times wt\ \%\ Mn)+((26\times wt\ \%\ (N-0.02))+2.77;$$

and wherein the ratio of the [Cr] equivalent divided by the [Ni] equivalent is optimized at a melting stage in order to primarily obtain an austenitic microstructure in the base stainless steel after solution heat treatment performed in the range 1100 deg C. to 1250 deg C. followed by water quenching.

2. Austenitic stainless steel base metal according to claim 1, further comprising ≤0.030 wt % of Carbon.

3. Austenitic stainless steel base metal according to claim 1, further comprising 0.020 wt % to 0.030 wt % of Carbon.

4. Austenitic stainless steel base metal according to claim 1, further comprising no more than 2.0 wt % Mn.

5. Austenitic stainless steel base metal according to claim 1, further comprising 1.0 wt % Manganese to 2.0 wt % Manganese.

6. Austenitic stainless steel base metal according to claim 1, wherein the ratio of Manganese to the Nitrogen is controlled to less than or equal to 3.75.

7. Austenitic stainless steel base metal according to claim 1, further comprising ≤0.030 wt % of Phosphorus.

8. Austenitic stainless steel base metal according to claim 1, further comprising ≤0.010 wt % of Sulphur.

9. Austenitic stainless steel base metal according to claim 1, further comprising ≤0.001 wt % of Sulphur.

10. Austenitic stainless steel base metal according to claim 1, wherein the Oxygen is ≤0.050 wt % Oxygen.

11. Austenitic stainless steel base metal according to claim 1, further comprising no more than 0.75 wt % of Silicon.

12. Austenitic stainless steel base metal according to claim 1, wherein the Silicon is ≥0.25 wt % and ≤0.75 wt % of Silicon.

13. Austenitic stainless steel base metal according to claim 1, further comprising ≥0.75 wt % Si and ≤2.00 wt % Silicon.

14. Austenitic stainless steel base metal according to claim 1, further comprising at least one element selected from Boron, Aluminium, Calcium, Magnesium, Copper, Tungsten, Vanadium, Titanium, and/or Niobium plus Tantalum.

15. Austenitic stainless steel base metal according to claim 1, further comprising ≤0.010 wt % Boron.

16. Austenitic stainless steel base metal according to claim 1, further comprising ≥0.001 wt % Boron and ≤0.010 wt % Boron.

17. Austenitic stainless steel base metal according to claim 1, further comprising ≤0.050 wt % Aluminium.

18. Austenitic stainless steel base metal according to claim 1, further comprising ≥0.005 wt % Aluminium and ≤0.050 wt % Aluminium.

19. Austenitic stainless steel base metal according to claim 1, further comprising ≤0.010 wt % Calcium.

20. Austenitic stainless steel base metal according to claim 1, further comprising ≥0.001 wt % Calcium and ≤0.010 wt % Calcium.

21. Austenitic stainless steel base metal according to claim 1, further comprising ≤0.010 wt % Magnesium.

22. Austenitic stainless steel base metal according to claim 21, further comprising ≥0.001 wt % Magnesium and ≤0.010 wt % Magnesium.

23. Austenitic stainless steel base metal according to claim 1, further comprising ≤1.50 wt % Copper.

24. Austenitic stainless steel base metal according to claim 1, further comprising ≥1.50 wt % Copper and ≤3.50 wt % Copper.

25. Austenitic stainless steel base metal according to claim 1, further comprising ≤2.00 wt % Tungsten.

26. Austenitic stainless steel base metal according to claim 1, further comprising ≥0.50 wt % Tungsten and ≤1.00 wt % Tungsten.

27. Austenitic stainless steel base metal according to claim 1, further comprising ≤0.50 wt % Vanadium.

28. Austenitic stainless steel base metal according to claim 1, further comprising ≥0.10 wt % Vanadium and ≤0.50 wt % Vanadium.

29. Austenitic stainless steel base metal according to claim 1, further comprising 0.040 wt % Carbon to less than 0.10 wt % of Carbon.

30. Austenitic stainless steel base metal according to claim 29, wherein the Carbon is ≥0.030 wt % Carbon and ≤0.08 wt % Carbon.

31. Austenitic stainless steel base metal according to claim 29, further comprising no more than 0.70 wt % Titanium.

32. Austenitic stainless steel base metal according to claim 31, wherein the Titanium is more than Ti (min); wherein Ti (min) is calculated from 4×C (min); and wherein C (min) is minimum amount of the Carbon.

33. Austenitic stainless steel base metal according to claim 30, wherein the Titanium is more than Ti (min); wherein Ti (min) is calculated from 5×C (min); and wherein C (min) is minimum amount of the Carbon.

34. Austenitic stainless steel base metal according to claim 29, wherein the Niobium is more than Nb (min); wherein Nb (min) is calculated from 8×C (min); wherein C (min) is minimum amount of the Carbon.

35. Austenitic stainless steel base metal according to claim 30, wherein the Niobium is more than Nb (min); wherein Nb (min) is calculated from 10×C (min); wherein C (min) is minimum amount of the Carbon.

36. Austenitic stainless steel base metal according to claim 34, further comprising no more than 1.0 wt % Niobium plus Tantalum and maximum of 0.10 wt % of Tantalum.

37. Austenitic stainless steel base metal according to claim 36, wherein the Niobium and Tantalum is more than Nb+Ta (min); wherein Nb+Ta (min) is calculated from 8×C (min); wherein C (min) is minimum amount of the Carbon, (with 0.10 wt % Ta max).

38. Austenitic stainless steel base metal according to claim 30, further comprising no more than 1.0 wt % Niobium plus Tantalum and maximum of 0.10 wt % of Tantalum, wherein the Niobium and Tantalum is more than Nb+Ta (min); wherein Nb+Ta (min) is calculated from 10×C (min); wherein C (min) is minimum amount of the Carbon, (with 0.10 wt % Ta max).

39. Austenitic stainless steel base metal having a non-magnetic austenitic base metal microstructure comprising 0.40 to 0.70 wt % of Nitrogen and an alloy composition having a specified Pitting Resistance Equivalent ($PRE_N$) of ≥25; wherein $PRE_N$=wt % of Chromium+(3.3×wt % of Molybdenum)+(16×wt % of Nitrogen), and wherein the alloy composition further includes 16.00 wt % of Chromium to 30.00 wt % of Chromium (Cr); 8.00 wt % of Nickel to 27.00 wt % of Nickel (Ni); no more than 7.00 wt % of Molybdenum (Mo); 1.0 wt % of Manganese to less than 4.00 wt % of Manganese (Mn), no more than 1.0 wt % of Niobium (Nb), less than 0.10 wt % of Carbon (C), ≤0.070 wt % Oxygen, no more than 2.00 wt % of Silicon (Si), ≥0.03 wt % of Cerium and ≤0.08 wt % of Cerium, and a balance of iron and inevitable impurity, wherein ratio of the Manganese (Mn) to the Nitrogen (N) is controlled to less than 10.0; and wherein ratio of Chromium Equivalent [Cr] to Nickel Equivalent [Ni] is determined and controlled to more than 0.40 and less than 1.05; and wherein the Chromium Equivalent is determined and controlled according to a first formula:

$$[Cr]=(\text{wt \% Cr})+(1.5\times\text{wt \% Si})+(1.4\times\text{wt \% Mo})+(\text{wt \% Nb})-4.99;\text{ and}$$

wherein the Nickel Equivalent is determined and controlled according to a second formula:

$$[Ni]=(\text{wt \% Ni})+(30\times\text{wt \% C})+(0.5\times\text{wt \% Mn})+((26\times\text{wt \% }(N-0.02))+2.77;$$

and wherein the ratio of the [Cr] equivalent divided by the [Ni] equivalent is optimized at a melting stage in order to primarily obtain an austenitic microstructure in the base stainless steel after solution heat treatment performed in the range 1100 deg C. to 1250 deg C. followed by water quenching.

40. Austenitic stainless steel base metal having a non-magnetic austenitic base metal microstructure comprising 0.40 to 0.60 wt % of Nitrogen and an alloy composition having a specified Pitting Resistance Equivalent ($PRE_M$) of ≥25; wherein $PRE_N$=wt % of Chromium+(3.3×wt % of Molybdenum)+(16×wt % of Nitrogen) and wherein the alloy composition further includes 16.00 wt % of Chromium to 30.00 wt % of Chromium (Cr); 8.00 wt % of Nickel to 27.00 wt % of Nickel (Ni); no more than 7.00 wt % of Molybdenum (Mo); 1.0 wt % of Manganese to less than 4.00 wt % of Manganese (Mn), no more than 1.0 wt % of Niobium (Nb), less than 0.10 wt % of Carbon (C), ≤0.070 wt % Oxygen, no more than 2.00 wt % of Silicon (Si), ≥0.03 wt % of Cerium and ≤0.08 wt % of Cerium, and a balance of iron and inevitable impurity, wherein ratio of the Manganese (Mn) to the Nitrogen (N) is controlled to less than 10.0; and wherein ratio of Chromium Equivalent [Cr] to Nickel Equivalent [Ni] is determined and controlled to more than 0.40 and less than 1.05; and wherein the Chromium Equivalent is determined and controlled according to a first formula:

[Cr]=(wt % Cr)+(1.5×wt % Si)+(1.4×wt % Mo)+(wt % Nb)−4.99; and wherein the Nickel Equivalent is determined and controlled according to a second formula:

[Ni]=(wt % Ni)+(30×wt % C)+(0.5×wt % Mn)+((26×wt % (N−0.02))+2.77;

and wherein the ratio of the [Cr] equivalent divided by the [Ni] equivalent is optimized at a melting stage in order to primarily obtain an austenitic microstructure in the base stainless steel after solution heat treatment performed in the range 1100 deg C. to 1250 deg C. followed by water quenching.

41. Austenitic stainless steel base metal having a non-magnetic austenitic base metal microstructure comprising 0.50 wt % to 1.00 wt % of Tungsten, 0.40 to 0.70 wt % of Nitrogen, and an alloy composition having a specified Pitting Resistance Equivalent ($PRE_{NW}$)≥27; wherein $PRE_{NW}$=wt % of Chromium+[(3.3×wt % (Molybdenum+Tungsten)]+(16×wt % Nitrogen)

and wherein the alloy composition further includes 16.00 wt % of Chromium to 30.00 wt % of Chromium (Cr); 8.00 wt % of Nickel to 27.00 wt % of Nickel (Ni); no more than 7.00 wt % of Molybdenum (Mo); 1.0 wt % of Manganese to less than 4.00 wt % of Manganese (Mn), no more than 1.0 wt % of Niobium (Nb), less than 0.10 wt % of Carbon (C), ≤0.070 wt % Oxygen, no more than 2.00 wt % of Silicon (Si), >0.03 wt % of Cerium and ≤0.08 wt % of Cerium, and a balance of iron and inevitable impurity, wherein ratio of the Manganese (Mn) to the Nitrogen (N) is controlled to less than 10.0; and wherein ratio of Chromium Equivalent [Cr] to Nickel Equivalent [Ni] is determined and controlled to more than 0.40 and less than 1.05; and wherein the Chromium Equivalent is determined and controlled according to a first formula:

[Cr]=(wt % Cr)+(1.5×wt % Si)+(1.4×wt % Mo)+(wt % Nb)−4.99; and wherein the Nickel Equivalent is determined and controlled according to a second formula:

[Ni]=(wt % Ni)+(30×wt % C)+(0.5×wt % Mn)+((26×wt % (N−0.02))+2.77;

and wherein the ratio of the [Cr] equivalent divided by the [Ni] equivalent is optimized at a melting stage in order to primarily obtain an austenitic microstructure in the base stainless steel after solution heat treatment performed in the range 1100 deg C. to 1250 deg C. followed by water quenching.

42. Austenitic stainless steel base metal having a non-magnetic austenitic base metal microstructure comprising 0.40 to 0.60 wt % of Nitrogen, 0.50 wt % to 1.00 wt % of Tungsten and an alloy composition having a specified Pitting Resistance Equivalent ($PRE_{NW}$)≥27; wherein $PRE_{NW}$=wt % of Chromium+[(3.3×wt % (Molybdenum+Tungsten)]+(16×wt % Nitrogen)

and wherein the alloy composition further includes 16.00 wt % of Chromium to 30.00 wt % of Chromium (Cr); 8.00 wt % of Nickel to 27.00 wt % of Nickel (Ni); no more than 7.00 wt % of Molybdenum (Mo); 1.0 wt % of Manganese to less than 4.00 wt % of Manganese (Mn), no more than 1.0 wt % of Niobium (Nb) and less than 0.10 wt % of Carbon (C), ≤0.070 wt % Oxygen, no more than 2.00 wt % of Silicon (Si), ≥0.03 wt % of Cerium and ≤0.08 wt % of Cerium, a balance of iron and inevitable impurity, wherein ratio of the Manganese (Mn) to the Nitrogen (N) is controlled to less than 10.0; and wherein ratio of Chromium Equivalent [Cr] to Nickel Equivalent [Ni] is determined and controlled to more than 0.40 and less than 1.05; and wherein the Chromium Equivalent is determined and controlled according to a first formula:

[Cr]=(wt % Cr)+(1.5×wt % Si)+(1.4×wt % Mo)+(wt % Nb)−4.99; and wherein the Nickel Equivalent is determined and controlled according to a second formula:

[Ni]=(wt % Ni)+(30×wt % C)+(0.5×wt % Mn)+((26×wt % (N−0.02))+2.77;

and wherein the ratio of the [Cr] equivalent divided by the [Ni] equivalent is optimized at a melting stage in order to primarily obtain an austenitic microstructure in the base stainless steel after solution heat treatment performed in the range 1100 deg C. to 1250 deg C. followed by water quenching.

43. Austenitic stainless steel base metal according to claim 1, wherein the ratio of the Chromium Equivalents to Nickel Equivalents is determined and controlled to more than 0.45 and less than 0.95.

44. Wrought steel comprising the austenitic stainless steel base metal of claim 1.

45. Cast steel comprising the austenitic stainless steel base metal of claim 1.

46. Austenitic stainless steel base metal according to claim 1, wherein [Cr] and [Ni] are further defined by:

Chromium Equivalent, [Cr]=(wt % Cr)+(1.5×wt % Si)+(1.4×wt % Mo)+(wt % Nb)+(0.72×wt % W)+(2.27×wt % V)+(2.20×wt % Ti)+(0.21×wt % Ta)+(2.48×wt % Al)−4.99; and Nickel Equivalent, [Ni]=(wt % Ni)+(30×wt % C)+(0.5×wt % Mn)+((26×wt % (N−0.02))+(0.44% x wt % Cu)+2.77, wherein the wt % of Nb, W, V, Ti, Ta, Al and Cu are non-zero; and where Nb=Niobium W=Tungsten;

V=Vanadium;

Ti=Titanium;

Ta=Tantalum;

Al=Aluminium; and

Cu=Copper.

47. A method of manufacturing austenitic stainless steel base metal having a non-magnetic austenitic base metal microstructure comprising 16.00 wt % of Chromium to 30.00 wt % of Chromium (Cr); 8.00 wt % of Nickel to 27.00 wt % of Nickel (Ni); no more than 7.00 wt % of Molybdenum (Mo); 0.40 wt % of Nitrogen to 0.70 wt % of Nitrogen (N), 1.0 wt % of Manganese to less than 4.00 wt % of Manganese (Mn), no more than 1.0 wt % of Niobium (Nb), less than 0.10 wt % of Carbon (C), ≤0.070 wt % Oxygen, no more than 2.00 wt % of silicon, ≥0.03 wt % of Cerium and ≤0.08 wt % of Cerium, and a balance of iron and inevitable impurity, the method comprising:

(i) performing solution heat treatment of a metal alloy composition at a temperature between 1100° C. and 1250° C., wherein a ratio of Chromium equivalent divided by Nickel equivalent is optimized at a melting stage in order to primarily obtain an austenitic microstructure in the base stainless steel after solution heat treatment performed in the range 1100 deg C. to 1250 deg C. followed by water quenching to form the non-magnetic austenitic stainless steel base metal microstructure;

wherein, ratio of the Manganese (Mn) to the Nitrogen (N) is controlled to less than 10.0; and ratio of Chromium Equivalent [Cr] to Nickel Equivalent [Ni] is determined and controlled to more than 0.40 and less than 1.05; and wherein the Chromium Equivalent is determined and controlled according to a first formula:

$$[Cr]=(\text{wt \% Cr})+(1.5\times\text{wt \% Si})+(1.4\times\text{wt \% Mo})+(\text{wt \% Nb})-4.99;\ \text{and}$$

wherein the Nickel Equivalent is determined and controlled according to a second formula:

$$[Ni]=(\text{wt \% Ni})+(30\times\text{wt \% C})+(0.5\times\text{wt \% Mn})+((26\times\text{wt \% (N}-0.02))+2.77.$$

* * * * *